US008439807B2

(12) United States Patent
Piaget et al.

(10) Patent No.: US 8,439,807 B2
(45) Date of Patent: May 14, 2013

(54) EXERCISE DEVICE WITH TREADLES

(75) Inventors: Gary Piaget, Deerharbor, WA (US); Douglas A. Crawford, Lafayette, CO (US); Edward L. Flick, Portland, OR (US); Bradley J. Smith, Tyler, TX (US); Matt Rauwerdink, Portland, OR (US); Patrick A. Warner, Boulder, CO (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 13/372,750

(22) Filed: Feb. 14, 2012

(65) Prior Publication Data

US 2012/0142501 A1 Jun. 7, 2012

Related U.S. Application Data

(63) Continuation of application No. 12/494,580, filed on Jun. 30, 2009, now Pat. No. 8,113,994, which is a continuation of application No. 10/789,294, filed on Feb. 26, 2004, now Pat. No. 7,553, 260.

(60) Provisional application No. 60/450,789, filed on Feb. 28, 2003, provisional application No. 60/450,890, filed on Feb. 28, 2003, provisional application No. 60/451,104, filed on Feb. 28, 2003.

(51) Int. Cl.
*A63B 22/02* (2006.01)

(52) U.S. Cl.
USPC ..... 482/52; 482/54

(58) Field of Classification Search ..... 482/51–54, 482/121–130, 79–80
See application file for complete search history.

(56) References Cited

U.S. PATENT DOCUMENTS

| | | | |
|---|---|---|---|
| 347,101 | A | 8/1886 | Ferry |
| 834,461 | A | 10/1906 | Fair |
| 964,898 | A | 7/1910 | Budingen |
| 1,082,940 | A | 12/1913 | Flora |

(Continued)

FOREIGN PATENT DOCUMENTS

| | | | |
|---|---|---|---|
| CN | 2516185 | Y | 10/2002 |
| CN | 2675190 | Y | 2/2005 |
| FR | 2806921 | A3 | 10/2001 |
| TW | 184377 | | 5/1992 |

OTHER PUBLICATIONS

U.S. Appl. No. 12/796,554, filed Jun. 8, 2010, Lull et al.
U.S. Appl. No. 13/626,002, filed Sep. 25, 2012, Weier.
U.S. Appl. No. 13/619,799, filed Sep. 14, 2012, Piaget et al.
U.S. Appl. No. 13/619,902, filed Sep. 14, 2012, Piaget et al.

*Primary Examiner* — Stephen Crow
(74) *Attorney, Agent, or Firm* — Dorsey & Whitney LLP

(57) ABSTRACT

An exercise device employing side-by-side pivotally supported moving surfaces. In one particular example, an exercise device employs a first belt deployed about a front roller and a rear roller and an adjacent second belt deployed about a front roller and a rear roller. The rear of the belts in the area of the rear rollers are pivotally secured and the front of the belts in the area of the front roller are adapted to reciprocate in an up and down motion during use. In some implementations, the moving surfaces include an interconnection structure such that a generally downward movement of one surface is coordinated with a generally upward movement of the other surface. In other implementations, the moving surfaces are operably associated with one or more resistance elements that effect the amount of force required to pivot or actuate the moving surfaces.

6 Claims, 43 Drawing Sheets

U.S. PATENT DOCUMENTS

| | | | | |
|---|---|---|---|---|
| 1,652,102 | A | 12/1927 | Elmer et al. | |
| 2,017,128 | A | 10/1935 | O'Neill, Jr. | |
| 2,117,957 | A | 5/1938 | Heller | |
| 2,512,904 | A | 6/1950 | Strelecky | |
| 2,661,973 | A | 12/1953 | Sweger | |
| 2,941,834 | A | 6/1960 | Appleton et al. | |
| 3,408,067 | A | 10/1968 | Armstrong | |
| 3,580,340 | A | 5/1971 | Brown | |
| 3,637,206 | A | 1/1972 | Chickering, III | |
| 3,642,279 | A | 2/1972 | Cutter | |
| 3,650,529 | A | 3/1972 | Salm et al. | |
| 3,711,090 | A | 1/1973 | Fiedler | |
| 3,792,860 | A | 2/1974 | Selnes | |
| 3,826,491 | A | 7/1974 | Elder | |
| 4,066,257 | A | 1/1978 | Moller | |
| 4,126,326 | A | 11/1978 | Phillips | |
| 4,204,673 | A | 5/1980 | Speer, Sr. | |
| 4,274,625 | A | 6/1981 | Gaetano | |
| 4,334,676 | A | 6/1982 | Schonenberger | |
| 4,342,452 | A | 8/1982 | Summa | |
| 4,344,616 | A | 8/1982 | Ogden | |
| 4,374,587 | A | 2/1983 | Ogden | |
| 4,406,451 | A | 9/1983 | Gaetano | |
| 4,423,864 | A | 1/1984 | Wiik | |
| 4,555,108 | A | 11/1985 | Monteiro | |
| 4,659,074 | A | 4/1987 | Taitel et al. | |
| 4,659,077 | A | 4/1987 | Stropkay | |
| 4,733,858 | A | 3/1988 | Lan | |
| 4,747,612 | A | 5/1988 | Kuhn | |
| 4,830,362 | A | 5/1989 | Bull | |
| 4,949,993 | A | 8/1990 | Stark et al. | |
| 5,039,088 | A | 8/1991 | Shifferaw | |
| 5,048,821 | A | 9/1991 | Kuo-Liang | |
| 5,054,770 | A | 10/1991 | Bull | |
| D326,491 | S | 5/1992 | Dalebout | |
| 5,110,117 | A | 5/1992 | Fisher et al. | |
| 5,135,447 | A | 8/1992 | Robards, Jr. et al. | |
| 5,139,255 | A | 8/1992 | Sollami | |
| 5,163,888 | A | 11/1992 | Stearns | |
| 5,199,934 | A | 4/1993 | Lin | |
| 5,226,866 | A | 7/1993 | Engel et al. | |
| 5,238,462 | A | 8/1993 | Cinke et al. | |
| 5,263,910 | A | 11/1993 | Yang | |
| 5,267,923 | A | 12/1993 | Piaget et al. | |
| 5,282,776 | A | 2/1994 | Dalebout | |
| 5,299,993 | A | 4/1994 | Habing | |
| 5,308,300 | A | 5/1994 | Chino et al. | |
| 5,320,588 | A | 6/1994 | Wanzer et al. | |
| 5,336,142 | A | 8/1994 | Dalebout et al. | |
| 5,336,146 | A * | 8/1994 | Piaget et al. | 482/54 |
| 5,338,273 | A | 8/1994 | Metcalf et al. | |
| 5,370,592 | A | 12/1994 | Wu | |
| 5,372,560 | A | 12/1994 | Chang | |
| 5,385,520 | A | 1/1995 | Lepine et al. | |
| 5,411,279 | A | 5/1995 | Magid | |
| 5,431,612 | A | 7/1995 | Holden | |
| 5,441,467 | A | 8/1995 | Stevens | |
| 5,460,586 | A | 10/1995 | Wilkinson et al. | |
| 5,492,517 | A | 2/1996 | Bostic et al. | |
| 5,518,470 | A | 5/1996 | Piaget et al. | |
| 5,538,489 | A | 7/1996 | Magid | |
| 5,575,740 | A | 11/1996 | Piaget et al. | |
| 5,607,376 | A | 3/1997 | Magid | |
| 5,626,539 | A | 5/1997 | Piaget et al. | |
| 5,643,144 | A | 7/1997 | Trulaske | |
| 5,645,512 | A | 7/1997 | Yu | |
| 5,669,856 | A * | 9/1997 | Liu | 482/51 |
| 5,679,101 | A | 10/1997 | Magid | |
| 5,690,582 | A | 11/1997 | Ulrich et al. | |
| 5,749,807 | A | 5/1998 | Webb | |
| 5,762,587 | A | 6/1998 | Dalebout et al. | |
| 5,803,874 | A | 9/1998 | Wilkinson | |
| 5,803,880 | A | 9/1998 | Allen | |
| 5,816,372 | A | 10/1998 | Carlson et al. | |
| 5,833,584 | A | 11/1998 | Piaget et al. | |
| 5,871,421 | A | 2/1999 | Trulaske et al. | |
| D406,621 | S | 3/1999 | Piaget | |
| 5,879,271 | A | 3/1999 | Stearns et al. | |
| 5,882,281 | A | 3/1999 | Stearns et al. | |
| 5,897,459 | A | 4/1999 | Habing et al. | |
| 5,897,460 | A | 4/1999 | McBride et al. | |
| 5,897,461 | A | 4/1999 | Socwell | |
| 5,913,384 | A | 6/1999 | Williams | |
| 5,919,115 | A | 7/1999 | Horowitz et al. | |
| D412,953 | S | 8/1999 | Armstrong | |
| 5,967,944 | A | 10/1999 | Vittone et al. | |
| 5,993,358 | A | 11/1999 | Gureghian et al. | |
| D421,779 | S | 3/2000 | Piaget et al. | |
| 6,033,344 | A | 3/2000 | Trulaske et al. | |
| 6,042,513 | A | 3/2000 | Koteles et al. | |
| 6,042,519 | A | 3/2000 | Shea | |
| D424,137 | S | 5/2000 | Barker et al. | |
| 6,113,518 | A | 9/2000 | Maresh et al. | |
| 6,135,925 | A | 10/2000 | Liu | |
| 6,152,859 | A | 11/2000 | Stearns | |
| 6,217,487 | B1 | 4/2001 | Reinert | |
| D445,152 | S | 7/2001 | Wang et al. | |
| 6,258,012 | B1 | 7/2001 | Yoshimura | |
| 6,264,042 | B1 | 7/2001 | Cossey, Jr. et al. | |
| 6,283,896 | B1 | 9/2001 | Grunfeld et al. | |
| D450,792 | S | 11/2001 | Kuo | |
| 6,409,633 | B1 | 6/2002 | Abelbeck | |
| 6,454,679 | B1 | 9/2002 | Radow | |
| 6,461,279 | B1 | 10/2002 | Kuo | |
| 6,554,749 | B2 | 4/2003 | Iund et al. | |
| 6,626,802 | B1 | 9/2003 | Rodgers, Jr. | |
| D482,085 | S | 11/2003 | Eyler et al. | |
| 6,645,124 | B1 | 11/2003 | Clem | |
| 6,761,667 | B1 | 7/2004 | Cutler et al. | |
| 6,811,517 | B1 * | 11/2004 | Eschenbach | 482/52 |
| 6,811,519 | B2 * | 11/2004 | Kuo | 482/54 |
| 6,835,166 | B1 * | 12/2004 | Stearns et al. | 482/52 |
| 6,849,034 | B2 | 2/2005 | Eschenbach | |
| 6,872,168 | B2 * | 3/2005 | Wang et al. | 482/54 |
| 6,893,383 | B1 | 5/2005 | Chang et al. | |
| 6,902,513 | B1 | 6/2005 | McClure | |
| 6,923,745 | B2 | 8/2005 | Stearns | |
| 6,923,746 | B1 | 8/2005 | Skowronski et al. | |
| D527,060 | S * | 8/2006 | Flick et al. | D21/669 |
| 7,097,593 | B2 * | 8/2006 | Chang | 482/54 |
| D534,973 | S * | 1/2007 | Flick et al. | D21/669 |
| 7,166,062 | B1 | 1/2007 | Watterson et al. | |
| 7,169,088 | B2 * | 1/2007 | Rodgers, Jr. | 482/52 |
| 7,169,089 | B2 * | 1/2007 | Rodgers, Jr. | 482/52 |
| 7,172,531 | B2 * | 2/2007 | Rodgers, Jr. | 482/52 |
| 7,179,201 | B2 * | 2/2007 | Rodgers, Jr. | 482/52 |
| 7,201,705 | B2 * | 4/2007 | Rodgers, Jr. | 482/52 |
| 7,214,168 | B2 * | 5/2007 | Rodgers, Jr. | 482/52 |
| D546,909 | S * | 7/2007 | Flick | D21/694 |
| 7,244,217 | B2 * | 7/2007 | Rodgers, Jr. | 482/52 |
| 7,306,546 | B2 * | 12/2007 | Lo | 482/52 |
| 7,341,542 | B2 * | 3/2008 | Ohrt et al. | 482/52 |
| 7,455,626 | B2 * | 11/2008 | Trevino et al. | 482/54 |
| 7,462,134 | B2 * | 12/2008 | Lull et al. | 482/52 |
| 7,517,303 | B2 * | 4/2009 | Crawford et al. | 482/54 |
| 7,544,153 | B2 * | 6/2009 | Trevino et al. | 482/54 |
| 7,553,260 | B2 * | 6/2009 | Piaget et al. | 482/54 |
| 7,618,346 | B2 * | 11/2009 | Crawford et al. | 482/8 |
| 7,621,850 | B2 * | 11/2009 | Piaget et al. | 482/54 |
| 7,645,214 | B2 * | 1/2010 | Lull | 482/51 |
| 7,704,191 | B2 * | 4/2010 | Smith et al. | 482/51 |
| 7,731,636 | B2 * | 6/2010 | Lull et al. | 482/52 |
| 7,736,278 | B2 * | 6/2010 | Lull et al. | 482/52 |
| 7,758,473 | B2 * | 7/2010 | Lull et al. | 482/52 |
| 7,785,235 | B2 * | 8/2010 | Lull et al. | 482/52 |
| D624,975 | S * | 10/2010 | Flick et al. | D21/696 |
| 7,811,209 | B2 * | 10/2010 | Crawford et al. | 482/54 |
| 7,815,549 | B2 * | 10/2010 | Crawford et al. | 482/52 |
| 7,819,779 | B2 * | 10/2010 | Chang | 482/54 |
| 7,887,466 | B1 * | 2/2011 | Chen | 482/54 |
| 7,967,730 | B2 * | 6/2011 | Crawford et al. | 482/8 |
| 8,002,674 | B2 * | 8/2011 | Piaget et al. | 482/52 |
| RE42,698 | E * | 9/2011 | Kuo et al. | 482/54 |
| 8,062,187 | B2 * | 11/2011 | Lull et al. | 482/52 |
| 8,113,994 | B2 * | 2/2012 | Piaget et al. | 482/52 |
| 8,147,385 | B2 * | 4/2012 | Crawford et al. | 482/52 |

2001/0016542 A1* 8/2001 Yoshimura ..... 482/54
2004/0162193 A1 8/2004 Gray et al.
2009/0029831 A1 1/2009 Weier
2010/0093500 A1 4/2010 Elbaz et al.
2011/0312472 A1 12/2011 Piaget et al.
2012/0190509 A1 7/2012 Crawford et al.

* cited by examiner

EXERCISE DEVICE WITH TREADLES

CROSS REFERENCE TO RELATED APPLICATIONS

The present application is a continuation of U.S. patent application Ser. No. 12/494,580 (the "'580 Application") filed Jun. 30, 2009, now U.S. Pat. No. 8,113,994, which is a continuation of U.S. patent application Ser. No. 10/789,294 (the "'294 Application"), filed Feb. 26, 2004, now U.S. Pat. No. 7,553,260, and entitled "Exercise Device With Treadles," which claims the benefit under 35 U.S.C. §119(e) of U.S. Provisional Patent Application No. 60/450,789 (the "'789 Application"), filed on Feb. 28, 2003, and entitled "Dual Deck Exercise Device," U.S. Provisional Patent Application No. 60/450,890 (the "'890 Application"), filed Feb. 28, 2003, and entitled "System and Method For Controlling an Exercise Apparatus," and U.S. Provisional Patent Application No. 60/451,104 (the "'104 Application"), filed Feb. 28, 2003, and entitled "Exercise Device With Treadles." The '580, '294, '789, '890, and '104 Applications are hereby incorporated by reference into the present application in their entireties.

The present application incorporates by reference in its entirety, as if fully described herein, the subject matter disclosed in the following U.S. applications:

U.S. patent application Ser. No. 10/789,182, filed on Feb. 26, 2004, now U.S. Pat. No. 7,621,850, and entitled "Dual Deck Exercise Device";

U.S. patent application Ser. No. 10/789,579, filed on Feb. 26, 2004, now U.S. Pat. No. 7,618,346, and entitled "System and Method For Controlling an Exercise Apparatus";

U.S. Provisional Patent Application No. 60/548,265 filed on Feb. 26, 2004 and entitled "Exercise Device with Treadles";

U.S. Provisional Patent Application No. 60/548,786 filed on Feb. 26, 2004 and entitled "Control System and Method for an Exercise Apparatus";

U.S. Provisional Patent Application No. 60/548,811 filed on Feb. 26, 2004 and entitled "Dual Treadmill Exercise Device Having a Single Rear Roller";

U.S. Provisional Patent Application No. 60/548,787 filed on Feb. 26, 2004 and entitled "Hydraulic Resistance, Arm Exercise, and Non-Motorized Dual Deck Treadmills"; and U.S. Design Application No. 29/176,966, filed on Feb. 28, 2003, now U.S. Design Pat. No. D534,973, and entitled "Exercise Device with Treadles".

FIELD OF THE INVENTION

The present invention generally involves the field of exercise devices, and more particularly involves an exercise device including interconnected treadles with moving surfaces provided thereon. The present invention also involves various treadle interconnection mechanisms, treadle dampening mechanisms, and treadle reciprocation enhancement mechanisms.

BACKGROUND OF THE INVENTION

The health benefits of regular exercise are well known. Many different types of exercise equipment have been developed over time, with various success, to facilitate exercise. Examples of successful classes of exercise equipment include the treadmill and the stair climbing machine. A conventional treadmill typically includes a continuous belt providing a moving surface that a user may walk, jog, or run on. A conventional stair climbing machine typically includes a pair of links adapted to pivot up and down providing a pair of surfaces or pedals that a user may stand on and press up and down to simulate walking up a flight of stairs.

Various embodiments and aspects of the present invention involve an exercise machine that provides side-by-side moving surfaces that are pivotally supported at one end and adapted to pivot up and down at an opposite end. With a device conforming to the present invention, two pivotable moving surfaces are provided in a manner that provides some or all of the exercise benefits of using a treadmill with some or all of the exercise benefits of using a stair climbing machine. Moreover, an exercise machine conforming to aspects of the present invention provides additional health benefits that are not recognized by a treadmill or a stair climbing machine alone. These and numerous other embodiments and aspects of the present invention are discussed in greater detail below.

SUMMARY OF THE INVENTION

Aspects of the present invention involve an exercise apparatus comprising a first treadle assembly providing a first moving surface, the first treadle assembly arranged to pivot; a second treadle assembly providing a second moving surface, the second treadle assembly arranged to pivot; an interconnection assembly operably coupled between the first treadle assembly and with the second treadle assembly; and at least one resistance element operably coupled with the interconnection assembly.

In one particular aspect of the invention, the first moving surface may comprise a first roller and a second roller and an endless belt in rotatable engagement with the first and second roller; and the second moving surface may comprise a third roller and a fourth roller and a second endless belt in rotatable engagement with the third and fourth roller.

In one particular aspect of the invention, the interconnection assembly comprises a rocker arm arranged to pivot about a first pivot point. The rocker arm may comprise a first portion and a second portion to either side of the first pivot point, the first portion coupled with the first treadle assembly and the second portion coupled with the second treadle assembly. The interconnection assembly may further comprise a first rod, such as a turnbuckle, connected between the first portion of the rocker arm and the first treadle assembly; and a second rod, such as a turnbuckle, connected between the second portion of the rocker arm and the second treadle assembly.

Alternatively, in another aspect of the invention, the interconnection assembly may comprise at least one pulley connected with the frame structure; and at least one cable operably supported between the at least one pulley, the first treadle assembly and the second assembly. The at least one pulley may comprise at least one first pulley connected with the frame structure above the first treadle assembly; and at least one second pulley connected with the frame structure above the second treadle assembly. Further, the first treadle assembly may include a third pulley; the second treadle assembly includes a fourth pulley; and the at least one cable may be operably supported by the third pulley and the fourth pulley.

With regard to the resistance element, in one aspect of the invention, the resistance element comprises a rotationally elastic member. Alternatively, the resistance element comprises a clutch. Further, in one example, the interconnection assembly comprises a rocker arm adapted to pivot about a pivot axis, and the clutch comprises a first clutch plate operably connected with the rocker arm and a second clutch plate adapted to engage the first clutch plate to provide a resistance between the first and second clutch plates. The second clutch plate may be adjustably arranged to provide an adjustable resistance between the first clutch plate and the second clutch plate. The second clutch plate is supported by a pivotable bracket, the pivotable bracket comprising a biasing member to adjust the second clutch. Further, a spring member may be arranged to urge the second clutch plate against the first clutch plate.

Alternatively, still with regard to the resistance element, the exercise device further comprises a frame and the resistance element comprises at least one spring element operably coupled between the frame and the rocker arm type interconnection assembly. The at least one spring may be coupled to the rocker arm distally from the first pivot point.

In another alternative, still referring to the resistance element, the exercise apparatus further comprises a frame; the rocker arm comprises a pivot axle; the resistance element comprises a pulley operably coupled with the pivot axle; and at least one spring operably coupled between the pulley and the frame.

Alternatively, the rocker arm comprises a pivot axle and a brake is operably coupled with the pivot axle. The brake may comprises a fluid filled vessel with an impeller blade.

In another aspect of the invention, an exercise apparatus comprises a first treadle assembly providing a first moving surface including a first roller and a second roller and an endless belt in rotatable engagement with the first and second roller, the first treadle assembly arranged to pivot; and a resistance device comprising a first disk and a first strap connected between the first treadle assembly, around the disk, and with the base frame.

In another aspect of the invention, an exercise apparatus comprises a frame; a first treadle assembly providing a first moving surface, the first treadle assembly arranged to pivot; a second treadle assembly providing a second moving surface, the second treadle assembly arranged to pivot; an interconnection assembly operably coupled between the first treadle assembly and with the second treadle assembly; and a resistance element coupled with the first treadle and the second treadle, the resistance element comprising a pivotally supported bracket having a first section and a second section to either side of a pivot axle, a first cable coupled between the first treadle assembly and the first side, a first shock coupled between the first section and the frame, a second cable coupled between the second cable coupled between the second treadle and the second side, and a second shock coupled between the second section and the frame.

In another aspect of the invention, an exercise apparatus comprises an exercise apparatus comprises a base frame; a first treadle assembly including a first roller and a second roller and an endless belt in rotatable engagement with the first and second roller, the first treadle assembly pivotally connected with the base frame; a second treadle assembly including a third roller and a fourth roller and a second endless belt in rotatable engagement with the third and fourth roller, the second treadle assembly pivotally connected with the base frame; and means for locking out the treadle assemblies connected with the first treadle assembly and the second treadle assembly, the lock out mechanism movable between a position where the first and second treadle assembly may pivot upward and downward and a position where the first and second treadle assembly may not pivot upward and downward.

In another aspect of the invention, an exercise apparatus for a user with a first foot and a second foot, the exercise device comprises a frame structure; a first treadle assembly pivotally connected with the frame structure, the first treadle assembly including an endless belt; a second treadle assembly pivotally connected with the frame structure, the second treadle assembly including a second endless belt; an interconnection member operably connected with the first treadle assembly and with the second treadle assembly; at least one resistance element operably associated with the interconnection assembly; and whereby, during use of the exercise device, a first foot moves rearwardly and downwardly and a second foot moves rearwardly and upwardly.

In another aspect of the invention, an exercise apparatus comprises a frame structure; a first treadle assembly providing a first moving surface and an endless belt in rotatable engagement with the first and second roller, the first treadle assembly pivotally connected with a the frame structure; a second treadle assembly providing a second moving surface, including a third roller and a fourth roller and a second endless belt in rotatable engagement with the third and fourth roller, the second treadle assembly pivotally connected with the frame structure; a first springless shock connected between the first treadle assembly and the frame structure; and a second springless shock connected between the second treadle assembly and the frame structure.

The first moving surface may comprise an endless belt in rotatable engagement with the first and second roller; and the second moving surface comprise a second endless belt in rotatable engagement with the third and fourth roller.

In another aspect of the invention, the exercise apparatus comprises a frame structure; a first treadle assembly including a first roller and a second roller and an endless belt in rotatable engagement with the first and second roller, the first treadle assembly pivotally connected with the frame structure; a second treadle assembly including a third roller and a fourth roller and a second endless belt in rotatable engagement with the third and fourth roller, the second treadle assembly pivotally connected with the frame structure; and an interconnection member operably associated with the first treadle assembly and the second assembly; whereby the interconnection member may be configured in a shipping configuration where the first treadle assembly and second treadle assembly are lowered with respect to the base frame.

The interconnection member may comprise a rocker arm assembly. The rocker arm assembly may include a spring loaded axle pivotally supported in a bracket defining an elongate slot.

Further, the present invention provides a skid plate utilized on an exercise apparatus having a first treadle assembly and a second treadle assembly. The skid plate acts to keep the treadle assemblies in parallel alignment with respect to each other.

In one aspect of the present invention, a skid plate for maintaining parallel alignment between a first treadle assembly and a second treadle assembly on an exercise apparatus includes a member having a front side defined by a first side and a second side separated by a third side and a fourth side, and further defined by a thickness separating said front side from a rear side.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

The detailed description will refer to the following drawings, wherein like numerals refer to like elements, and wherein.

DETAILED DESCRIPTION

Figure 1:
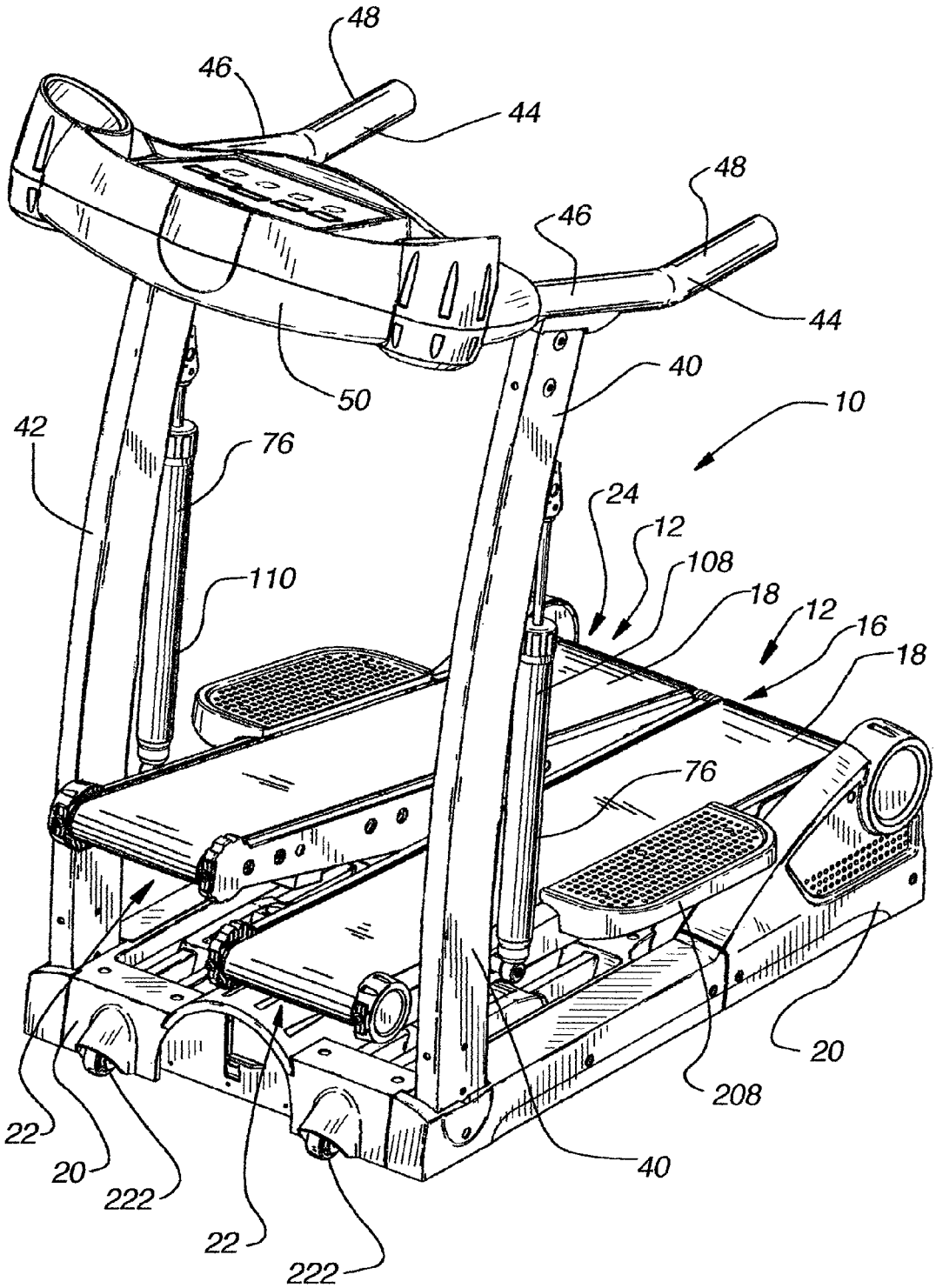
FIG. 1 is an isometric view of one embodiment of an exercise device, in accordance with the present invention.

An exercise device 10 conforming to the present invention may be configured to provide a user with a walking-type exercise, a stepping-type exercise or a climbing-like exercise that is a combination of both walking and stepping. The exercise device generally includes two treadmill-like assemblies 12 (referred to herein as a "treadle" or a "treadle assembly") pivotally connected with a frame 14 so that the treadles may pivot up and down about a common axis 16. Each treadle includes a tread belt 18 that provides a moving surface like a treadmill. In use, a user will walk, jog, or run on the treadles and the treadles will reciprocate about the common axis. The treadles are interconnected so that upward movement of one treadle is accompanied by downward movement of the other treadle. The combination of the moving surface of the tread belts and the coordinated and interconnected reciprocation of the treadles provides an exercise that is similar to climbing on a loose surface, such as walking, jogging, or running up a sand dune where each upward and forward foot movement is accompanied by the foot slipping backward and downward. Extraordinary cardiovascular and other health benefits are achieved by such a climbing-like exercise. Moreover, as will be recognized from the following discussion, the extraordinary health benefits are achieved in a low impact manner.

Figure 2:
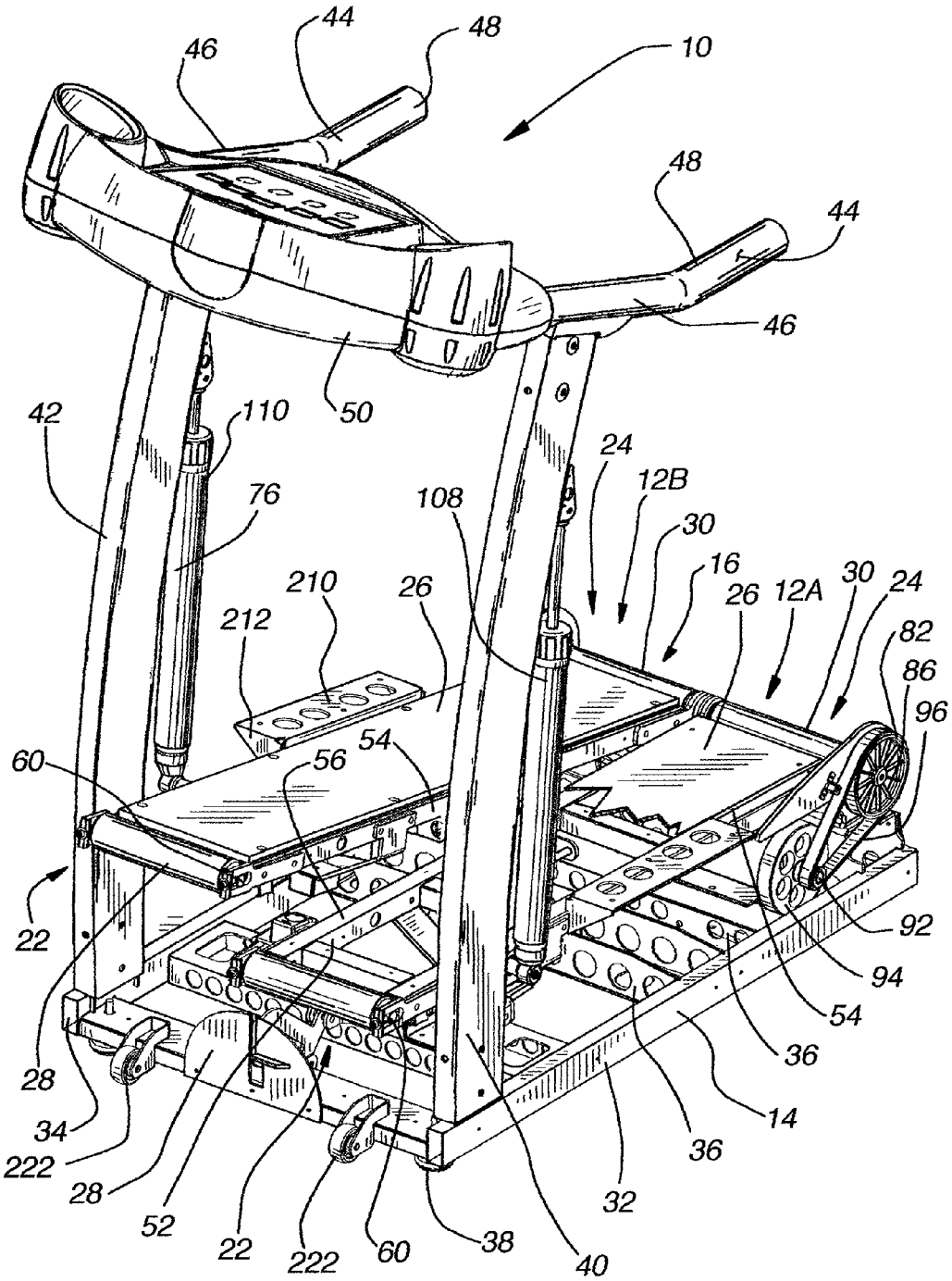
FIG. 2 is an isometric view of the exercise device shown in FIG. 1 with decorative and protective side panels removed to better illustrate various components of the exercise.

FIG. 1 is an isometric view of one example of an exercise device conforming to the present invention. The embodiment of the exercise device illustrated in FIG. 1 includes protective and decorative panels 20, which in some instances obscure the view of some components of the exercise device. FIG. 2 is an isometric view the exercise device illustrated in FIG. 1 with the protective and decorative panels removed to better illustrate all of the components of the device. The other views of the exercise device shown in FIGS. 3-8, and others, in most instances, do not include the protective and decorative panels.

Referring to FIGS. 1, 2 and others, the exercise device includes a first treadle assembly 12A and a second treadle assembly 12B, each having a front portion 22 and a rear portion 24. The rear portions of the treadle assemblies 12 are pivotally supported at the rear of the exercise device 10. The front portions 22 of the treadle assemblies are supported above the frame 14, and are configured to reciprocate in a generally up and down manner during use. It is also possible to pivotally support the treadles at the front of the exercise device, and support the rear of the treadle assemblies above the frame. The treadle assemblies also supports an endless belt or "tread belt" that rotates over a deck 26 and about front 28 and rear 30 rollers to provide either a forward or rearward moving surface.

A user may perform exercise on the device facing toward the front of the treadle assemblies (referred to herein as "forward facing use") or may perform exercise on the device facing toward the rear of the treadle assemblies (referred to herein as "rearward facing use"). The term "front," "rear," and "right" are used herein with the perspective of a user standing on the device in the forward facing manner the device will be typically used. During any method of use, the user may walk, jog, run, and/or step on the exercise device in a manner where each of the user's feet contact one of the treadle assemblies. For example, in forward facing use, the user's left foot will typically only contact the left treadle assembly 12A and the user's right foot will typically only contact the right treadle assembly 12B. Alternatively, in rearward facing use, the user's left foot will typically only contact the right treadle assembly 12B and the user's right foot will typically only contact the left treadle assembly 12A.

An exercise device conforming to aspects of the invention may be configured to only provide a striding motion or to only provide a stepping motion. For a striding motion, the treadle assemblies are configured to not reciprocate and the endless belts 18 configured to rotate. The term "striding motion" is meant to refer to any typical human striding motion such as walking, jogging and running. For a stepping motion, the treadle assemblies are configured to reciprocate and the endless belts are configured to not rotate about the rollers. The term "stepping motion" is meant to refer to any typical stepping motion, such as when a human walks up stairs, uses a conventional stepper exercise device, walks up a hill, etc.

As mentioned above, the rear 24 of each treadle assembly is pivotally supported at the rear of the exercise device. The front of each treadle assembly is supported above the front portion of the exercise device so that the treadle assemblies may pivot upward and downward. When the user steps on a tread belt 18, the associated treadle assembly 12A, 12B (including the belt) will pivot downwardly. As will be described in greater detail below, the treadle assemblies 12 are interconnected such that downward or upward movement of one treadle assembly will cause a respective upward or downward movement of the other treadle assembly. Thus, when the user steps on one belt 18, the associated treadle assembly will pivot downwardly while the other treadle assembly will pivot upwardly. With the treadle assemblies configured to move up and down and the tread belts configured to provide a moving striding surface, the user may achieve an exercise movement that encompasses a combination of walking and stepping.

FIG. 2 is a partial cutaway isometric view of the embodiment of the exercise device 10 shown in FIG. 1. With regard to the left and right treadle assemblies, the tread belt is removed to show the underlying belt platform or "Deck" 26 and the front roller 28 and the rear roller 30. In addition, the belt platform of the left treadle is partially cut away to show the underlying treadle frame components. Referring to FIG. 2 and others, the exercise device includes the underlying main frame 14. The frame provides the general structural support for the moving components and other components of the exercise device. The frame includes a left side member 32, a right side member 34 and a plurality of cross members 36 interconnecting the left side and right side members to provide a unitary base structure. The frame may be set directly on the floor or a may be supported on adjustable legs, cushions, bumpers, or combinations thereof. In the implementation of FIG. 2, adjustable legs 38 are provided at the bottom front left and front right corners of the frame.

Figure 5:
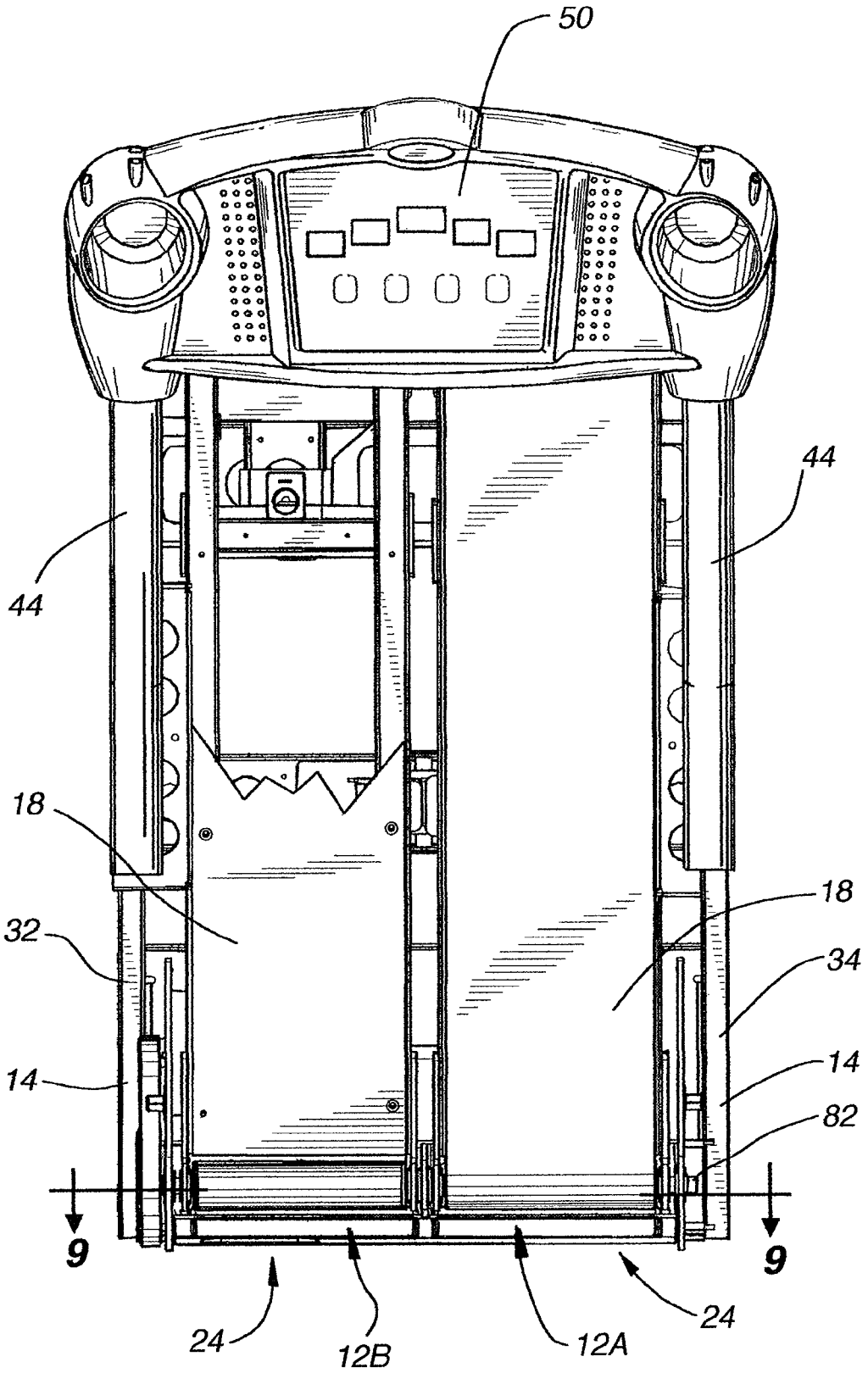
FIG. 5 is top view of the exercise device shown in FIG. 2.
Figure 7:
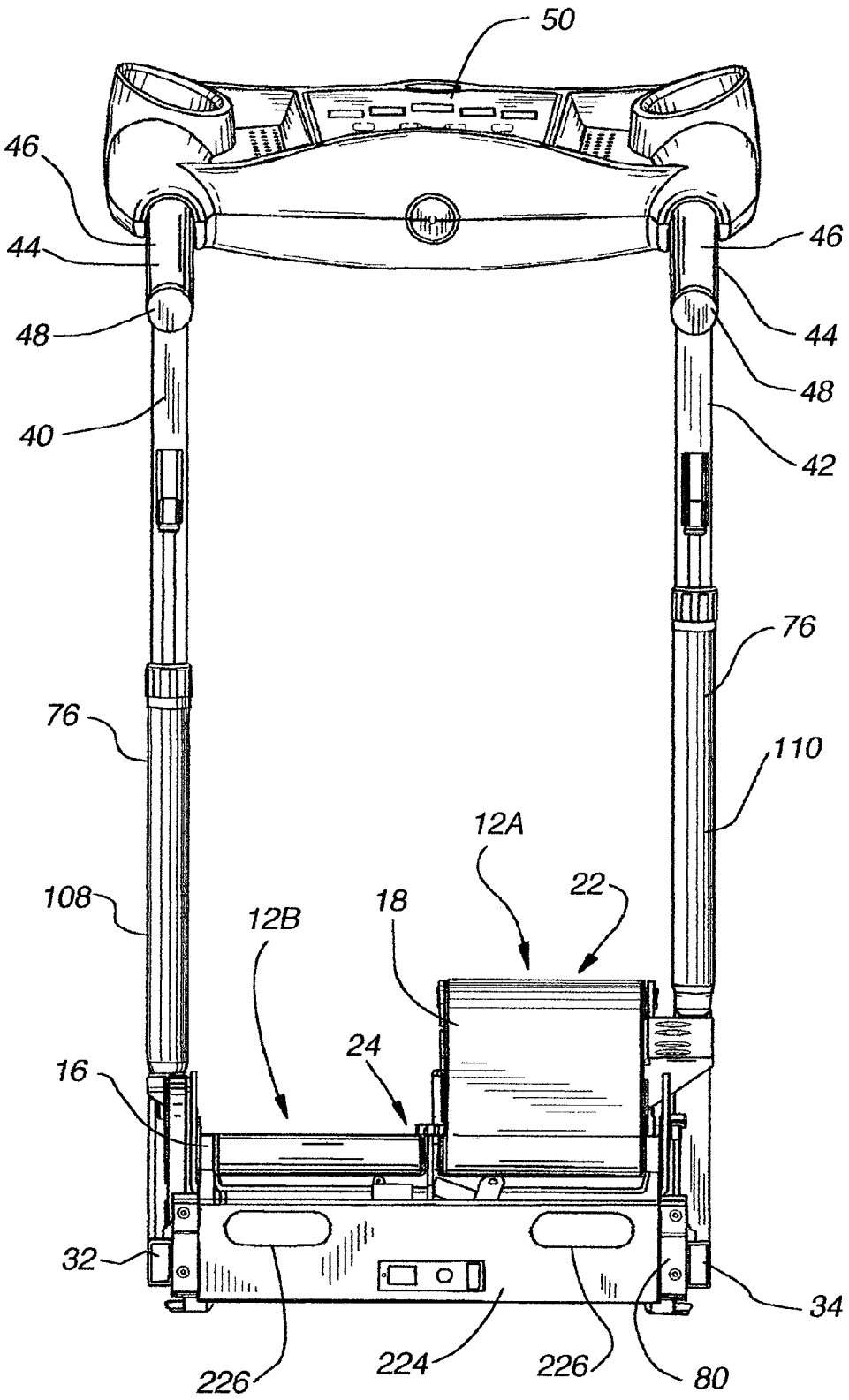
FIG. 7 is a rear view of the exercise device shown in FIG. 2.
Figure 8:
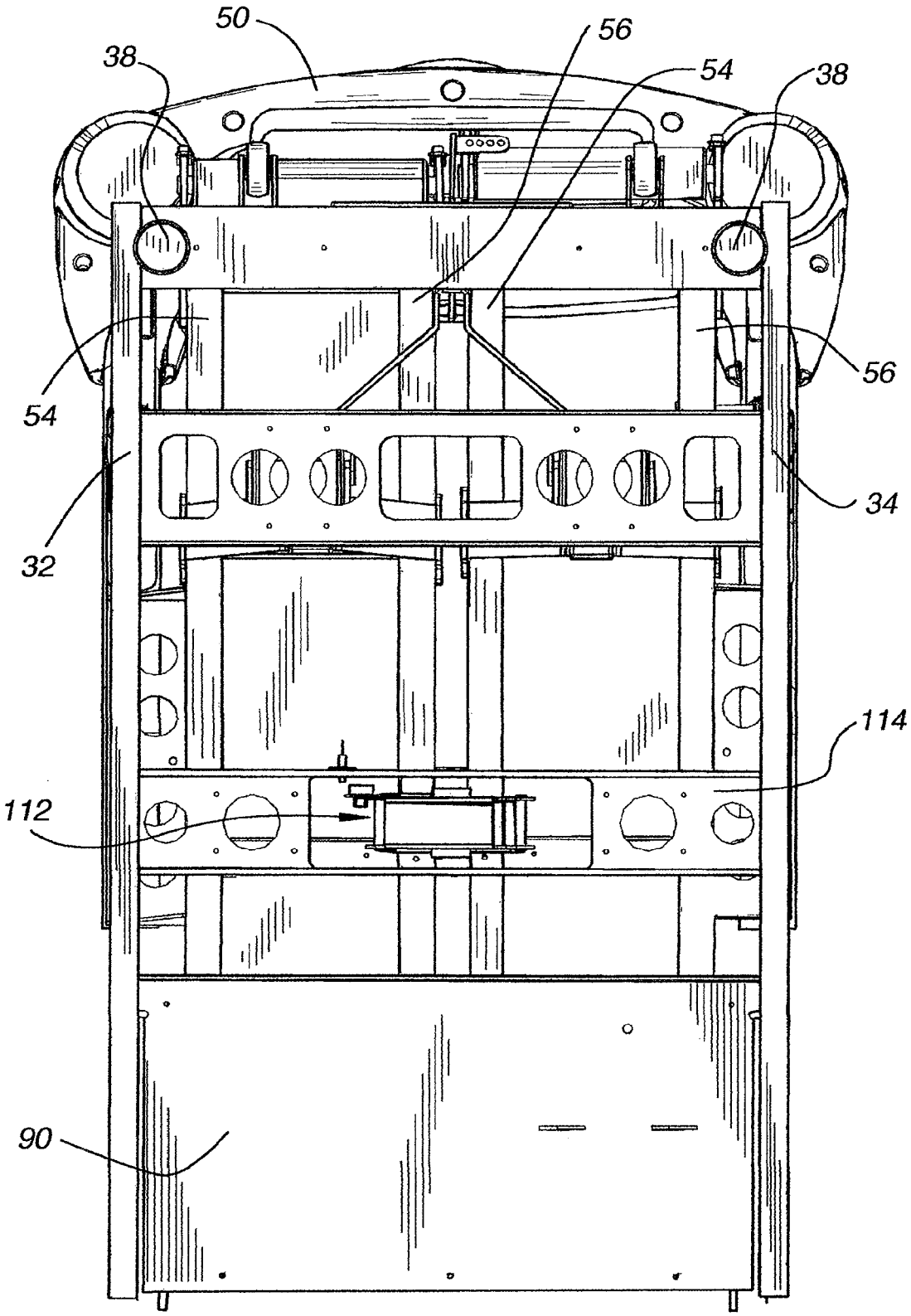
FIG. 8 is a bottom view of the exercise device shown in FIG. 2.

A left upright 40 is connected with the forward end region of the left side member 32. A right upright 42 is connected with the forward end region of the right side member 34. The uprights extend generally upwardly from the frame, with a slight rearward sweep. Handles 44 extend transversely to the top of each upright in a generally T-shaped orientation with the upright. The top of the T is the handle and the downwardly extending portion of the T is the upright. The handles are arranged generally in the same plane as the respective underlying side members 32, 34. The handles define a first section 46 connected with the uprights, and a second rearwardly section 48 extending angularly oriented with respect to the first section. The handle is adapted for the user to grasp during use of the exercise device. A console 50 is supported between the first sections of the handles. The console includes one or more cup holders, an exercise display, and one or more depressions adapted to hold keys, a cell phone, or other personal items. The console is best shown in FIGS. 5 and 7.

Figure 3A:
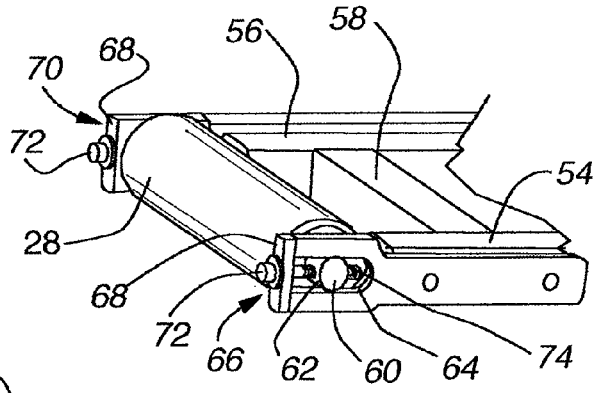
FIG. 3A is a perspective view of the adjustable front roller of the exercise device shown in FIG. 3
Figure 3:
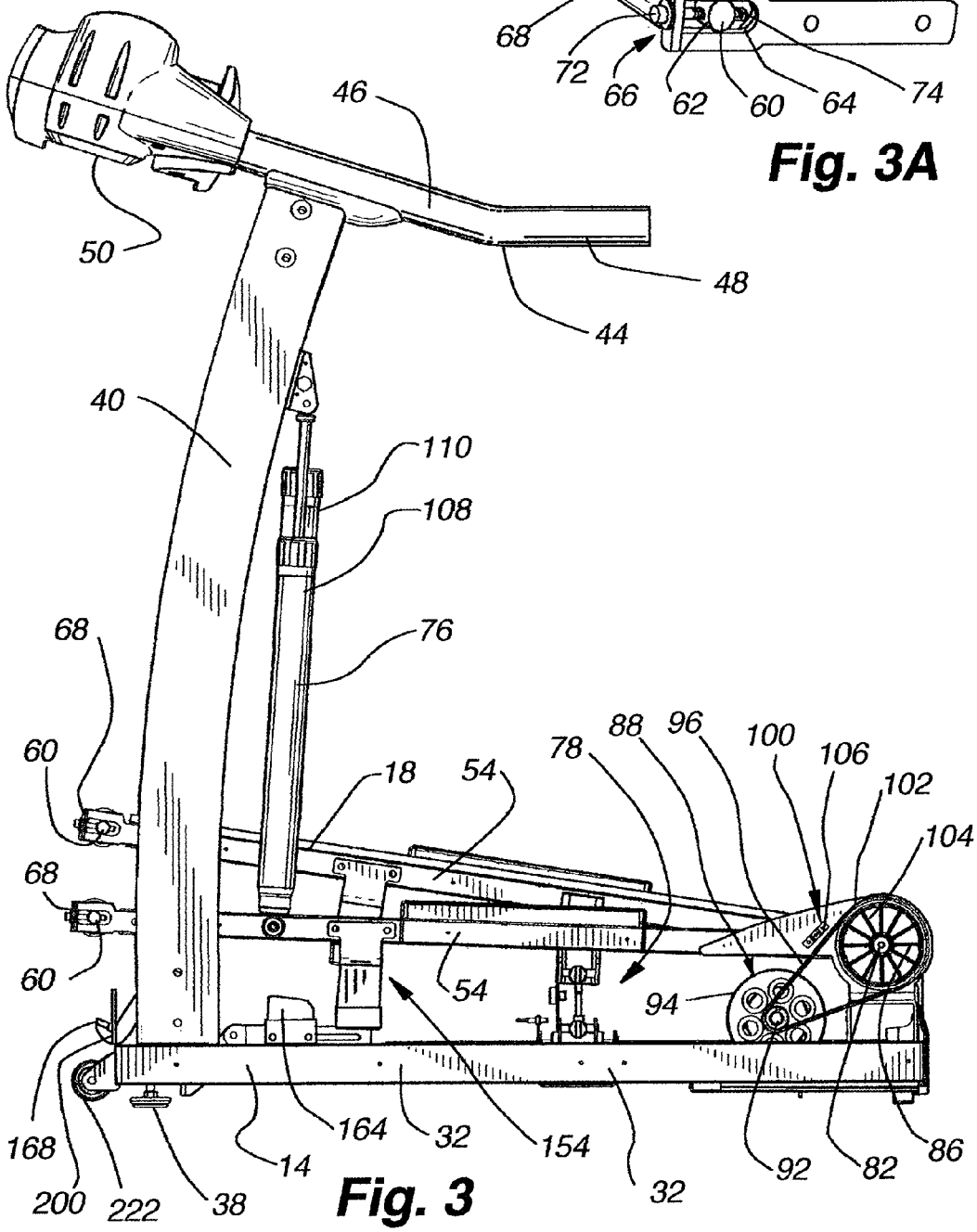
FIG. 3 is a left side view of the exercise device shown in FIG. 2.
Figure 4:
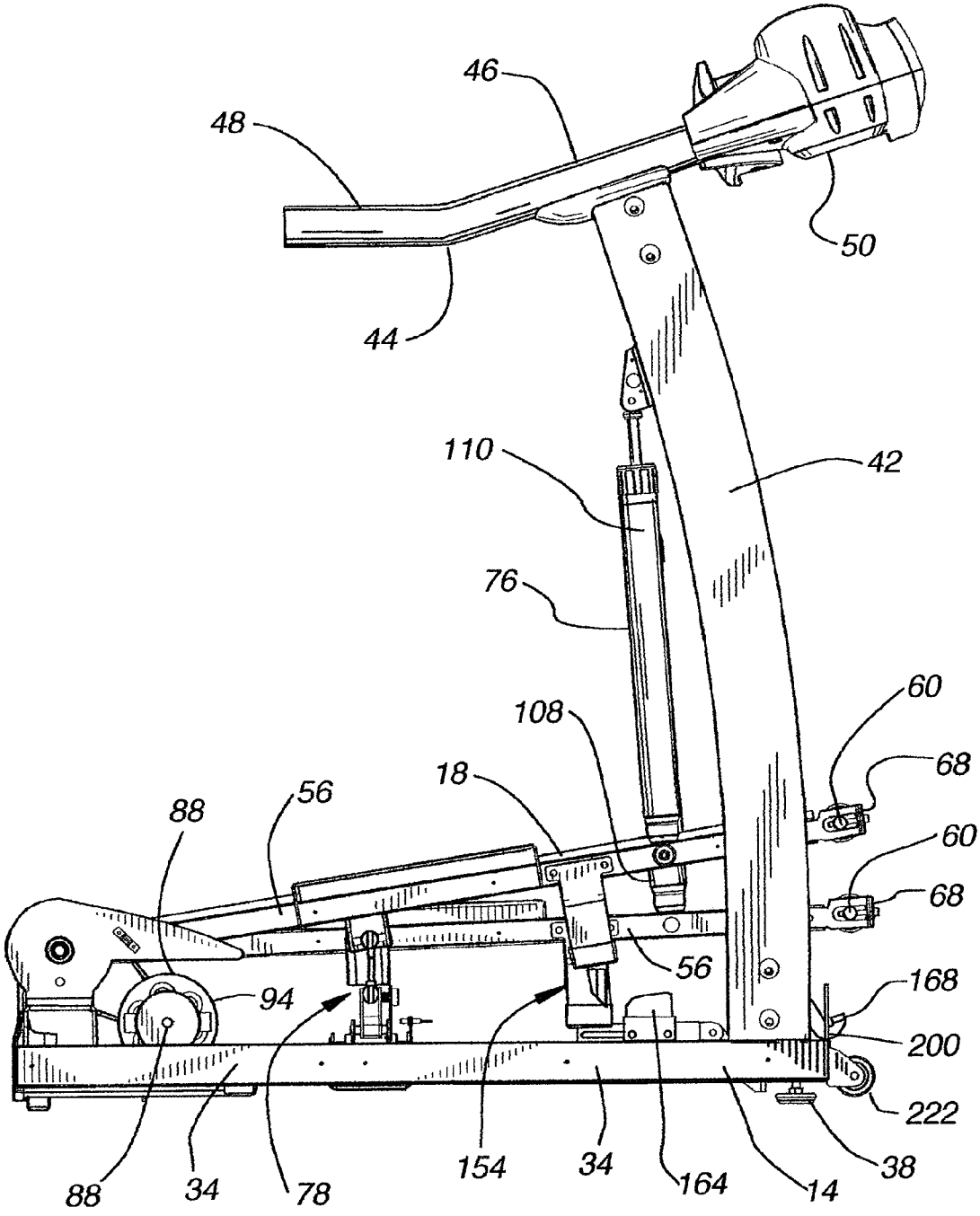
FIG. 4 is a right side view of the exercise device shown in FIG. 2.
Figure 6:
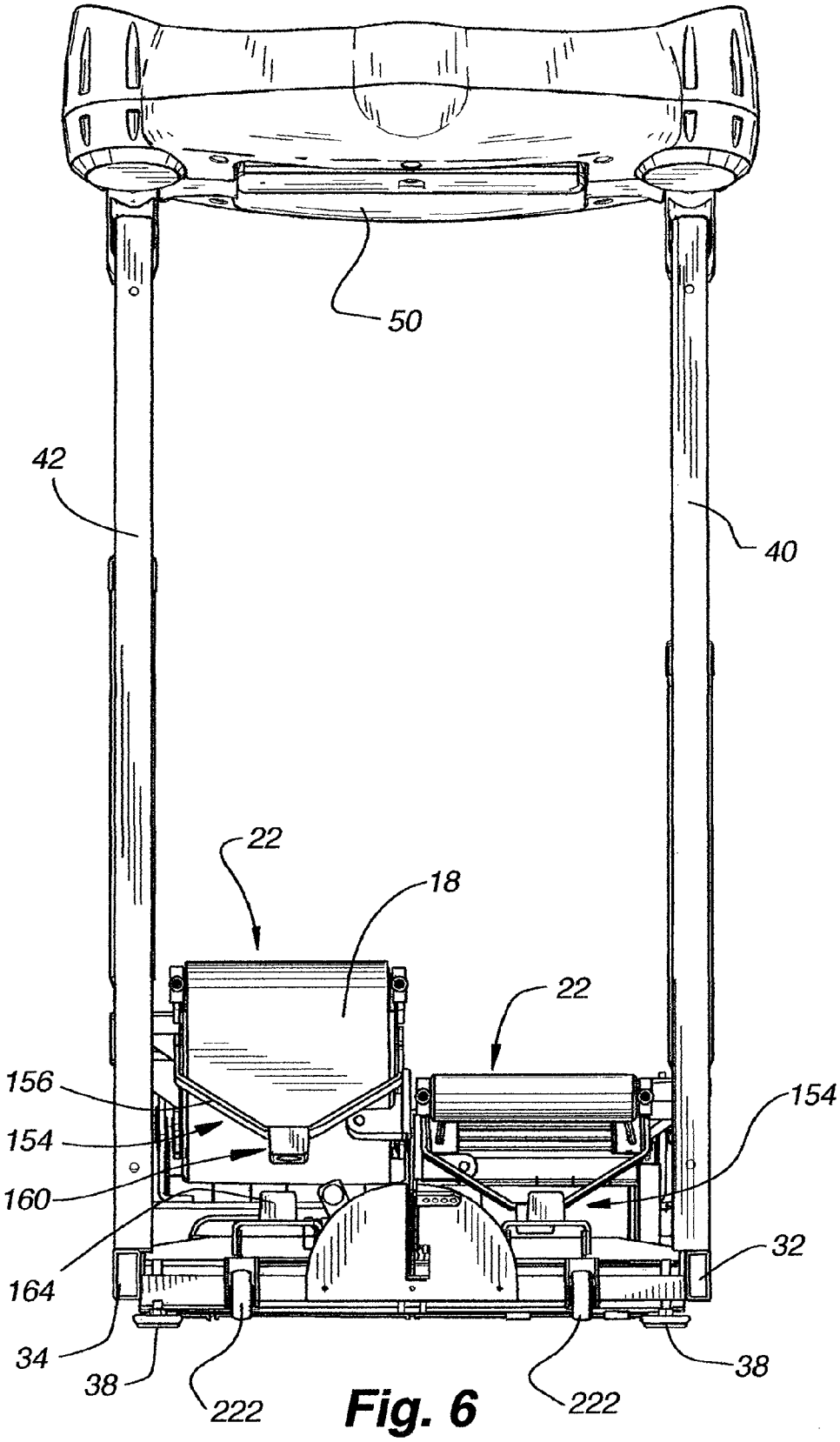
FIG. 6 is a front view of the exercise device shown in FIG. 2.
Figure 9:
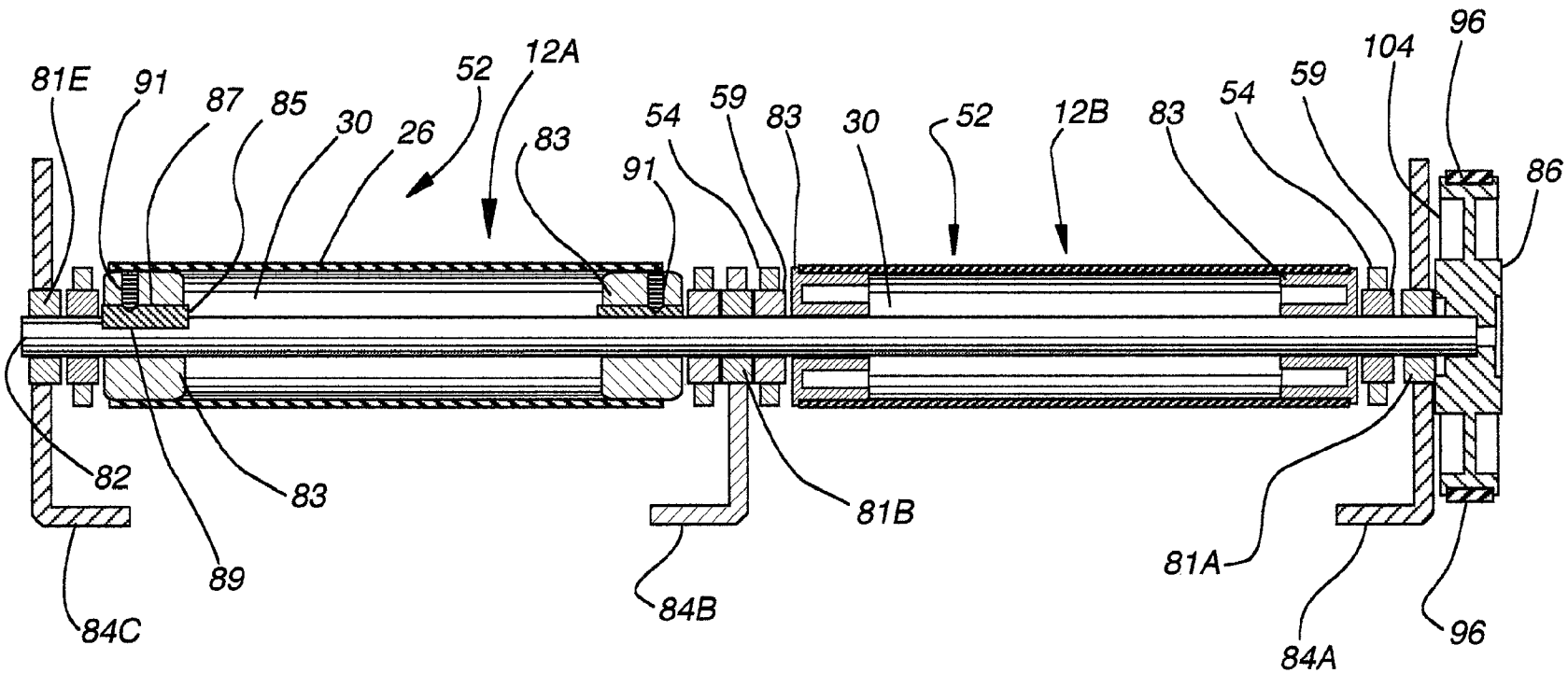
FIG. 9 is a section view taken along line 9-9 of FIG. 5.

FIG. 3 is a left side view and FIG. 4 is right side view of the exercise device 10 shown in FIG. 2. FIG. 5 is a top view and FIG. 6 is a front view of the embodiment of the exercise device shown in FIG. 2. FIG. 9 is a section view taken along line 9-9 of FIG. 5. Referring to FIGS. 2-6 and 9, and others, each treadle assembly includes a treadle frame 52 having a left member 54, a right member 56, and a plurality of treadle cross members 58 extending between the left and right members. As best shown in FIG. 9, the outside longitudinal members 54, 56 of each treadle are pivotally coupled to the rear axis (axle) 16 by radial ball bearings 59.

The front rollers 28 are rotatably supported at the front of each treadle frame and the rear rollers 30 are pivotally supported at the rear of each treadle frame. To adjust the tread belt tension and tracking, the front or rear rollers may be adjustably connected with the treadle frame. In one particular implementation as best shown in FIGS. 3, 3A and 4, each front roller is adjustably connected with the front of each respective treadle frame. The front roller includes an axle 60 extending outwardly from both ends of the roller. The outwardly extending ends of the axle each define a threaded aperture, 62 and are supported in a channel 64 defined in the forward end of the left 54 and right 56 treadle frame side members. The channel defines a forwardly opening end 66. A plate 68 defining a threaded aperture is secured to the front end of the left and right members so that the centerline of the aperture 70 is in alignment with the forward opening end 66 of the channel 64. A bolt is threaded into the threaded aperture and in engagement with the corresponding threaded aperture in the end of the roller axle 60 supported in the channel. Alternatively, a spring is located between the closed rear portion of the channel and the pivot axle to bias the pivot axle forwardly. By adjusting one or both of the bolts at the ends of the axle, the corresponding end of the axle may be moved forwardly or rearwardly in the channel to adjust the position of the front roller. Adjustment of the front roller can loosen or tighten the tread belt or change the tread belt travel.

The belt decks 26 are located on the top of each treadle frame 52. The deck may be bolted to the treadle frame, may be secured to the frame in combination with a deck cushioning or deck suspension system, or may be loosely mounted on the treadle frame. Each belt deck is located between the respective front 28 and rear 30 rollers of each treadle assembly 12A, 12B. The belt decks are dimensioned to provide a landing platform for most or all of the upper run of the tread belts 18.

The rear of each treadle assembly is pivotally supported at the rear of the frame, and the front of each treadle assembly is supported above the frame by one or more dampening elements 76, an interconnection member 78, or a combination thereof, so that each treadle assembly 12 may pivot up and down with respect to the lower frame. FIG. 7 is a rear view of the embodiment of the exercise device shown in FIG. 2. FIG. 9 is a section view of the rear roller assembly taken along line 9-9 of FIG. 5. Referring to FIGS. 5, 7, 9 and others, each treadle assembly is pivotally supported above a rear cross member 80 of the main frame 14. In one particular implementation, a drive shaft 82 is rotatably supported above the rear cross member by a left 84A, middle 84B, and right 84C drive bracket. Corresponding radial bearings 81A, 81B and 81C rotatably support the axle in the brackets. The drive shaft rotatably supports each rear roller. Thus, the left and right rear rollers are rotatably supported about a common drive axis 82, which is also the common rear pivot axis 16 of the treadles 12, in one example.

Each roller (28, 30) is supported on the axle (16, 82) by a pair of collars 83. The collars are secured to the axle by a key 85 that fits in a channel 87, 89 in the collar and in the axle. The collar is further secured to the axle by a set screw 91 supported in the collar. The set screw is tightened against the key.

A pulley 86 is secured to a portion of the drive shaft 82. As shown in FIGS. 2, 3, 9 and others, in one particular implementation, the drive pulley 86 is secured to the left end region of the drive shaft. However, the drive pulley may be secured to the right end region, or somewhere along the length of the drive shaft between the left and right end regions. A motor 88 is secured to a bottom plate 90 (best shown in the bottom view of FIG. 8) that extends between the right 56 and left 54 side members. A motor shaft 92 extends outwardly from the left side of the motor. The motor is mounted so that the motor shaft is generally parallel to the drive shaft 82. A flywheel 94 is secured to the outwardly extending end region of the motor shaft. A drive belt 96 is connected between the drive shaft pulley and a motor pulley 98 connected with the motor shaft. Accordingly, the motor is arranged to cause rotation of the drive shaft and both rear rollers 30.

A belt speed sensor 100 is operably associated with the tread belt 18 to monitor the speed of the tread belt. In one particular implementation the belt speed sensor is implemented with a reed switch 102 including a magnet 104 and a pick-up 106. The reed switch is operably associated with the drive pulley to produce a belt speed signal. The magnet is imbedded in or connected with the drive pulley 86, and the pick-up is connected with the main frame 14 in an orientation to produce an output pulse each time the magnet rotates past the pick-up.

Both the left and right rear rollers 30 are secured to the drive shaft 82. Thus, rotation of the drive shaft causes the left and right rear rollers and also the associated endless belts 18 to rotate at, or nearly at, the same pace. It is also possible to provide independent drive shafts for each roller that would be powered by separate motors, with a common motor control. In such an instance, motor speed would be coordinated by the controller to cause the tread belts to rotate at or nearly at the same pace. The motor or motors may be configured or commanded through user control to drive the endless belts in a forward direction (i.e., from the left side perspective, counterclockwise about the front and rear rollers) or configured to drive the endless belts in a rearward direction (i.e., from the left side perspective, clockwise about the front and rear rollers).

During use, the tread belt 18 slides over the deck 26 with a particular kinetic friction dependant on various factors including the material of the belt and deck and the downward force on the belt. In some instances, the belt may slightly bind on the deck when the user steps on the belt and increases the kinetic friction between the belt and deck. Besides the force imparted by the motor 88 to rotate the belts, the flywheel 94 secured to the motor shaft has an angular momentum force component that helps to overcome the increased kinetic friction and help provide uniform tread belt movement. In one particular implementation, the deck is a ⅜" thick medium density fiber based (or "MDF") with an electron beam low friction cured paint coating. Further, the belt is a polyester weave base with a PVC top. The belt may further incorporate a low friction material, such as low friction silicone.

Certain embodiments of the present invention may include a resistance element 76 operably connected with the treadles. As used herein the term "resistance element" is meant to include any type of device, structure, member, assembly, and configuration that resists the vertical movement, such as the pivotal movement of the treadles. The resistance provided by the resistance element may be constant, variable, and/or adjustable. Moreover, the resistance may be a function of load, of time, of heat, or of other factors. Such a resistance element may provide other functions, such as dampening the downward, upward, or both movement of the treadles. The resistance element may also impart a return force on the treadles such that if the treadle is in a lower position, the resistance element will impart a return force to move the treadle upward, or if the treadle is in an upper position, the resistance element will impart a return force to move the treadle downward. The term "shock" or "dampening element" is sometimes used herein to refer to a resistance element, or to a spring (return force) element, or a dampening element that may or may not include a spring (return) force.

Figure 26:
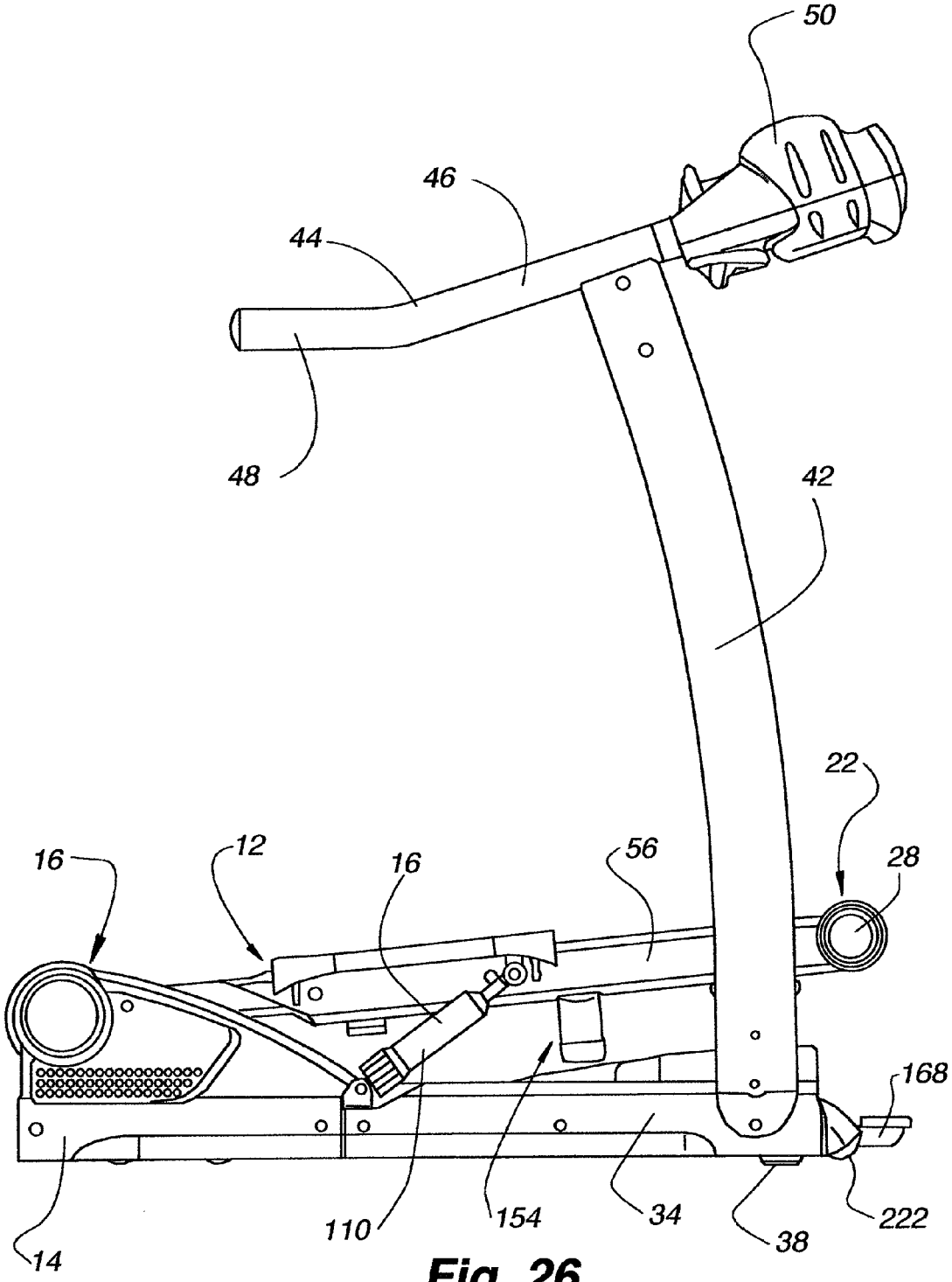
FIG. 26 is a right side of an exercise device employing an alternatively positioned shock, in accordance with the present invention.

In one particular configuration of the exercise device, a resistance element 76 extends between each treadle assembly 12 and the frame 14 to support the front of the treadle assemblies and to resist the downward movement of each treadle. The resistance element or elements may be arranged at various locations between treadle frame and the main frame. In the embodiments shown in FIGS. 1-7, and others, the resistance elements include a first 108 and a second 110 shock. The shock both resists and dampens the movement of the treadles. More particularly, the first or left shock 108 extends between the left or outer frame member 54 of the left treadle assembly and the left upright frame member 40. The second shock 110 extends between the right or outer frame member 56 of the right treadle assembly and the right upright frame member 42. FIG. 26 illustrates an alternative embodiment of the present invention wherein shocks extend between the outer frame members of each treadle assembly and a portion of the frame below the treadle assembly. In another alternative, the shocks may be connected to the front of the treadles (See FIG. 40) between the inner and outer treadle frame members.

In one particular implementation, the shock (108, 110) is a fluid-type or air-type dampening device and is not combined internally or externally with a return spring. As such, when a user's foot lands on the front of a treadle, the shock dampens and resists the downward force of the footfall to provide cushioning for the user's foot, leg and various leg joints such as the ankle and knee. In some configurations, the resistance device may also be adjusted to decrease or increase the downward stroke length of a treadle. The shock may be provided with a user adjustable dampening collar, which when rotated causes the dampening force of the shock to either increase or decrease to fit any particular user's needs. One particular shock that may be used in an exercise device conforming to the present invention is shown and described in U.S. Pat. No. 5,762,587 titled "Exercise Machine With Adjustable-Resistance, Hydraulic Cylinder," the disclosure of which is hereby incorporated by reference in its entirety.

Generally, the shock includes a cylinder filled with hydraulic fluid. A piston rod extends outwardly from the cylinder. Within the cylinder, a piston is connected with the piston rod. The piston defines at least one orifice through which hydraulic fluid may flow, and also includes a check valve. The piston subdivides the cylinder into two fluid filled chambers. During actuation of the shock, the piston either moves up or down in the cylinder. In downward movement or extension of the shock, the fluid flows through the orifice at a rate governed partially by the number of orifices and the size of the orifices. In upward movement or compression of the shock, the fluid flows through the check valve. The collar is operably connected with a plate associated with the orifice or orifices. Rotation of the collar, will expose or cover orifices for fluid flow and thus reduce or increase the dampening force of the shock. Alternatively, the dampening resistance collar is connected with a tapered plunger directed into an orifice between the hydraulic chambers of the shock. The depth of the plunger will govern, in part, the resistance of the shock. Preferably, the return spring shown in FIG. 4 of the '587 patent is removed.

Another particular shock that may be used in an exercise device conforming to the present invention is shown and described in U.S. Pat. No. 5,622,527 titled "Independent action stepper" and issued on Apr. 22, 1997, the disclosure of which is hereby incorporated by reference in its entirety. The shock may be used with the spring 252 shown in FIG. 10 of the '527 patent. The spring provides a return force that moves or returns the treadles upward after they are pressed downward. Preferably, however, the spring 252 is removed. As such, in one implementation of the present invention, the shock only provides a resistance and does not provide a return force. In an embodiment that does not employ a spring, the shock may be arranged to provide a resistance in the range of 47 KgF to 103 KgF. Alternative resistance elements are discussed in more detail below.

Figure 10:
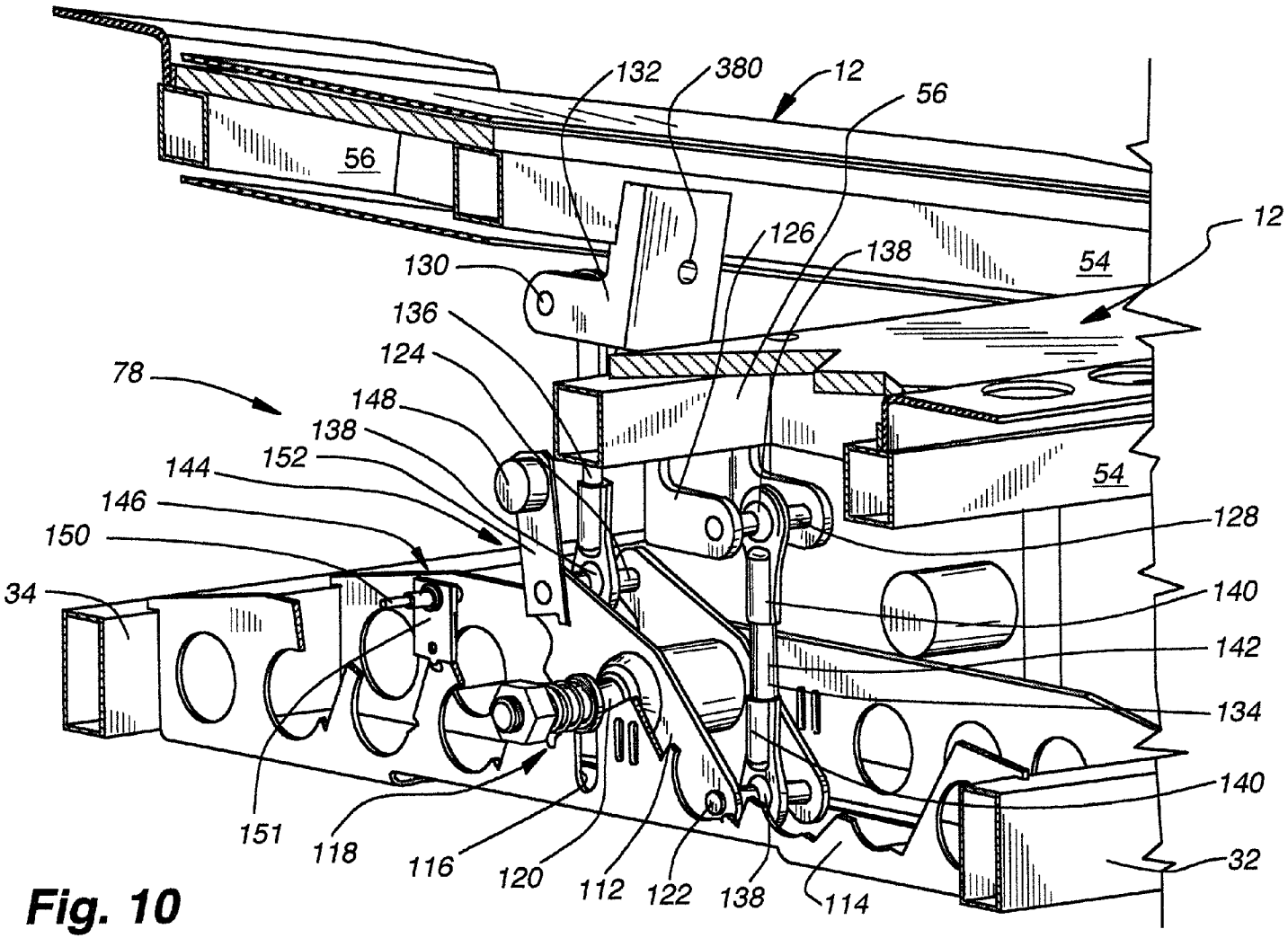
FIG. 10 is a partial cut away isometric view of the exercise device shown in FIG. 2, the view illustrating the rocker arm orientated in a position corresponding with the left treadle in about the lowest position and the right treadle in about the highest position.
Figure 11:
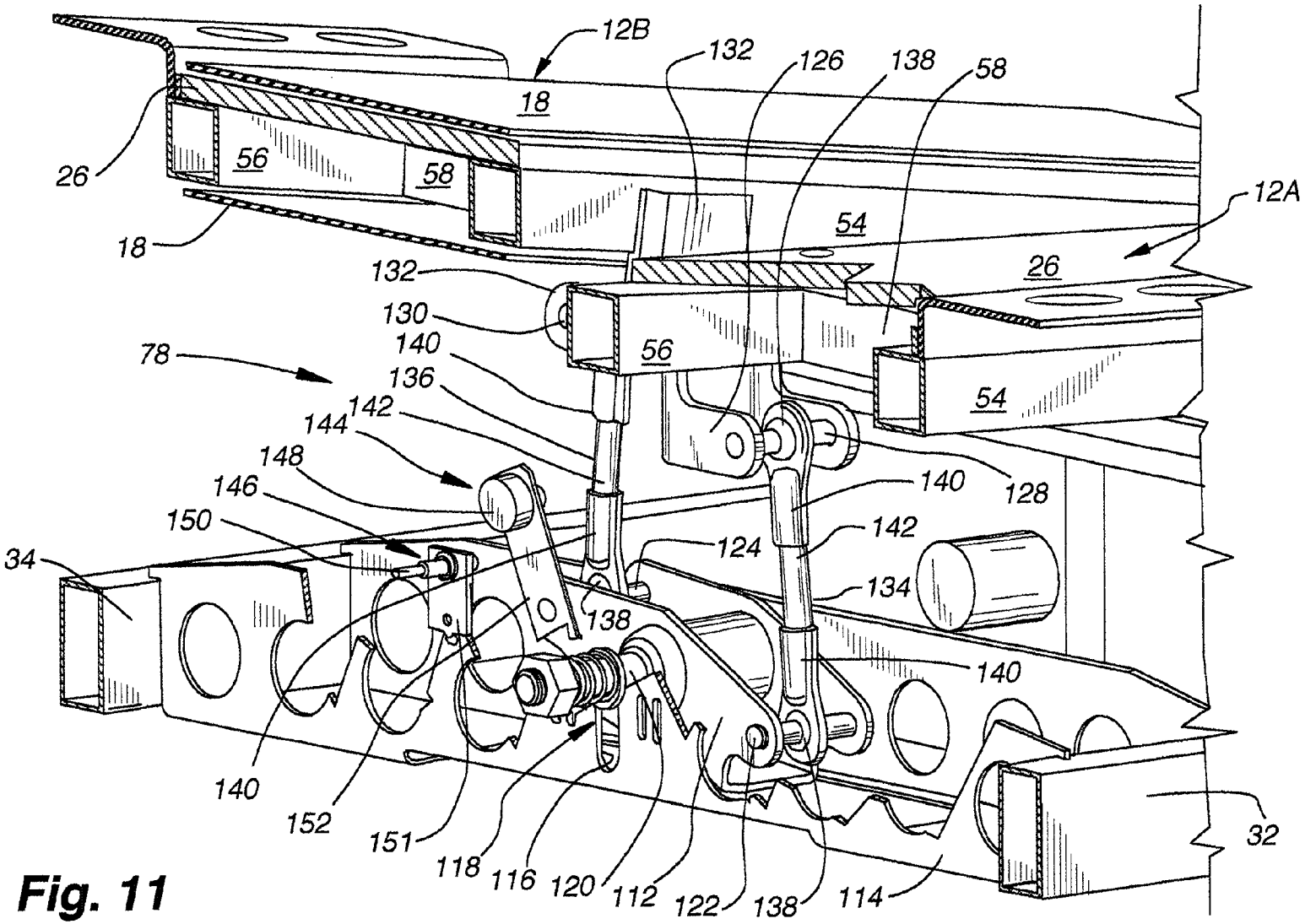
FIG. 11 is a partial cut away isometric view of the exercise device shown in FIG. 2, the view illustrating the rocker arm orientated in a position corresponding with the left treadle in a position higher than in FIG. 10 and the right treadle in a position lower than in FIG. 10.
Figure 12:
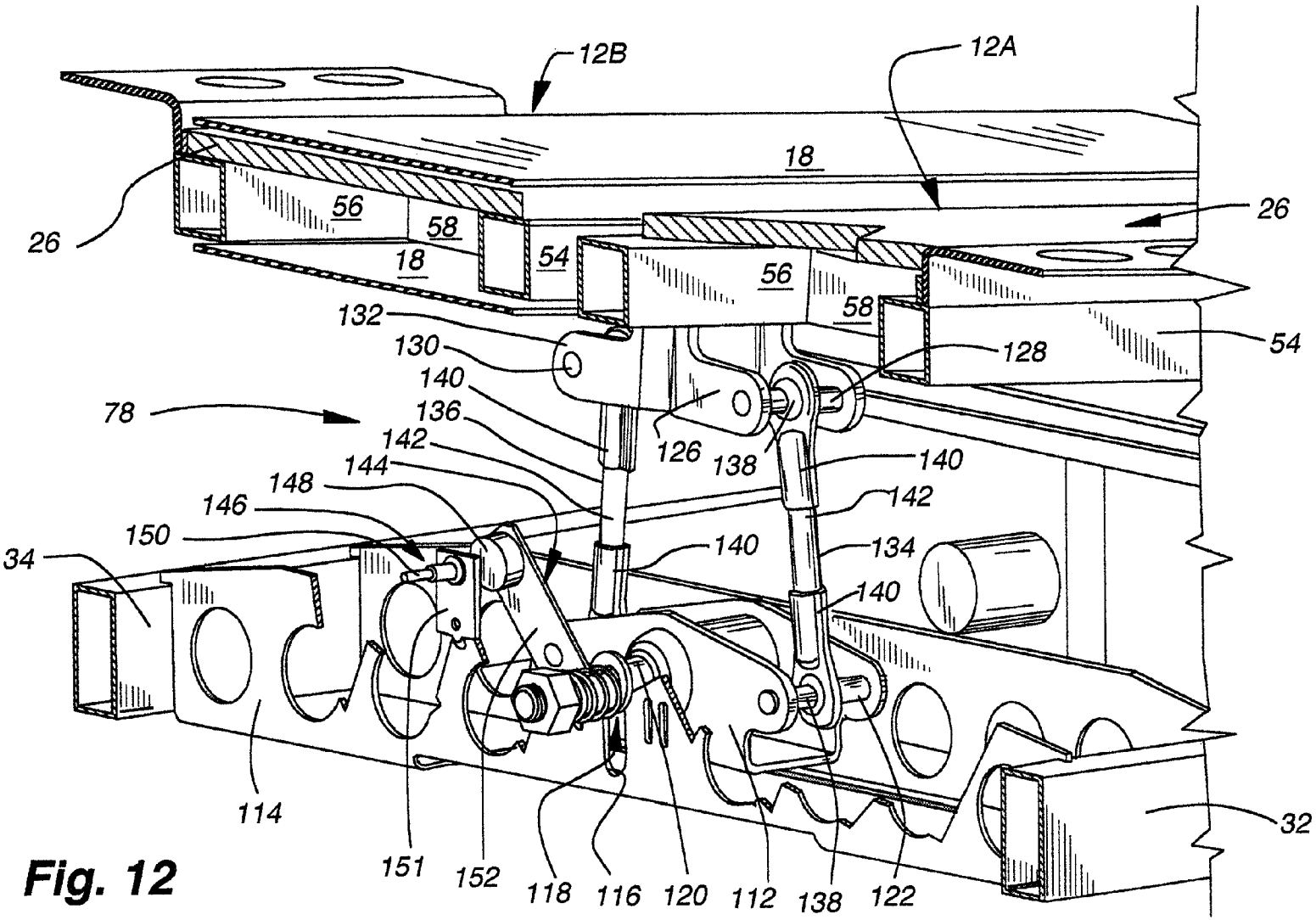
FIG. 12 is a partial cut away isometric view of the exercise device shown in FIG. 2, the view illustrating the rocker arm orientated in a position corresponding with the left treadle about parallel with the right treadle.
Figure 13:
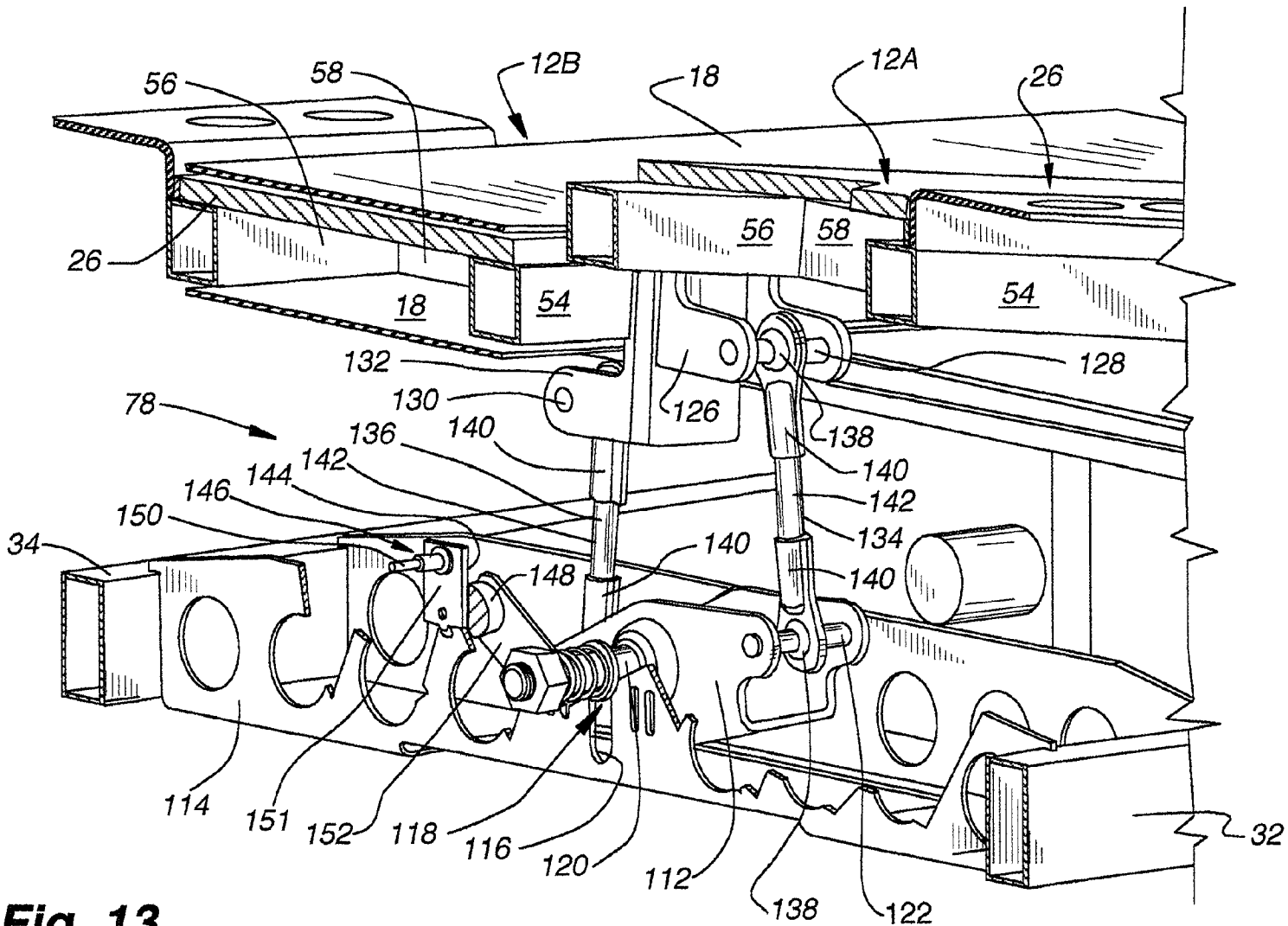
FIG. 13 is a partial cut away isometric view of the exercise device shown in FIG. 2, the view illustrating the rocker arm orientated in a position corresponding with the left treadle in a position higher than in FIG. 12 and the right treadle in a position lower than in FIG. 12.
Figure 14:
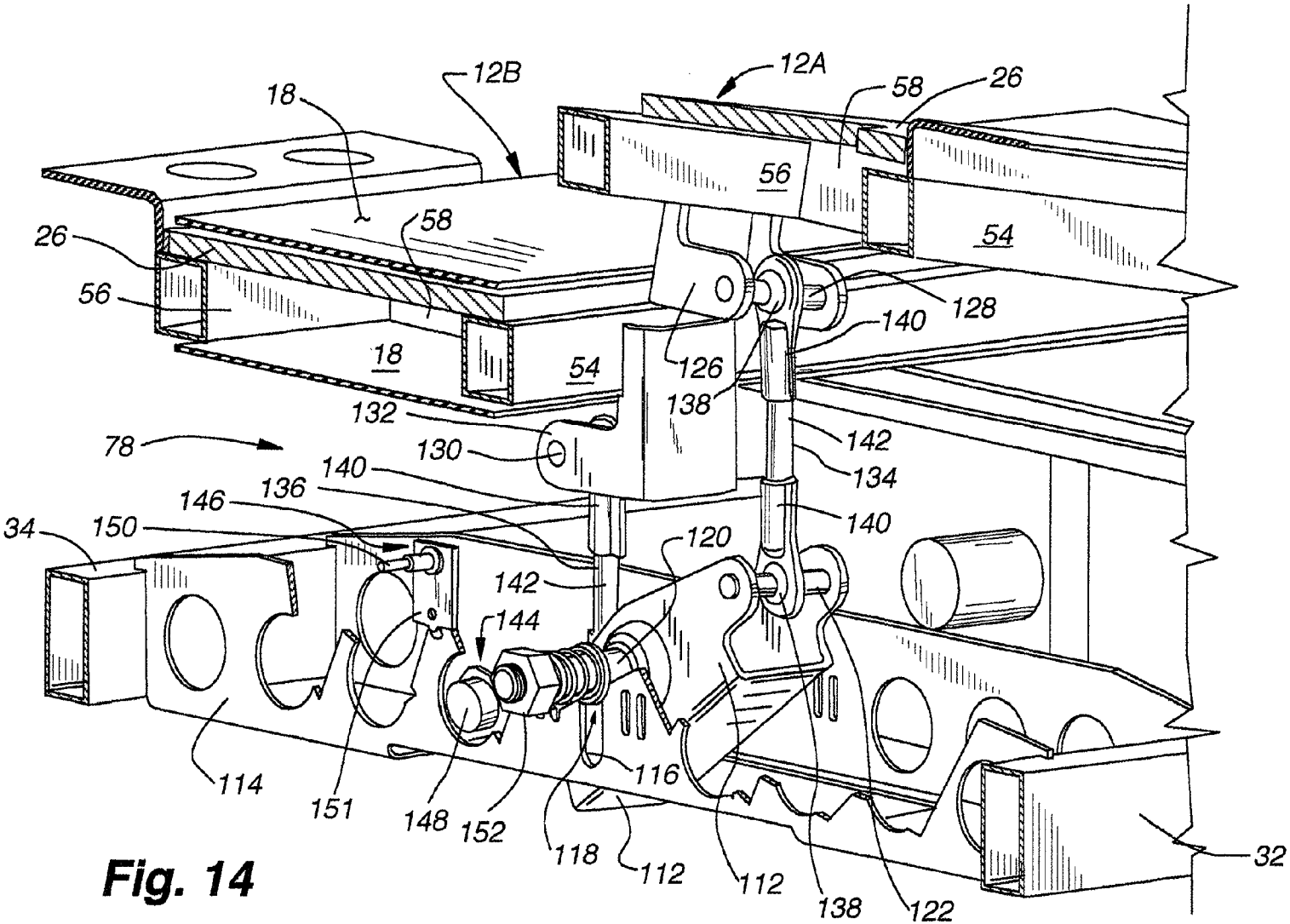
FIG. 14 is a partial cut away isometric view of the exercise device shown in FIG. 2, the view illustrating the rocker arm orientated in a position corresponding with the left treadle in a position higher than in FIG. 13 and the right treadle in a position lower than in FIG. 13.
Figure 15:
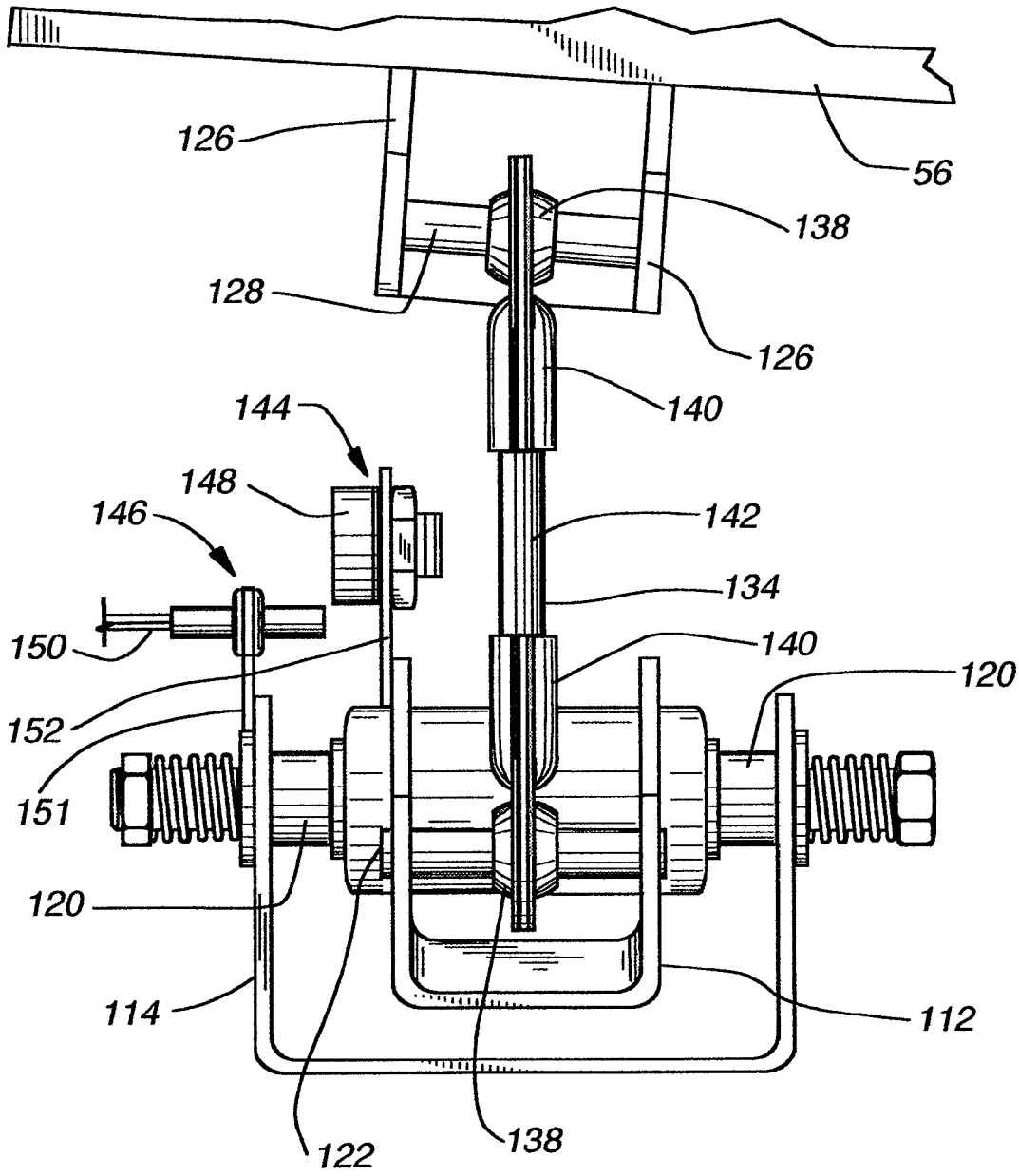
FIG. 15 is a left side view of one embodiment of the rocker arm, in accordance with the present invention.

FIGS. 10-14 are partial isometric views of the exercise device particularly illustrating the treadle interconnection structure 78. Each of FIGS. 10-14 show the interconnection structure in a different position. FIG. 15 is a side view of the treadle interconnection structure in the same position as is shown in FIG. 12. FIGS. 16(A,B)-20(A,B) are isometric views of the exercise device corresponding with the views shown in FIGS. 10-14. In the particular implementation of the interconnection structure illustrated in FIGS. 10-15 and others, the interconnection structure includes a rocker arm assembly 112 pivotally supported on a rocker cross member 114 extending between the left 32 and right 34 side members of the frame. The rocker arm assembly is operably connected with each treadle assembly 12. As best shown in FIG. 15, the rocker cross member defines a U-shaped cross section. Each upstanding portion of the U defines a key way 116, (see, e.g., FIGS. 14 and 25). The top of the key way defines a pivot aperture 118. The rocker arm includes a rocker pivot axle 120 that is supported in and extends between each pivot aperture to pivotally support the rocker arm. As discussed in more detail below, the key way provides a way for the interconnect structure to be moved between a "shipping" position and a "use" position.

The left and right outer portions of the rocker arm include a first or left lower pivot pin 122 and a second or right lower pivot pin 124, respectively. A generally L-shaped bracket 126 supporting a first upper pivot pin 128 extends downwardly from the inner or right side member 56 of the left treadle 12A so that the upper pivot pin is supported generally parallel, below, and outwardly of the inner side member. A second generally L-shaped bracket 132 supporting a second upper pivot pin 130 extends downwardly from the inner or left side tube 54 of the right treadle assembly 12B so that the upper pivot pin is supported generally parallel, below, and outwardly of the inner side member.

A first rod 134 is connected between the left upper 128 and lower 122 pivot pins. A second rod 136 is connected between the right upper 130 and lower 124 pivot pins. The rods couple the treadles to the rocker arm. In one particular implementation, each rod (134, 136) defines a turnbuckle with an adjustable length. The turnbuckles are connected in a ball joint 138 configuration with the upper and lower pivot pins. A turnbuckle defines an upper and a lower threaded sleeve 140. Each threaded sleeve defines a circular cavity with opposing ends to support a pivot ball. The pivot pins are supported in the pivot balls. A rod defines opposing threaded ends 142, each supported in a corresponding threaded sleeve.

As will be discussed in more detail below, the treadle assemblies 12 may be locked-out so as to not pivot about the rear axis 16. When locked out, the belts 18 of the treadle assemblies collectively provide an effectively single non-pivoting treadmill-like striding surface. By adjusting the length of one or both of the turnbuckles 134, 136 through rotation of the rod 142 during assembly of the exercise device or afterwards, the level of the two treadles may be precisely aligned so that the two treadles belts, in combination, provide parallel striding surfaces in the lock-out position.

The interconnection structure 78 (e.g., the rocker arm assembly) interconnects the left treadle with the right treadle in such a manner that when one treadle, (e.g., the left treadle) is pivoted about the rear pivot axis 16 downwardly then upwardly, the other treadle (e.g., the right treadle) is pivoted upwardly then downwardly, respectively, about the rear pivot axis in coordination. Thus, the two treadles are interconnected in a manner to provide a stepping motion where the downward movement of one treadle is accompanied by the upward movement of the other treadle and vice versa. During such a stepping motion, whether alone or in combination with a striding motion, the rocker arm 112 pivots or teeters about the rocker axis 120.

Referring now to FIGS. 10-14 and 16(A,B)-20(A,B), the climbing-like exercise provided by the motion of the exercise device 10 is described in more detail. A representative user (hereinafter the "user") is shown in forward facing use in FIGS. 16B-20B. The user is walking forward and the device is configured for climbing-type use, i.e., so the treadles reciprocate. The foot motion shown is representative of only one user. In some instances, the treadles 12 may not move between the upper-most and lower-most position, but rather points in between. In some instances, the user may have a shorter or longer stride than that shown. In some instances, a user may walk backward, or may face backward, or may face backward and walk backward.

Figure 16A:
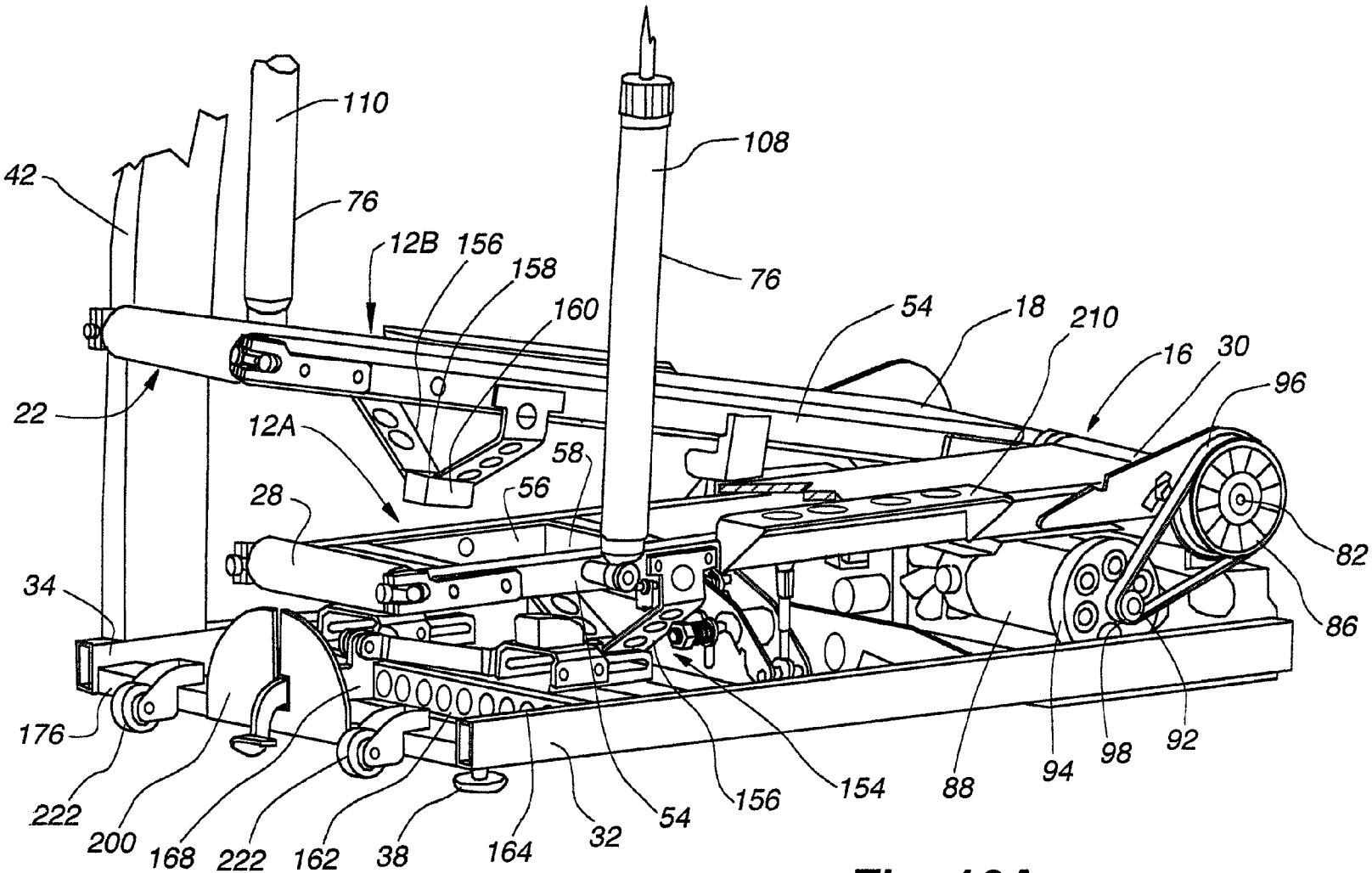
FIG. 16A is an isometric view of the exercise device shown in FIG. 2, the exercise device with the left treadle in about the lowest position and the right treadle in about the highest position.
Figure 16B:
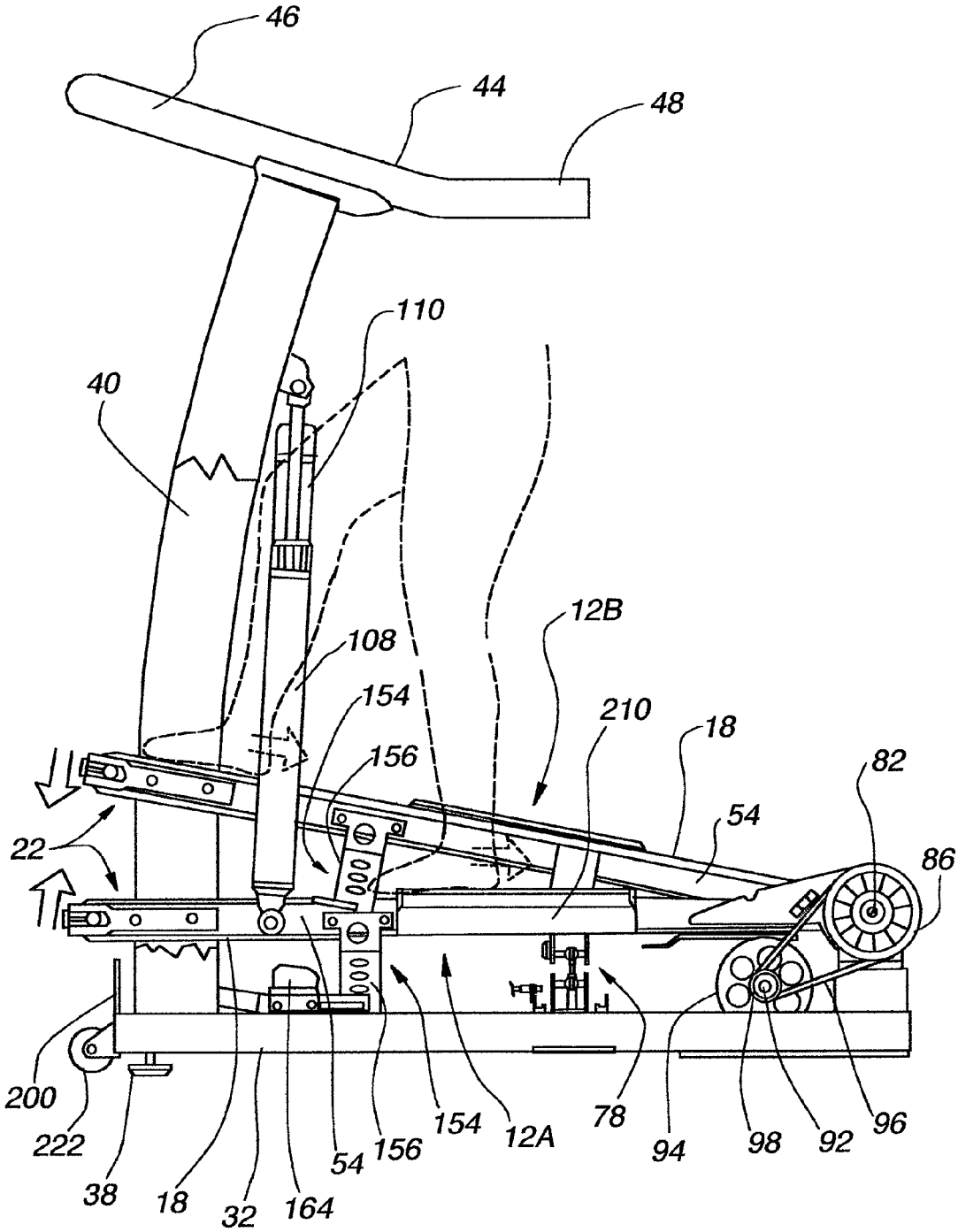
FIG. 16B is a left side view of the exercise device in the orientation shown in FIG. 16A and with a representative user.

In FIGS. 10 and 16A, the left treadle 12A is in a lower position and the right treadle 12B is in an upper position. Referring to FIGS. 10 and 14, the left side of the rocker arm 112 is pivoted downwardly and the right side of the rocker arm is pivoted upwardly. In FIG. 16B, the user is shown with his right foot forward and on the front portion of the right tread belt. In the orientation of the user shown in FIG. 16B, during forward facing climbing-type use, the user's left leg will be extended downwardly and rearwardly with the majority of the user's weight on the left treadle. The user's right leg will be bent at the knee and extended forwardly so that the user's right foot is beginning to press down on the right treadle. From the orientation shown in FIG. 16B, the user will transition his weight to a balance between the right leg and the left leg, and begin to press downwardly with his right leg to force the right treadle downwardly. Due to the movement of the belts, both feet will move rearwardly from the position shown in FIG. 16B.

Figure 17A:
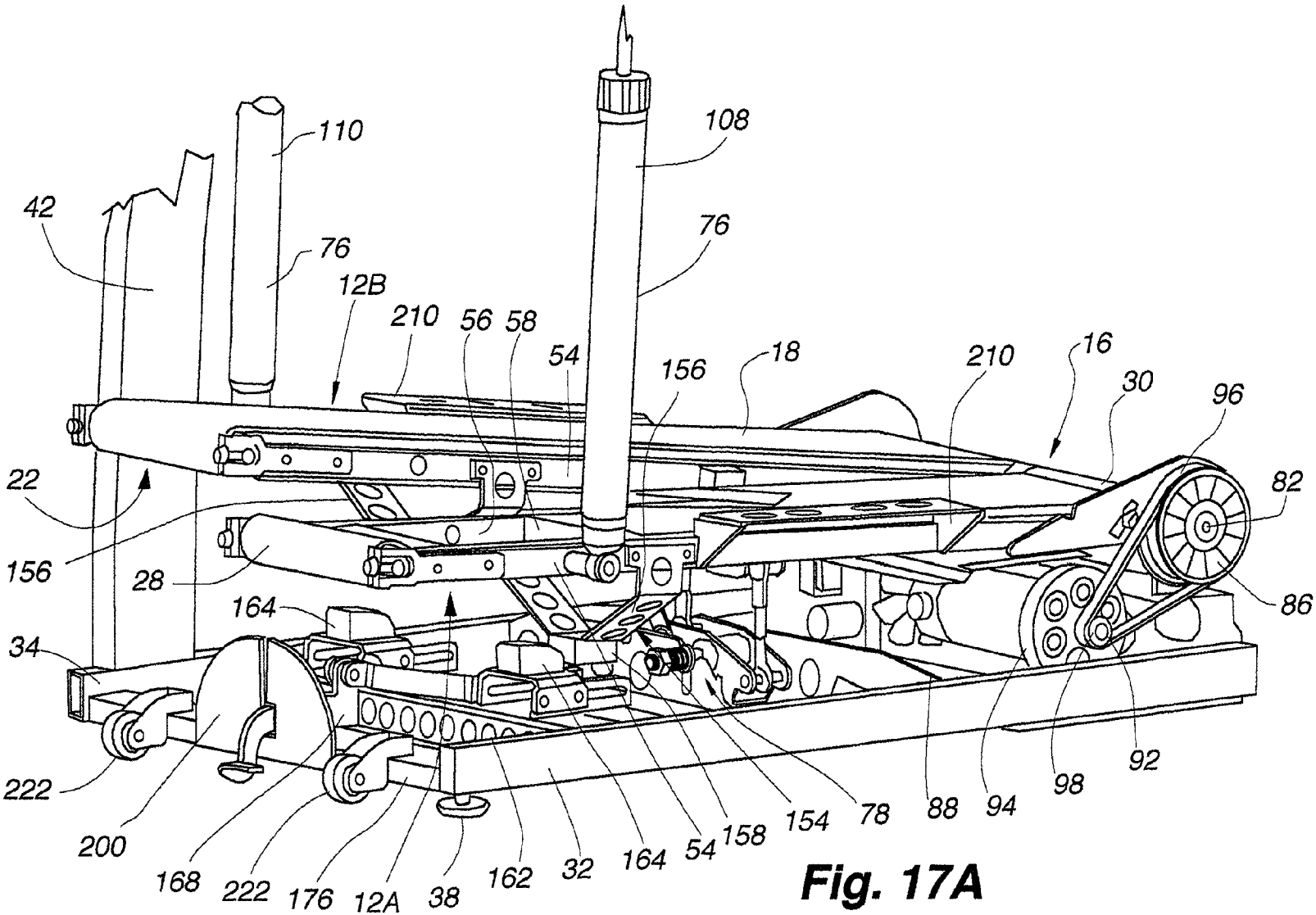
FIG. 17A is an isometric view of the exercise device shown in FIG. 2, the exercise device with the left treadle higher than shown in FIG. 16A, and the right treadle lower than shown in FIG. 16A.
Figure 17B:
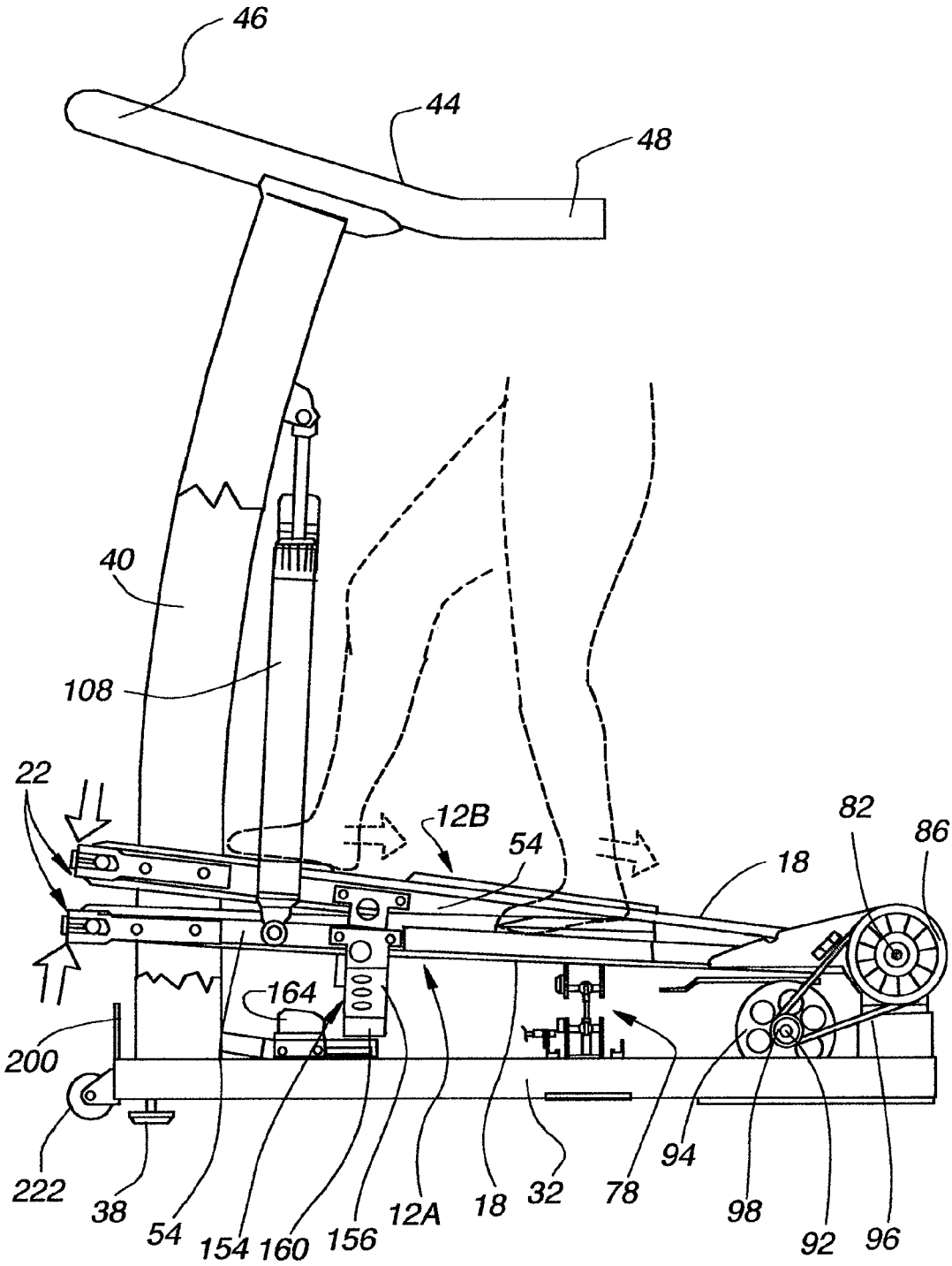
FIG. 17B is a left side view of the exercise device in the orientation shown in FIG. 17A and with a representative user.

FIGS. 11, 17A, and 17B show the orientation of the device 10 and the user in a position after that shown in FIGS. 10, 16A, and 16B. The right treadle 12B is being pressed downwardly, which, via the rocker interconnection structure 78, causes the left treadle 12A to begin to rise. The user's right foot has moved rearwardly and downwardly from the position shown in FIG. 16B. The user's left foot has moved rearwardly and upwardly from the position shown in FIG. 16B.

Figure 18A:
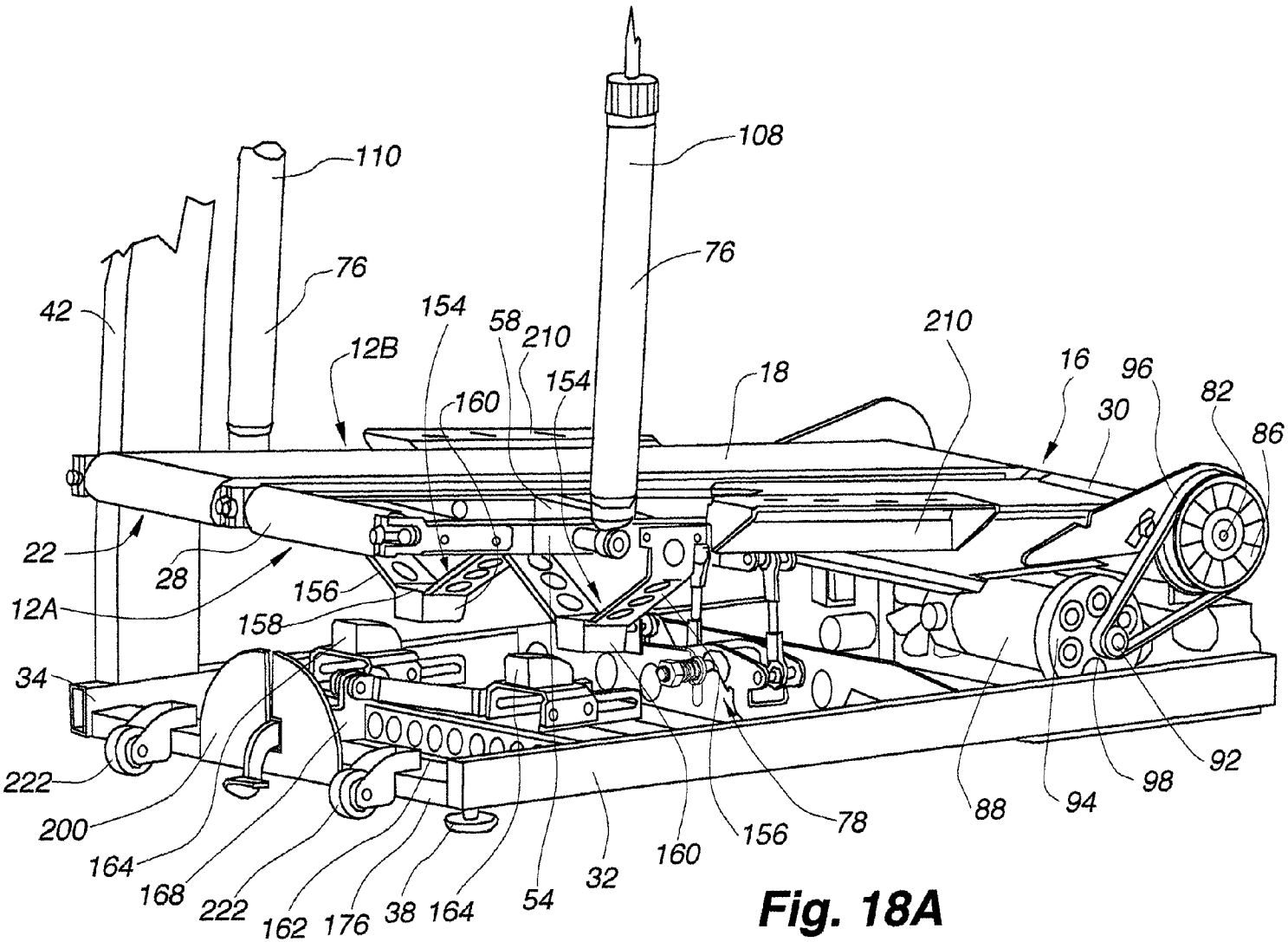
FIG. 18A is an isometric view of the exercise device shown in FIG. 2, the exercise device with the left and right treadle about parallel and collectively at about a 10% grade.
Figure 18B:
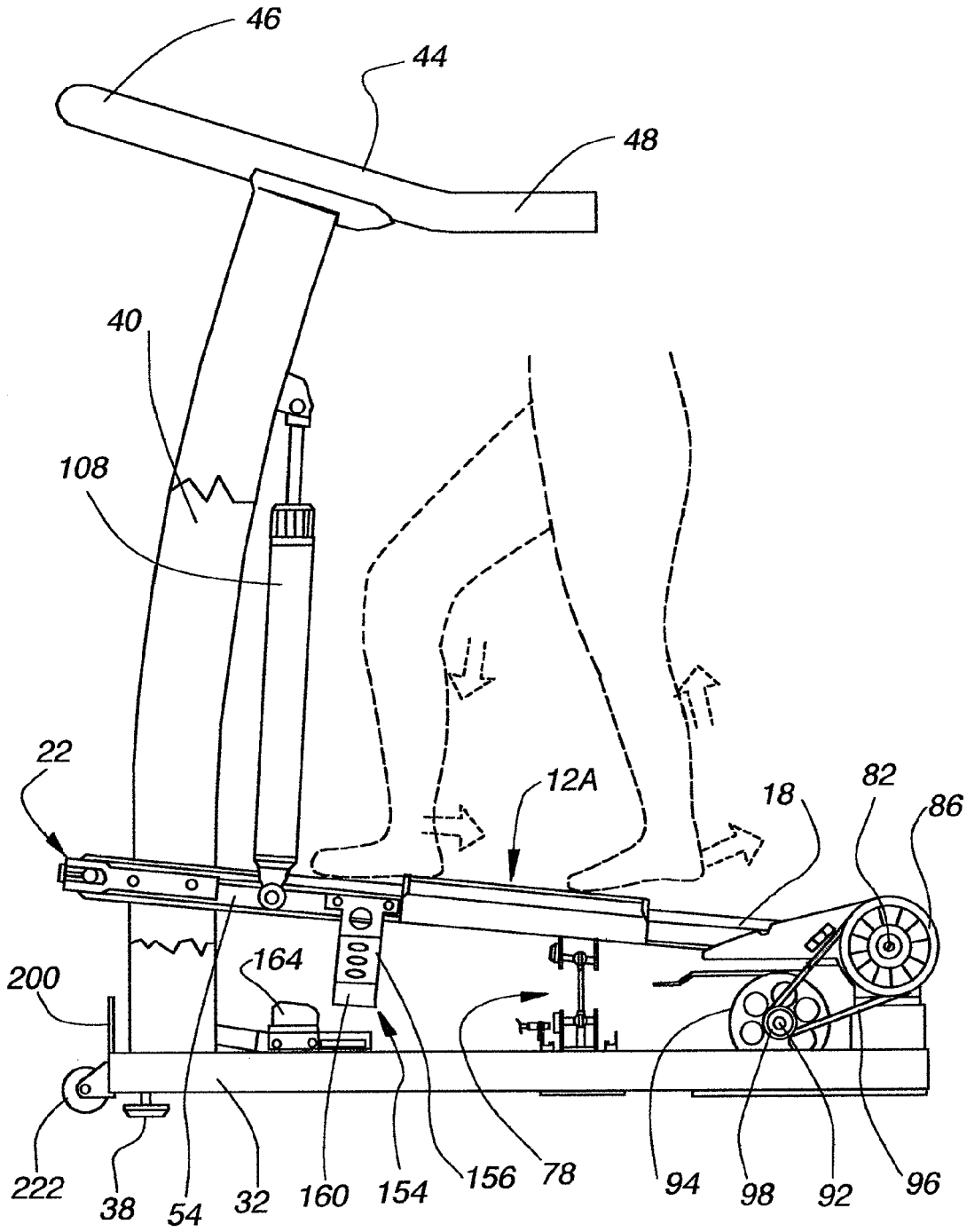
FIG. 18B is a left side view of the exercise device in the orientation shown in FIG. 18A and with a representative user.

FIGS. 12, 18A, and 18B show the right treadle 12B about midway through its upward stroke, and the left treadle 12A about midway through its downward stroke. As such, the treadle assemblies are nearly at the same level above the frame 14 and the endless belts 18 are also at the same level. As shown in FIG. 18B, the user's right foot and leg have moved rearwardly and downwardly from the position shown in FIG. 17B. The user's left foot has moved rearwardly and upwardly from the position shown in FIG. 16B. At this point, the user has begun to lift the left foot from the left tread belt in taking a forward stride; thus, the left heel is lifted and the user has rolled onto the ball of the left foot. Typically, more weight will now be on the right treadle than the left treadle.

Figure 19A:
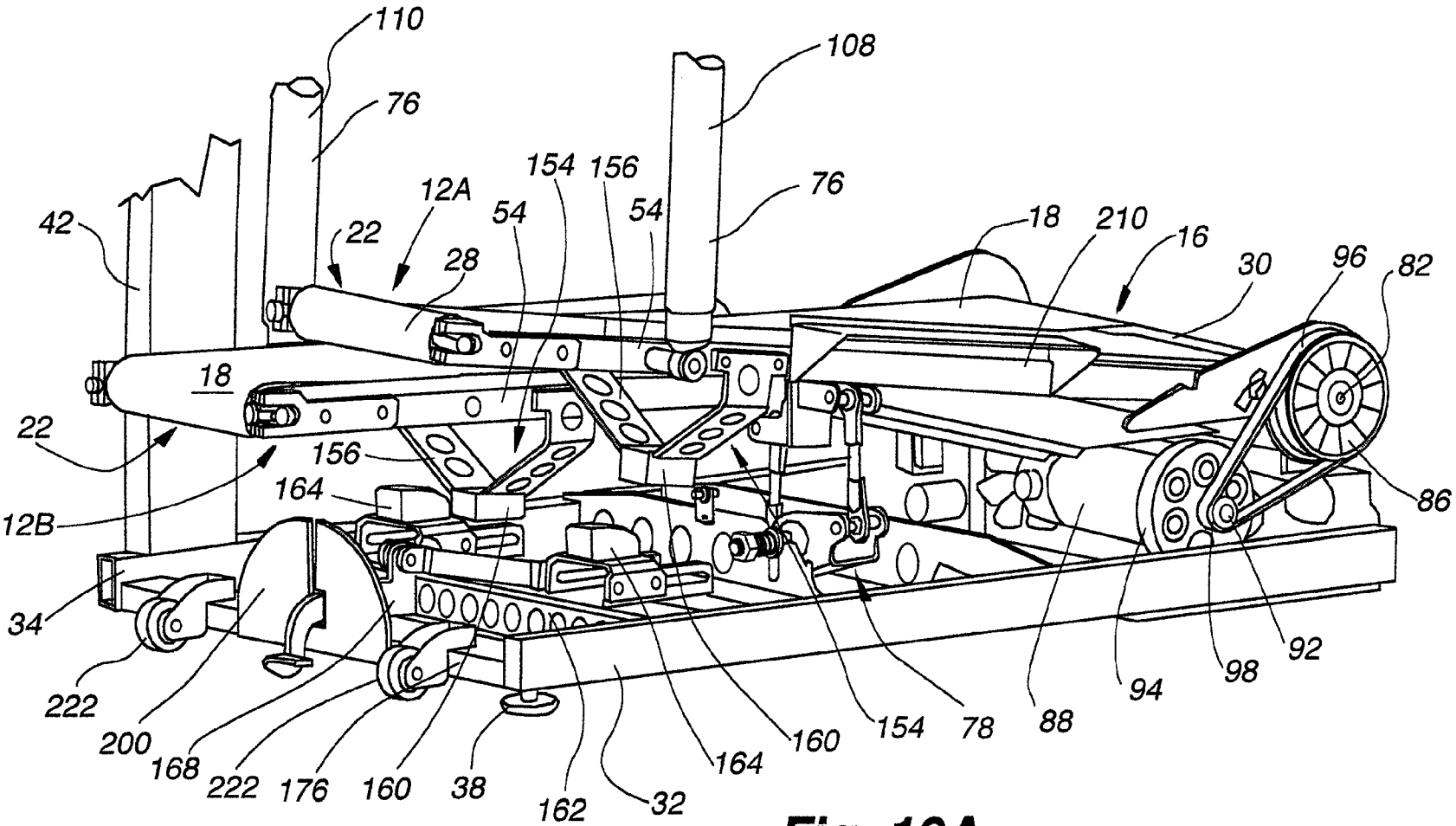
FIG. 19A is an isometric view of the exercise device shown in FIG. 2, the exercise device with the left treadle higher than shown in FIG. 18S, and the right treadle lower than as shown in FIG. 18A.
Figure 19B:
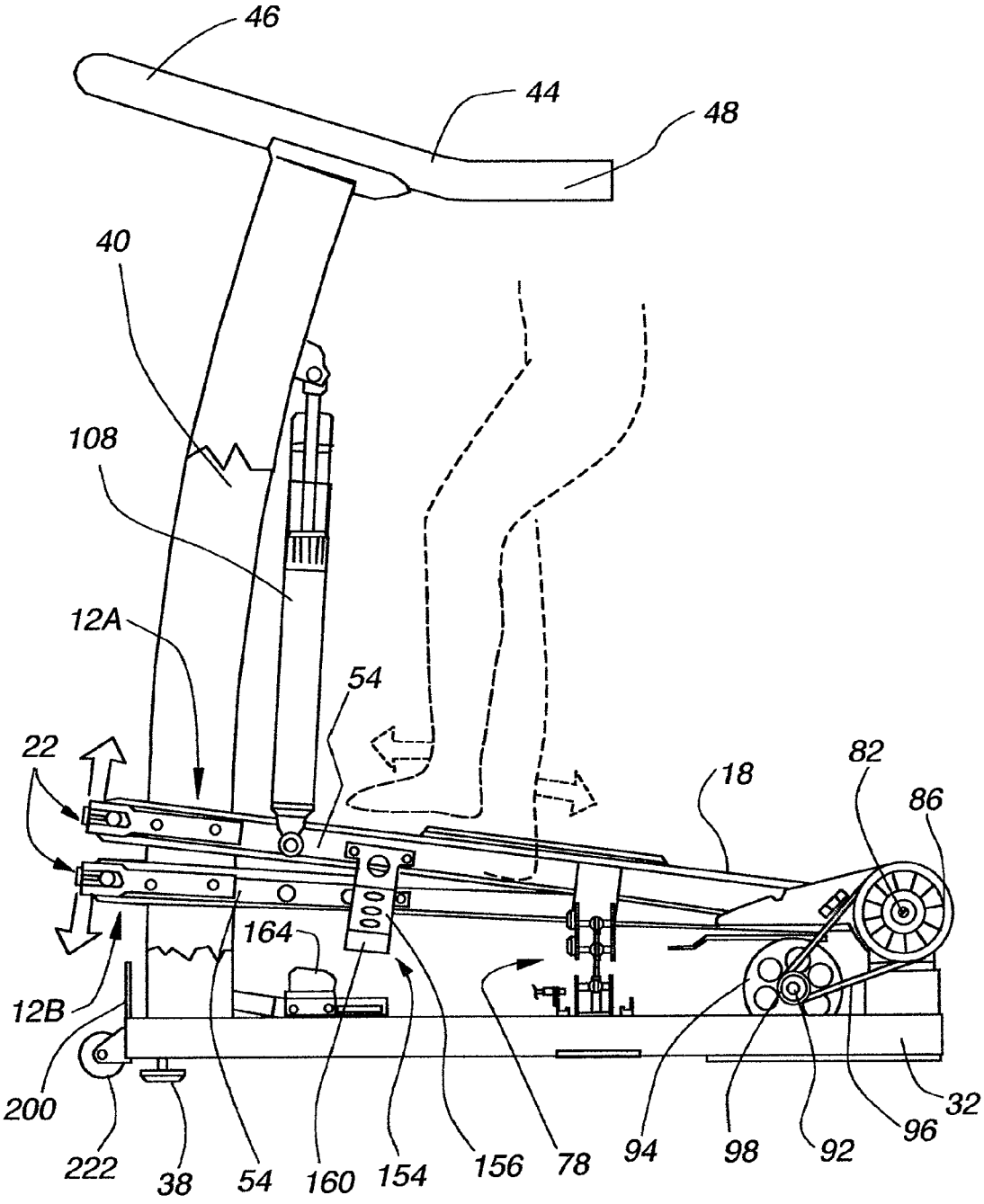
FIG. 19B is a left side view of the exercise device in the orientation shown in FIG. 19A and with a representative user.

After the orientation shown in FIGS. 12, 18A, and 18B, the right treadle 12B continues it downward movement and the left treadle 12A continues its upward movement to the orientation of the device as shown in FIGS. 13, 19A, and 19B. In FIGS. 13, 19A, and 19B, the left treadle is higher than the right treadle, and the rocker arm 112 is pivoted about the rocker pivot axis 120 such that its right side is lower than its left side. In this position, the user's right leg continues to move rearward and downward. The user has lifted the right leg off the left treadle and is moving it forward. At about the upper position of the left treadle, the user will step down with his left foot on the front portion of the treadle belt. All of the user's weight is on the right treadle until the user places his left foot on the left treadle. The user continues to provide a downward force on the right treadle forcing the left treadle up.

Figure 20A:
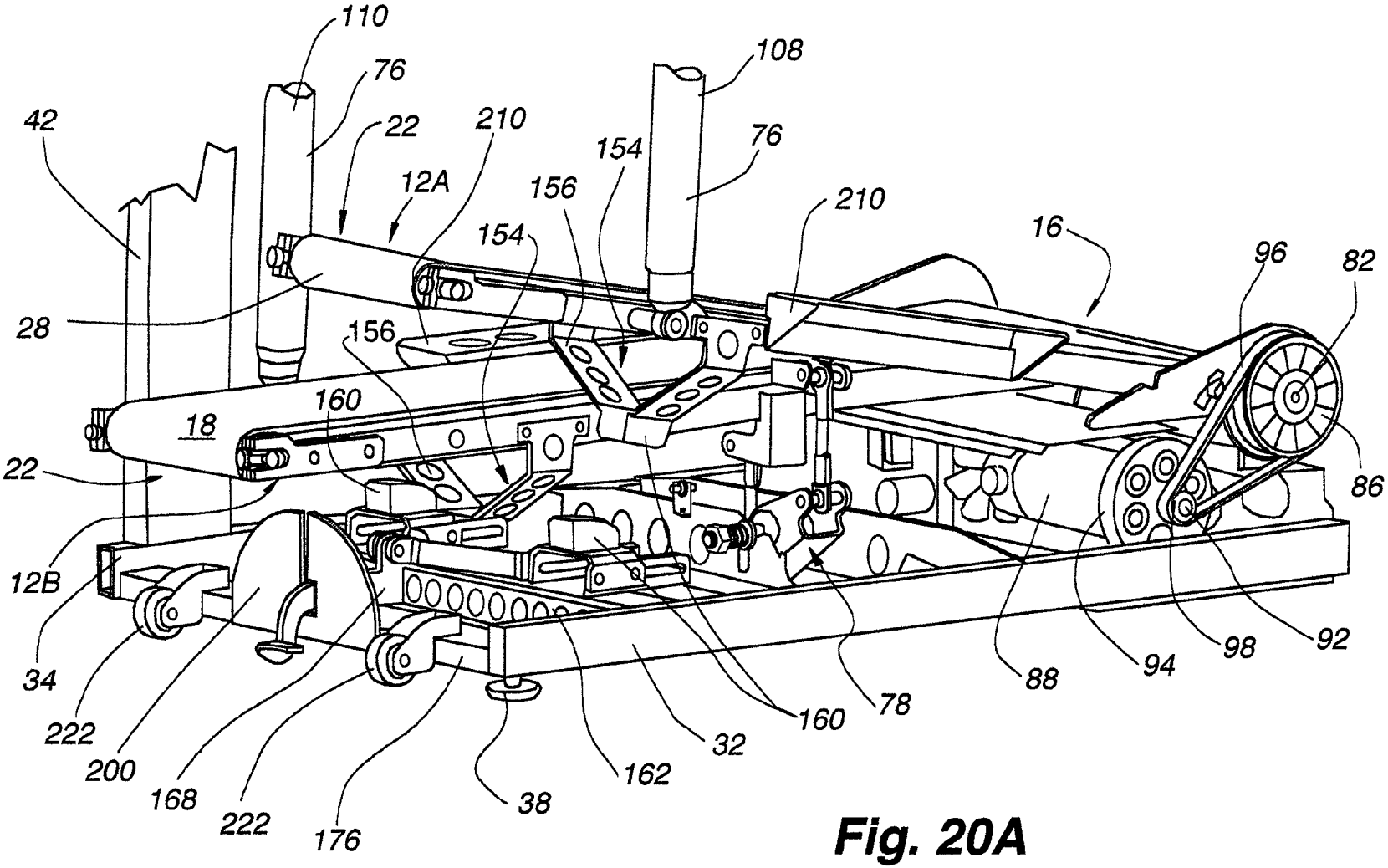
FIG. 20A is an isometric view of the exercise device shown in FIG. 2, the exercise device with the left treadle in about its highest position and the right treadle in about its lowest position.
Figure 20B:
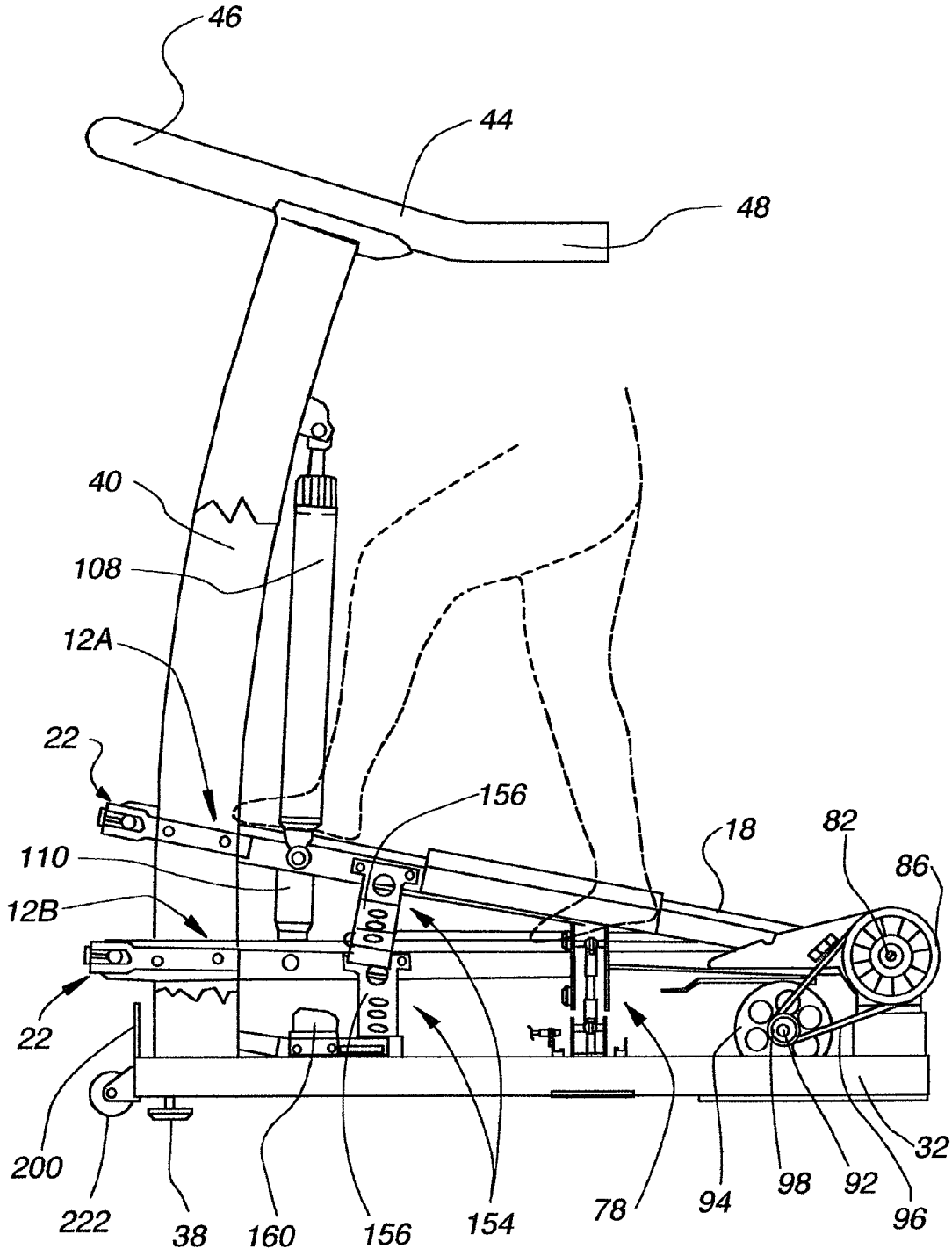
FIG. 20B is a left side view of the exercise device in the orientation shown in FIG. 20A and with a representative user.

FIGS. 14, 20A, and 20B illustrate the right treadle 12B in about its lowest position, and show the left treadle 12A in about its highest position. At this point, the user has stepped down on the front 22 of the left treadle and has begun pressing downward with the left leg. The user is also beginning to lift the right leg. The downward force on the left treadle will be transferred through the interconnection structure 78 to the right treadle to cause the right treadle to begin to rise.

FIGS. 16(A,B)-20(A,B) represent half a cycle of the reciprocating motion of the treadles, i.e., the movement of the left treadle from a lower position to an upper position and the movement of the right treadle from an upper position to a lower position. A complete climbing-type exercise cycle is represented by the movement of one treadle from some position and back to the same position in a manner that includes a full upward stroke of the treadle (from the lower position to the upper position) and a full downward stroke of the treadle (from the upper position to the lower position). For example, a step cycle referenced from the lower position of the left treadle (the upper position of the right treadle) will include the movement of the left treadle upward from the lower position to the upper position and then downward back to its lower position. In another example, a step cycle referenced from the mid-point position of the left treadle (see FIG. 18) will include the upward movement of the treadle to the upper position, the downward movement from the upper position, past the mid-point position and to the lower position, and the upward movement back to the mid-point position. The order of upward and downward treadle movements does not matter. Thus, the upward movement may be followed by the downward movement or the downward movement may be followed by the upward movement.

Referring to FIG. 10 and others, in one particular configuration, the exercise device includes a step sensor 144, which provides an output pulse corresponding with each downward stroke of each treadle. The step sensor is implemented with a second reed switch 146 including a magnet 148 and a pick-up 150. The magnet is connected to the end of a bracket 152 that extends upwardly from the rocker arm 112. The bracket orients the magnet so that it swings back and forth past the pick-up, which is mounted on a bracket 157 connected with the rocker cross member 114. The reed switch 146 triggers an output pulse each time the magnet 148 passes the pick-up 150. Thus, the reed switch transmits an output pulse when the right treadle 12B is moving downward, which corresponds with the magnet passing downwardly past the pick-up, and the reed switch also transmits an output pulse when the left treadle 12A is moving upward, which corresponds with the movement to the magnet upwardly past the pick-up. The output pulses are used to monitor the oscillation and stroke count of the treadles as they move up and down during use. With additional sensors arranged generally vertically, it is also possible to determine the depth or vertical stroke dimension. The output pulses, alone or in combination with the belt speed signal, may be used to provide an exercise frequency display and may be used in various exercise related calculations, such as in determining the user's calorie burn rate.

As best shown in FIGS. 3, 6, and 16A-20, in one particular implementation, each treadle includes a bottom-out assembly 154. The bottom-out assembly includes a generally V-shaped bracket 156 interconnected between the inside and outside members of the treadle frame. The vertex region of the V-shaped bracket is oriented downwardly and generally defines a flat mounting surface 158. A block 160 is fixed to the lower downwardly facing portion of the mounting surface. When the exercise device is assembled it is preferable to arrange the treadles by way of the turnbuckles (134, 136) so that the block 160 is maintained slightly above the underlying lock-out cross member 162 when the treadle is in its lowest position. A bumper 164 may be fixed to the cross member 162 to cushion the treadle should it bottom out. In one example, the block is fabricated with a hard, non-flexible, plastic. The block may also be fabricated with a solid or flexible resilient polymer material. In a flexible resilient form, the block will provide some cushioning to enhance the cushioning provided by the bumper, or provide cushions when a bumper is not used, should the block bottom-out on the lock-out cross member during use.

As mentioned above, the exercise device 10 may be configured in a "lock-out" position where the treadle assemblies do not pivot upward and downward. In one particular lock-out orientation, the treadle assemblies are pivotally fixed so that the tread belts are parallel and at about a 10% grade with respect to the rear of the exercise device. Thus, in a forward facing use, the user may simulate striding uphill, and in a rearward facing use the user may simulate striding downhill.

Figure 21:
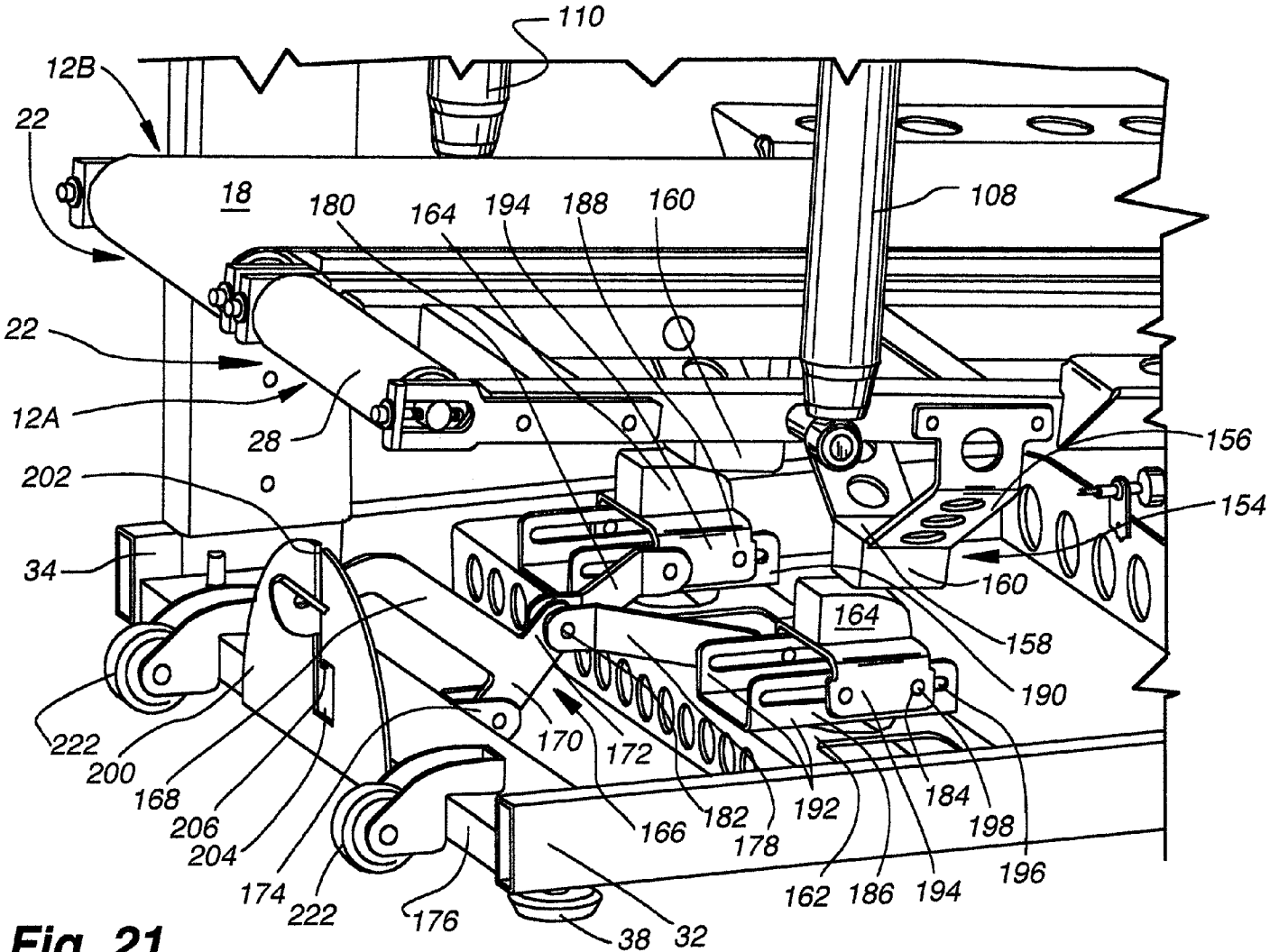
FIG. 21 is a partial cut away isometric view of the exercise device shown in FIG. 2, the view illustrating one embodiment of a lock-out mechanism used to prohibit treadle reciprocation, in accordance with the present invention.
Figure 22:
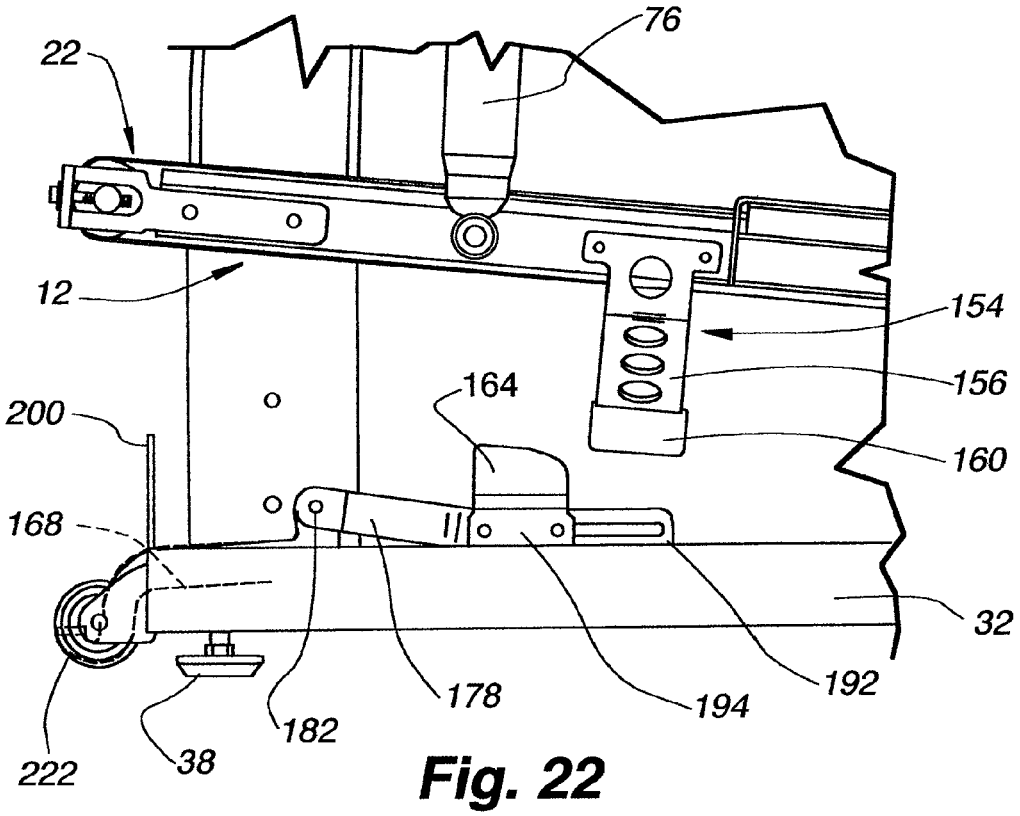
FIG. 22 is a side view of the lock-out mechanism in the unengaged position.
Figure 23:
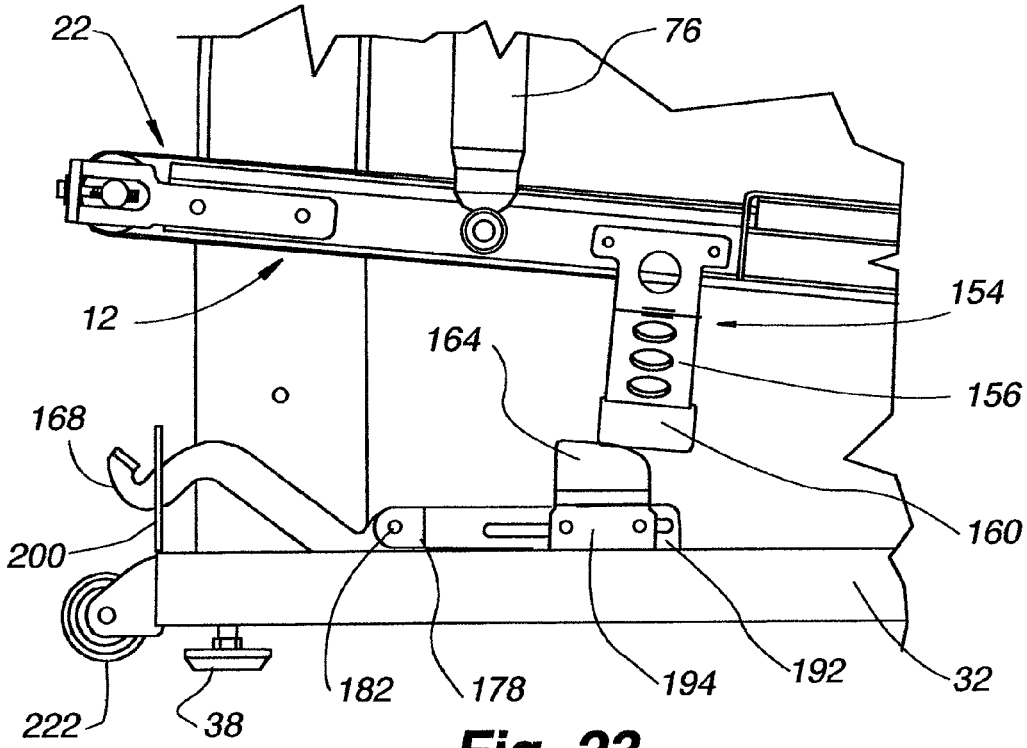
FIG. 23 is a side view of the lock-out mechanism in the engaged or locked out position.

FIG. 21 is a partial isometric view of the left front of the exercise device with the left upright removed to better illustrate one particular lock-out mechanism 166, in accordance with the present invention. FIG. 22 is a partial side view of the left front portion of the exercise device with the lock-out mechanism 166 in the unengaged position. FIG. 23 is a partial side view of the left front portion of the exercise device with the lock-out mechanism in the engaged position. The lock-out mechanism includes a generally T-shaped lever arm 168 with a lower portion 170 and an upper portion 172. The lower portion of the lever arm/latch 168 is pivotally connected with a lever bracket 174 extending rearwardly from the front cross member 176. The upper portion of the latch 168 is pivotally connected with a left 178 and a right 180 latch offset link about a common pivot axis 182. The left offset link is connected with a left slide bracket 184 that is slidably supported on a left guide bracket 186. The right offset link is connected with a right slide bracket 188 that is slidably supported on a second or right guide bracket 190. The two guide brackets are mounted on the upper surface of the lock-out cross member 162 in such a manner that each guide bracket defines a guideway extending generally in a direction between the front and rear of the exercise device. In one implementation, each guideway comprises a pair of upwardly extending sidewalls 192. The slide brackets define downwardly extending sidewalls 194 separated by a distance slightly greater then the distance between the upwardly extending sidewalls of the guide brackets. An elongate longitudinally extending slot 196 is defined in each of the guideway sidewalls. The slots are adapted to receive guide pins 198 that extend inwardly from the downwardly extending sidewalls of the slide brackets. The slide brackets are thus adapted to move forwardly and rearwardly about the guideways. The fore and aft range of the slide brackets is governed by the length of the channels and the fore and aft separation of the guide pins. The lock-out bumper 164 is connected with the top of each of the slide brackets.

As best shown in FIG. 21, an upwardly extending face plate 200 defines an upwardly extending slot 202 adapted to receive the lever arm 168. The bottom of the slot defines an offset slot 204 portion with a short downwardly extending keeper flange 206. In the non-lock out position (see FIG. 22) the lever arm is maintained in the offset slot portion and held in place by the keeper flange. To lock-out the treadles, the lever arm is first pressed downwardly to disengage it from the keeper flange, and then it is moved toward the right or away from the offset slot. Next the lever arm is raised upward in the slot. The upward motion causes the lever arm to pivot upwardly about the pivotal connection to the lever bracket 174. This upward pivoting motion is accompanied by a generally rearward motion of the upper portion 172 of the latch that causes the offset links (178, 180) to slide in the slide brackets (184, 186) and bumpers rearwardly along the guideways. A lever spring (not shown) may be connected between the lock-out assembly and one of the cross members to assist the user in moving the lock-out assembly into the "locked-out" position.

Before actuating the lock-out mechanism 162, the treadle assemblies are oriented generally level with each other, which causes the stop blocks 160 underhanging each treadle to be oriented at about the same vertical location. In this position, the lock-out assembly is moved rearwardly so that the bumpers 164 are moved rearwardly into engagement with the stop blocks 160. The rearward face of the bumpers may be tapered. As such, the bumpers may be wedged under the stop blocks to configure the exercise device in the "lock-out" position with the treadles prohibited from up and down motion.

Figure 27:
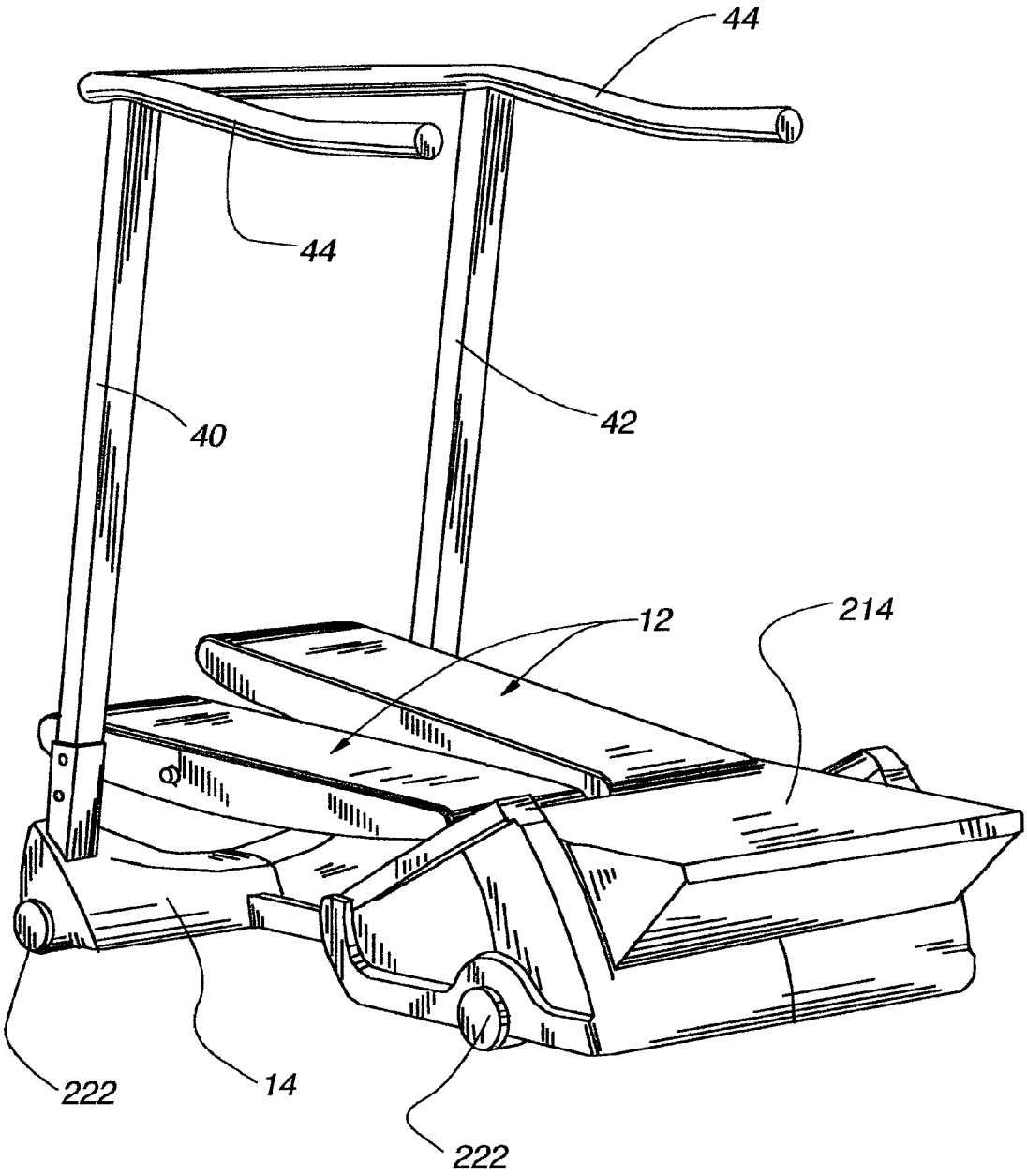
FIG. 27 is an isometric view at an alternative embodiment of the exercise device employing a rear mounting platform.

To mount the device, the user may simply step up onto the treadles 12 and begin exercising. Alternatively, the user may step onto a foot platform 208 extending outwardly from the side of each treadle assembly 12. As shown in FIG. 1, each platform defines a flat mounting surface 210 generally aligned with the adjacent treadle assembly and upper belt surface. The mounting surface may be knurled or have other similar type features to enhance the traction between the user's shoe or foot and the mounting surface. As shown in FIG. 2 and others, each platform is secured to an outwardly extending platform bracket 212. The platform bracket is secured to and extends outwardly from the left and right treadle frame members (54, 56). FIG. 27 illustrates an exercise device employing an alternative rear mounting platform 214, in accordance with the present invention. The rear mounting platform includes a single foot platform extending rearwardly from and at about the same level as the rear portion of the treadles 12.

Figure 24:
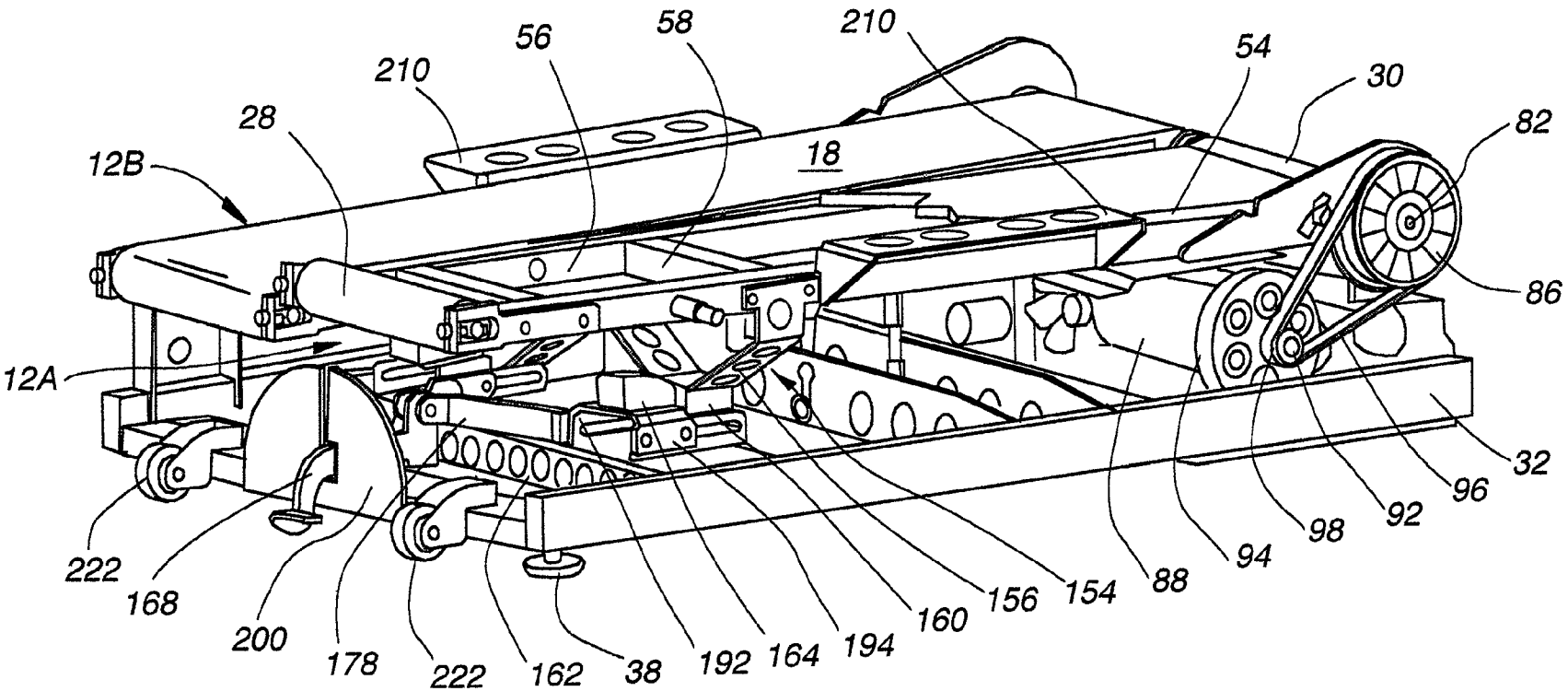
FIG. 24 is an isometric view of the exercise device of FIG. 2 configured in a shipping position.
Figure 25:
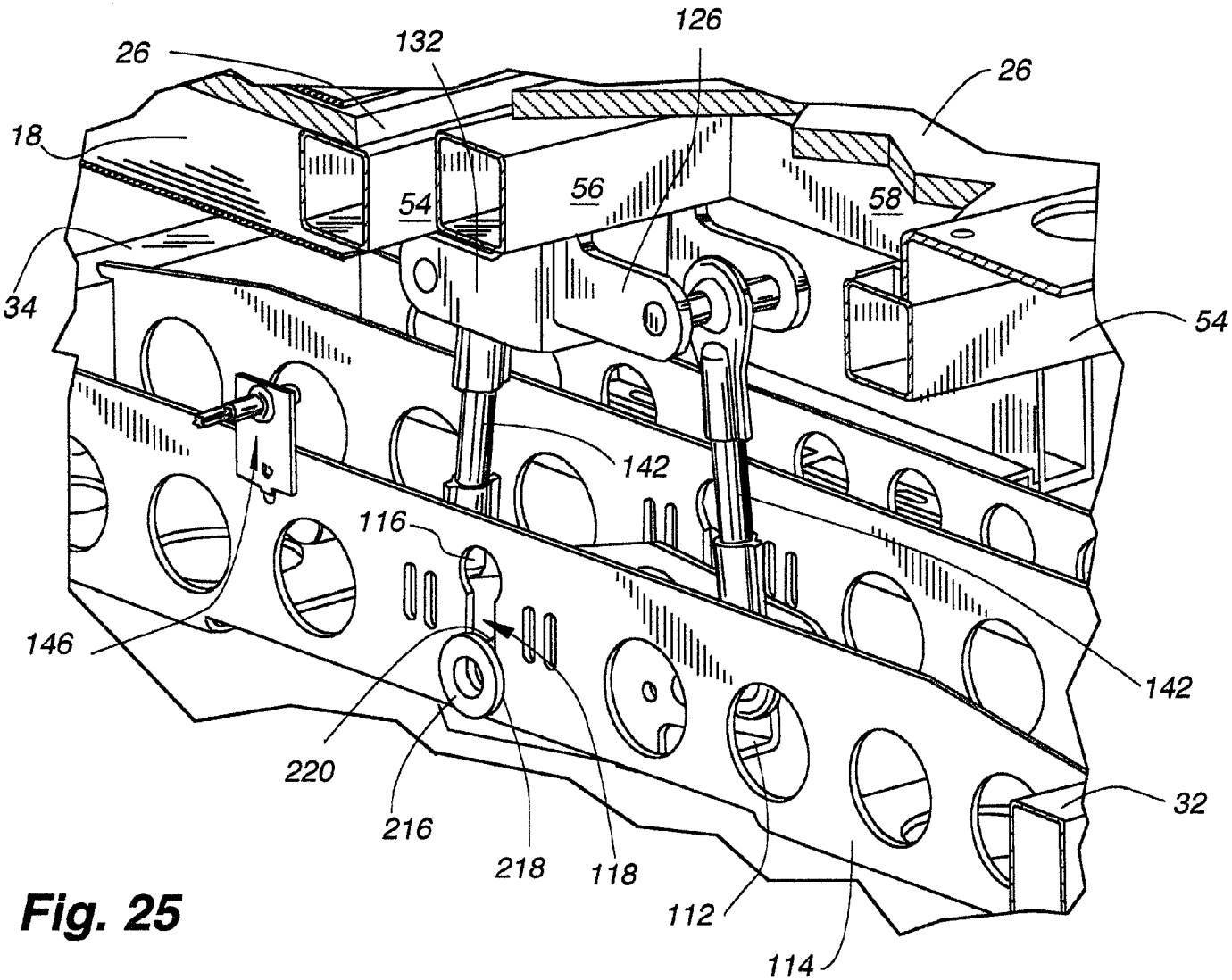
FIG. 25 is a partial cut away isometric view of the exercise device of FIG. 2 and FIG. 24, the view illustrating the rocker arm lowered into the shipping position.

To facilitate shipping the exercise device, some implementations of the exercise device may be configured so that the treadles 12 may be lowered into a shipping position from which the treadles may be easily moved upward and snapped into the operating position. FIG. 24 is an isometric view of the exercise device lowered into the shipping position, and with the left 40 and right 42 uprights and console 50 disconnected from the exercise device 10. FIG. 25 is a partial isometric view of the rocker arm assembly 112 lowered into the shipping position.

For an exercise device configured so that it may be lowered into the shipping position, the rocker arm pivot axle 120 is spring loaded so that it may be lowered in the key ways 116. As best shown in FIG. 15, each end of the rocker arm pivot axle includes an end cap 216. Each end cap includes a circumferential flange 218 of a diameter greater than any portion of the key way 116 including the pivot aperture 118. The end cap also defines a collar 220 arranged inwardly of the flange 218. The collar is of a diameter greater than the downwardly extending key way slot, but less than the diameter of the pivot aperture. The collar supports the rocker assembly 112 in the pivot aperture during use. To lower the rocker assembly, the end caps 216 are extended outwardly from the rocker arm. The collar is supported on a lesser diameter rod (the pivot axle) that is exposed when the cap is pulled out. The pivot axle is dropped down in the key ways, as shown in FIG. 25. Lowering the rocker arm causes the treadles 12 to pivot downwardly until the stop blocks 160 bottom out on the lock-out cross member 162. To configure the exercise device in its exercise or "use" orientation, the rocker assembly is lifted up, such as by lifting the front of the treadles, so that the pivot axle moves upward in the key ways to the pivot aperture. Because the pivot axle is spring loaded, when the axle is aligned with the pivot aperture the collars 220 snap inwardly into the pivot aperture. In this position, the rocker arm is firmly secured in the pivot apertures and ready to use.

A pair of wheels 222 are connected with the front cross member 176. A rear panel 224 (see FIG. 7) of the exercise device 10 includes a pair of handles 226. The handles are elongate apertures, but other handle structures may be used. By lifting the rear of the device, the wheels engage the surface that the device is resting on. In this manner, the user may easily roll the exercise device to a different location. Alternatively, a wheel or wheels may be provided at the rear of the device and handles located at the front. Although two wheels are shown, one or more wheels, slide plates, rollers, or other devices may be used to ease movement of the device.

Alternative Resistance Elements

The resistance elements 76 shown and described with respect to FIGS. 28-34 and the shocks (108, 110) discussed above with respect to FIGS. 1-26, resist the downward movement of the treadles. Resisting the downward movement provides the exercise device 10 with a stable and smooth reciprocating feel during use. Moreover, resisting the downward treadle movement also absorbs some or much of the initial shock when a user steps down or lands on the belt 18, which is beneficial for the user's legs and joints. In addition, the resistance elements, some of which are adjustable, also dampen the downward movement of the treadles 12 and thereby enhances the work out, muscular exertion, and calorie burn rate of the user.

Various embodiments of an exercise device conforming to the present invention may employ a resistance device to increase or decrease the downward force required to actuate a treadle. The resistance structures herein also function, in some instances, to impart a variable and adjustable resistance to the downward movement of the treadles 12. Changing the force required to move the treadles, in turn, changes the amount of exertion required by the user to actuate the treadles. Thus, the exercise device may be configured to provide various levels of exertion a user must employ during use of the exercise device. In addition, the belt speed may also be adjusted to increase or decease the levels of exertion a user must employ during use of the exercise device. The resistance and belt speed may be adjusted alone or together to provide a wide range of exercise levels.

Unlike the resistance elements illustrated in FIGS. 1-26, the resistance elements described below with regard to FIGS. 28-34 are located under the treadles. These arrangements provide alternative aesthetic arrangements of an exercise device conforming to the present invention, amongst other advantages. Additionally, in some instances, a single resistance element or coordinated resistance elements may be employed to act collectively on both treadles. These arrangements facilitate uniform resistance for both treadles, which helps to ensure that equal force is required to actuate both treadles. These arrangements also facilitate single point adjustment of the resistance.

Figure 28:
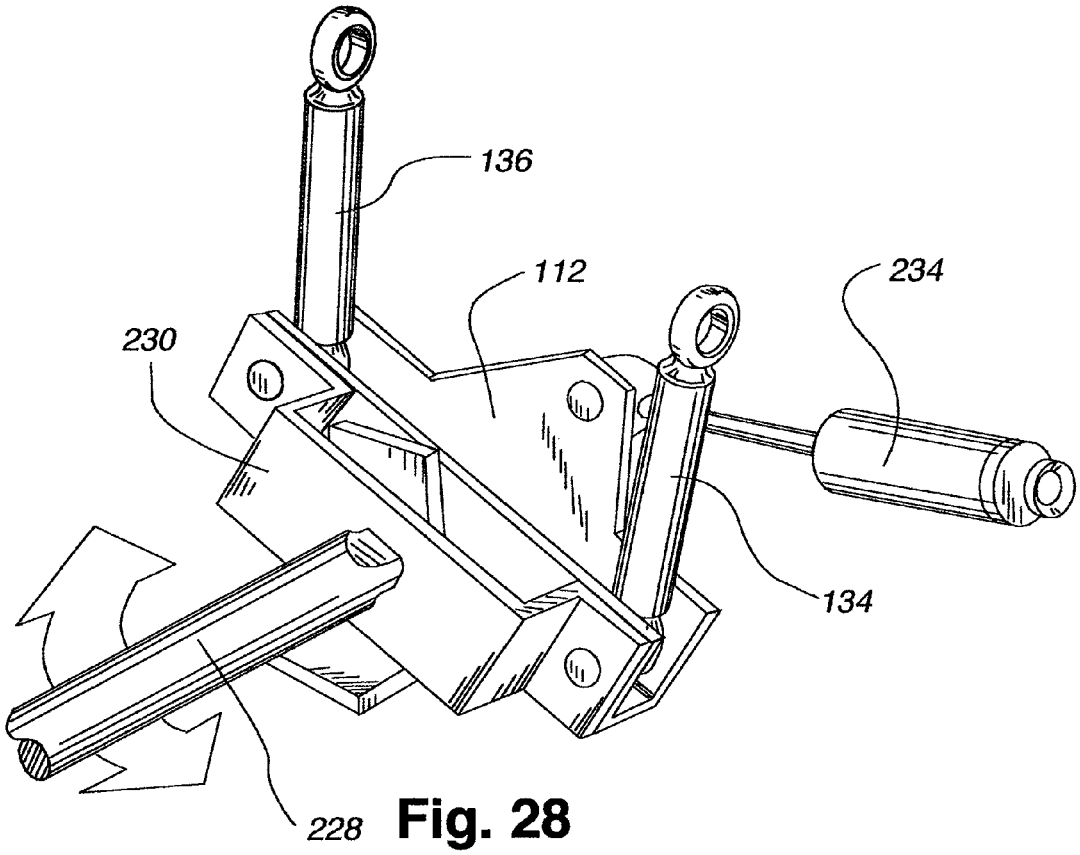
FIG. 28 is an isometric view of an alternative resistance element, in accordance with the present invention.

FIG. 28 illustrates an alternative resistance element 76, in accordance with one embodiment of the preset invention. Much of the exercise device 10 is not shown in FIG. 28 and the other figures below to clearly illustrate the resistance structures. The resistance element of FIG. 28 comprises a rotationally elastic member 228 interconnected between the rocker arm assembly 112 and the frame 114. In one particular implementation, one end of a rotationally elastic rod, such as spring steel rod, is fixed to the rear face of a bracket 230 connected to the rocker arm. The rod is generally coaxially aligned with the rocker pivot axle 120. The opposite end of the rod may be fixed to a frame cross member (not shown in FIG. 28). One end of the rod may also be connected with the front of the rocker arm assembly, and the opposite end fixed to the lock-out cross member 162. During use, the pivoting or teetering motion of the rocker arm causes the rod to twist back and forth. The characteristics of the rod cause it to resist the twisting motion, which resists the downward movement of the treadles. When a user finishes a stroke (i.e., when one of the treadles is at the bottom of its stroke and the other at the top of its stroke) and begins to step down on the treadle in the upper position, the rod will untwist and assist in raising the treadle at the bottom of its stroke. Thus, some resistance elements disclosed herein also assist in returning a treadle to an upward movement when the user unloads the treadle.

Also as shown in FIG. 28, the rocker arm assembly 112 may also include a forwardly extending rotatably mounted pin 232 offset from the pivot axle 120 of the rocker. A two-way shock 234 may be connected with the pin and pivotally connected with the frame. Offset from the pivot axle, the pin imports a lever advantage on the shock. The longitudinal axis of the shock is aligned generally tangential to the rotatably mounted pin. Arranged as such, the shock will dampen the rocking motion of the rocker arm. Due to the rocker arms interconnection with the treadle assemblies, the shock will also act to dampen the downward movement of each treadle. The rotationally elastic rod 228 and pin/shock members may be implemented alone or in combination. When used in combination with the shock, the untwisting of the rotationally elastic rod will assist the interconnection structure in overcoming the dampening force of the shock to return the treadles from a lower position to an upper position.

Figure 29:
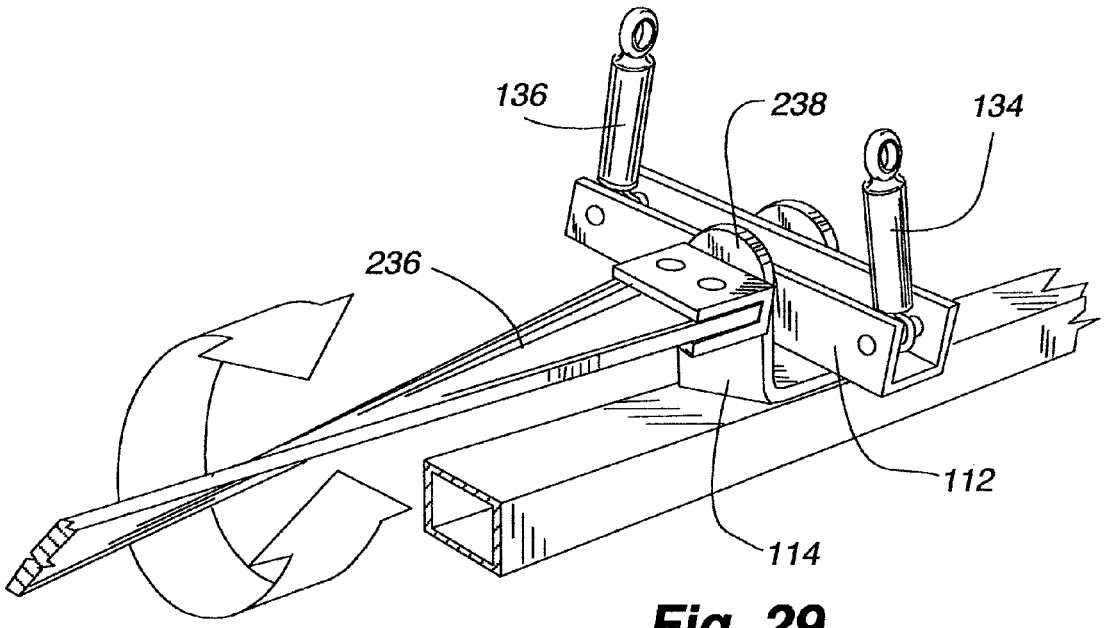
FIG. 29 is an isometric view of a second resistance element, in accordance with the present invention.

FIG. 29 is an isometric view of a depiction of an alternative resistance element 76 including one or more torsion flat springs 236 operably connected with the interconnection structure 78. The torsion flat spring is connected at one end with the rocker arm assembly 112 and connected at the other end with a frame cross member 36. In one particular implementation, the flat torsion spring is connected at one end with the cross member supporting the motor (not shown) and connected at the other end with the rocker in alignment with the rocker axle 120. An end cap flange 238 of the axle is oversized and the spring 236 is attached to it. An alternative or additional flat torsion spring may be connected at one end with the pivot axle at the front of the rocker arm and connected at the other end with the lock-out cross member 162. During use of the exercise device, the rocker arm twists the torsion flat spring back and forth. The torsion flat spring resists the teetering movement of the rocker arm. Because the rocker arm assembly interconnects both treadles, by resisting the teetering of the rocker arm, the torsion flat spring resists the downward movement of the treadles. Being twisted in conjunction with the lowering of a treadle, when the user removes his or her weight from the treadle, the torsion flat spring seeks to untwist and move the treadle upward. Thus, the torsion flat spring also assists the interconnection structure in moving the treadles upward so that the treadles will be properly oriented for the users next step.

Figure 30:
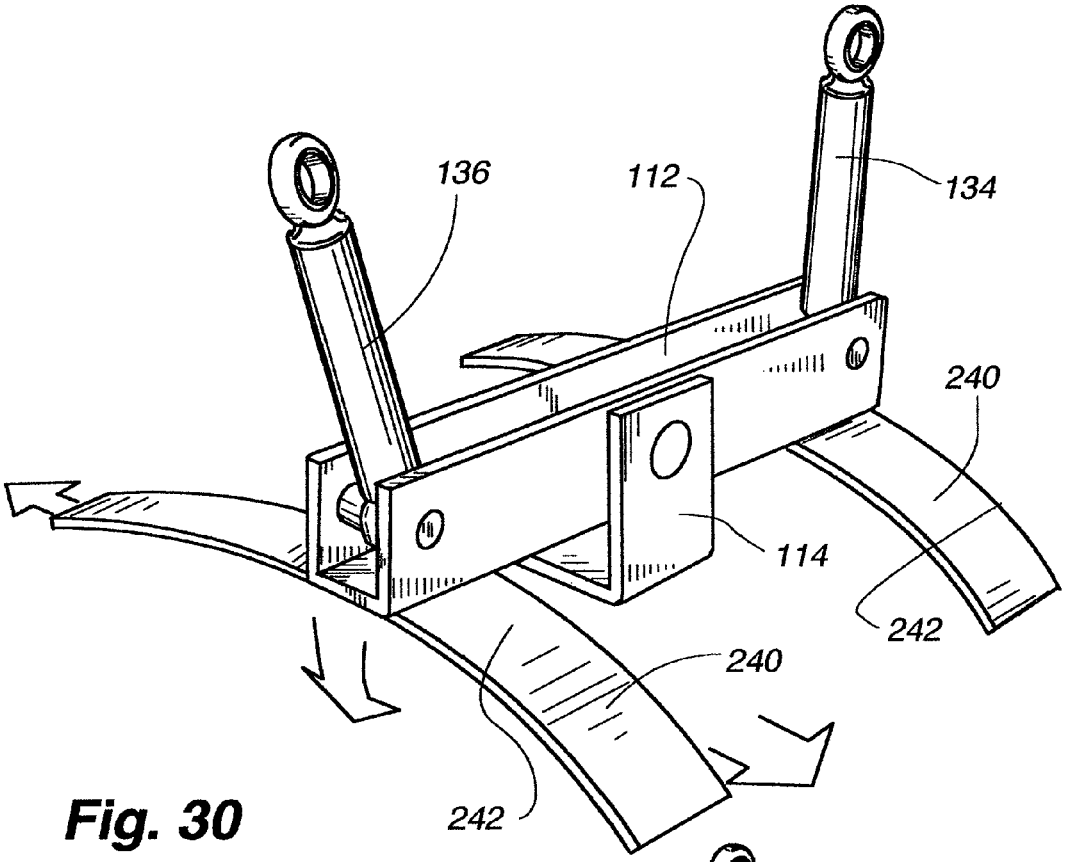
FIG. 30 is an isometric view of a third resistance element, in accordance with the present invention.
Figure 31:
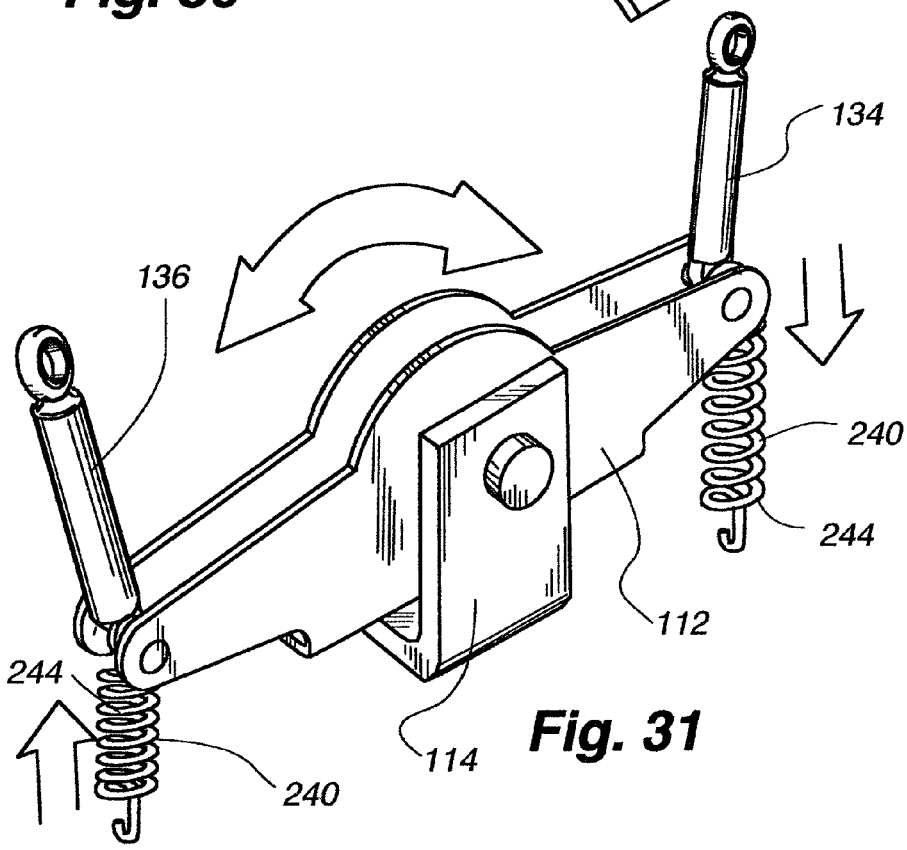
FIG. 31 is an isometric view of a fourth resistance element, in accordance with the present invention.

FIGS. 30 and 31 are isometric views of additional alternative resistance elements 76, comprising one or more springs 240 connected with the frame to engage the left and right outer portions of the rocker arm. FIG. 30 illustrates one particular resistance element implementation that employs leaf springs 242. FIG. 31 illustrates an alternative particular resistance element implementation that employs coil springs 244. Referring to FIG. 30, each spring is arranged in a manner to resist the downward motion of one end portion of the rocker arm, and to accelerate or push up the other end portion of the rocker arm. During use, a leaf spring will be deflected downward as the portion of the rocker arm pivots downwardly against it. This downward deflection will dampen the downward movement of the treadle. Moreover, when the user removes his or her weight from the treadle, the downwardly deflected leaf spring will push and/or accelerate the rocker arm and corresponding treadle upward.

As implemented in the embodiment of FIG. 31, a coil spring will resist the upward movement of the portion of the rocker arm 112 that it is connected to. Nonetheless, the coil spring 244 will also resist the downward movement of the treadles 12. For example, when the right treadle pivots downwardly, it will cause the left portion of the rocker arm to pivot upwardly against the force of the spring; thus, the left spring will act to resist the downward movement of the right treadle. In addition, when the user transfers his or her downward pressing force to the left treadle, the spring will act to pull the left portion of the rocker downwardly and pivot the right portion of the rocker upwardly against the right treadle; thus, the left spring will help return the right treadle to its upper position in preparation for the next downward push by the user.

Figure 32:
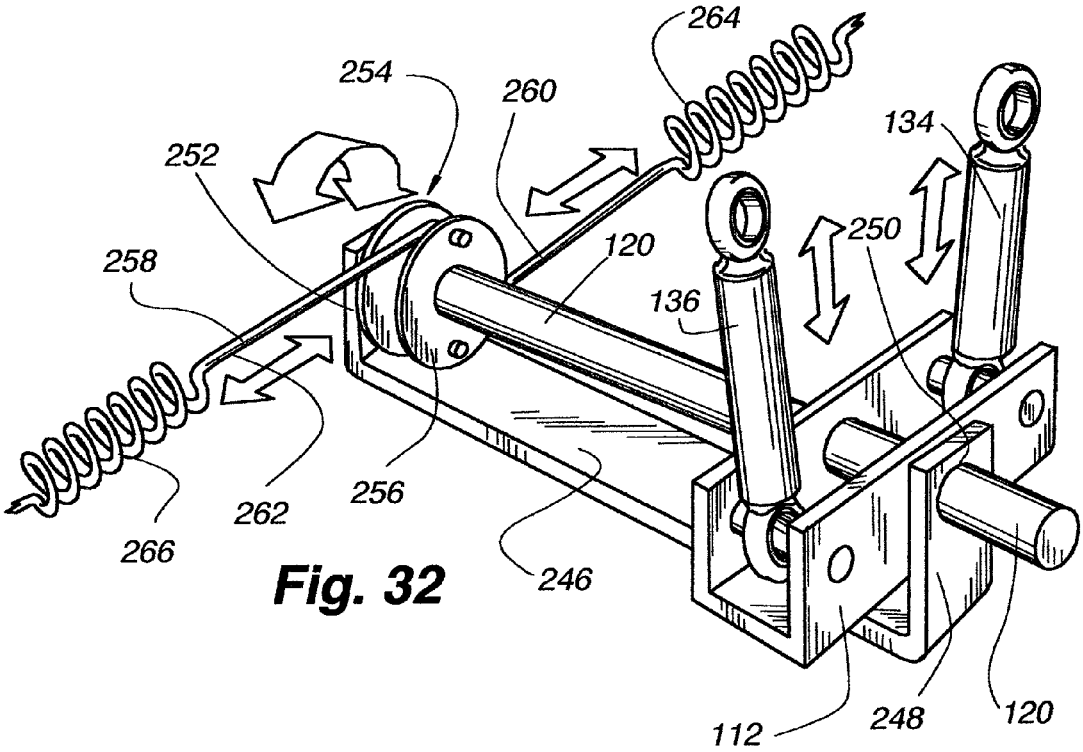
FIG. 32 is an isometric view of a fifth alternative resistance element, in accordance with the present invention.

FIG. 32 is an isometric view of yet another alternative treadle resistance element 76. In this example, the pivot axle 120 for the rocker arm 112 extends outwardly from the rocker arm and is supported in an elongated bracket 246. The bracket includes a first upstanding section 248 defining a first pivot aperture 250 and a second upstanding section 252 defining a second pivot aperture 254. The rocker pivot axle 120 is rot ably supported in the two pivot apertures. A pulley 256 is also connected to the pivot axle 120.

The pulley 256 is connected with a cabling and spring structure 258 in a manner to resist rotation of the pulley and to seek to return the pulley to a neutral position. As the pulley is operably connected with the pivot axle of the rocker arm, by acting on the pulley, the cabling and spring structure also resists rotation of the rocker and the associated up and down movement of the treadles. Moreover, the cabling and spring structure also seeks to return the rocker arm to its neutral position, i.e., where the two treadles 12 are about parallel. In one particular implementation, a first cable 260 is connected between the left side member 32 of the frame and either the upper or lower portion of the pulley when the pulley is in a position associated with the neutral position of the rocker arm 112. A second cable 262 is connected between the right side member 34 of the frame and the opposite portion of the pulley. Thus, if the first cable is connected to the lower portion of the pulley, then the second cable will be connected to the upper portion of the pulley. A spring 264 is interposed between the side member (32 or 34) and one of the cables (260 or 262). A second spring 266 may be interposed between the other side member and the other cable. In such an arrangement, a pivoting rocker arm causes rotation of the pulley 256, which winds the cables around the pulley and stretches the spring or springs. Thus, the spring resists the rotation of the pulley, dampens the pivoting of the rocker arm, and resists the associated downward movement of one of the treadles. In addition, when the load is removed from a downwardly oriented treadle, the spring will rotate the pulley in a manner to move the treadle upward.

Figure 33:
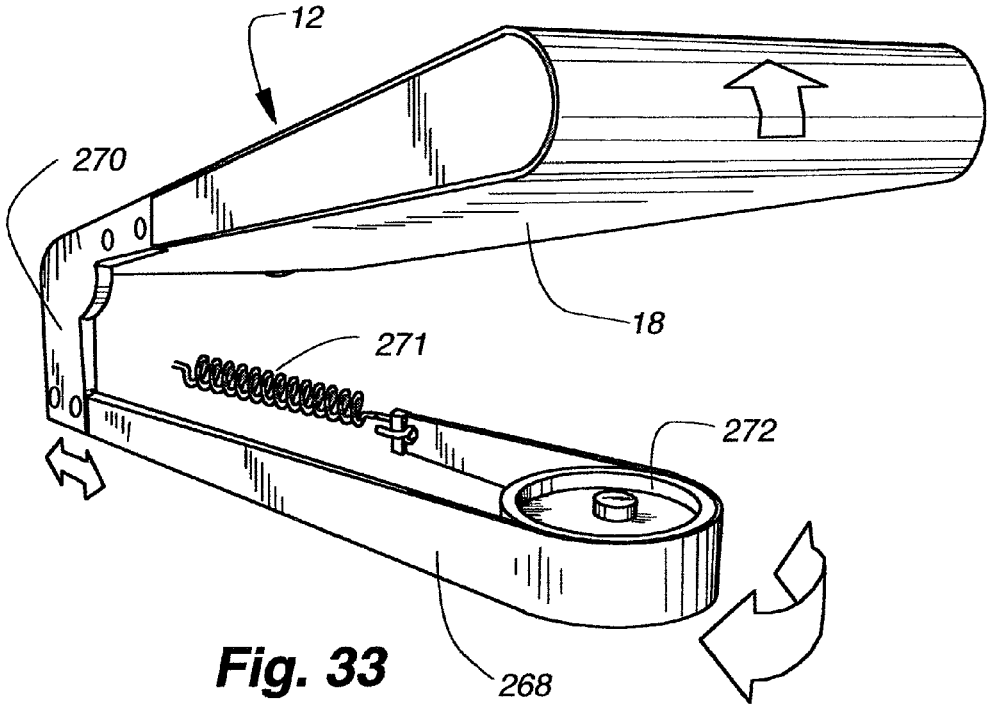
FIG. 33 is an isometric view of a sixth alternative resistance element, in accordance with the present invention.

FIG. 33 is an isometric view of a resistance element 76 that employs a felt backed nylon belt 268, in accordance with one embodiment of the present invention. For this embodiment, a bracket 270 extends downwardly from the rear of a treadle 12. The bracket is arranged to pivot forwardly and rearwardly with the treadle about the drive axle axis 82. A pulley 272 is mounted to the main frame forwardly of the bracket. The felt back nylon belt is connected at one end to the bracket 270 and routed around the pulley and connected at the other end by way of a spring 271 to the frame 14. In such an arrangement, the felt-backed nylon belt resists the downward motion of the treadle.

Downward movement of the treadle 12 causes the bracket 270 to pivot rearwardly and pull on the belt. The pulley 272 is configured to not rotate; thus the friction between the belt 268 and the pulley coupled with the expansive resistance of the spring acts to resist and dampen the downward movement of the treadle. By tightening or loosening the belt, the downward resistance of the treadle may be increased or decreased, respectively. Increasing or decreasing the downward resistance will affect the amount of force required by the user to actuate the treadles.

Figure 34:
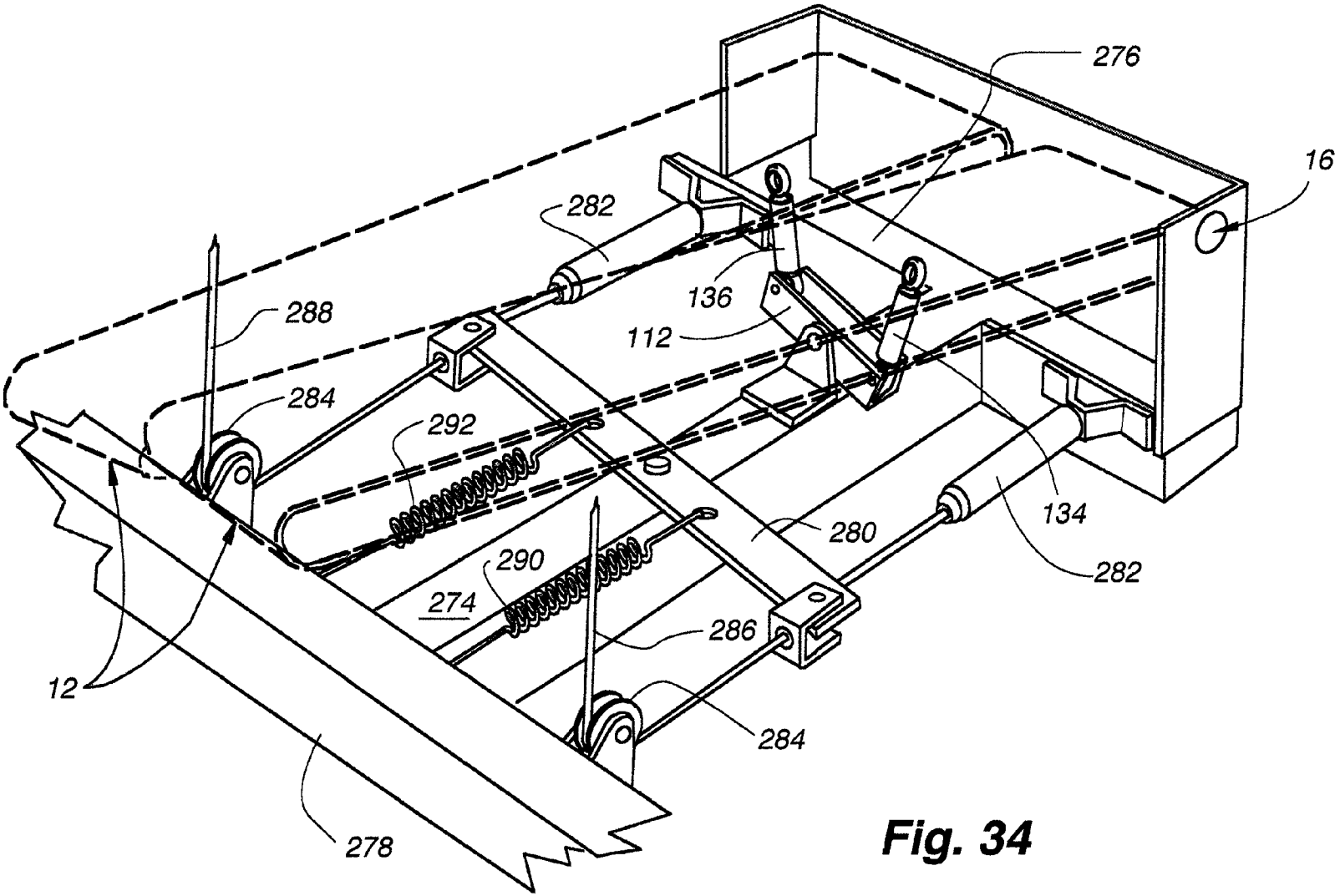
FIG. 34 is an isometric view of a seventh alternative resistance element, in accordance with the present invention.

FIG. 34 is an isometric view of an exercise device employing an alternative treadle resistance assembly 76, in accordance with the present invention. In this implementation, a center member 274 is longitudinally disposed between a rear cross member 276 and a forward cross member 278. The rocker arm assembly 112 is mounted on the center member 274. The rocker arm assembly in this embodiment of the exercise device is substantially rearwardly of its illustrated location in FIGS. 1-25. A second rocker arm 280 is also pivotally mounted on the center member 274. The second rocker is forward of the first rocker 112, and arranged so that the second rocker arm pivots in a generally horizontally plane. Shocks 282 are connected between each outer end region of the second rocker arm and the rear cross member 276. A left and a right pulley 284 are mounted on the forward cross member 278. A cable 286 is connected to the left portion of the second rocker 280, routed under the left pulley 272, and routed up to the bottom of the left treadle 12 assembly and connected thereto. A second cable 288 is connected to the right portion of the second rocker, routed under the right pulley, and routed up to the bottom of the right treadle assembly and connected thereto. A spring 290 is connected between the left portion of the second rocker and the forward cross member 278. A second spring 292 is connected between the right portion of the second rocker and the forward cross member 278.

To illustrate the operation of the resistance element of FIG. 34, the following discussion assumes that the right treadle is in the lower position and that the user is pushing down on the left treadle. The downward pushing force on the left treadle is transferred through the first rocker arm 112 to cause the right treadle to begin to pivot upwardly. This upward movement of the right treadle, pulls on the right cable 288 and causes the right portion of the second rocker arm 280 to begin to pivot forwardly. The forward pivoting of the right portion of the second rocker is accompanied by a rearward pivoting of the left portion. The forward pivoting of the right portion is dampened and resisted by the expansion of the right shock 282. The rearward pivoting of the left portion of the second rocker is dampened and resisted by the compression of the left shock 282. Through the cable interconnection with the treadles, the expansion and compression of the shocks will act to dampen and resist the treadle movement.

In addition, when a portion of the second rocker pivots rearwardly, the corresponding spring (290, 292) is extended. The extended spring acts to the pull the corresponding portion of the rocker arm forward when one of the treadles is unloaded due to the user beginning to press down on the opposing treadle.

Figure 35:
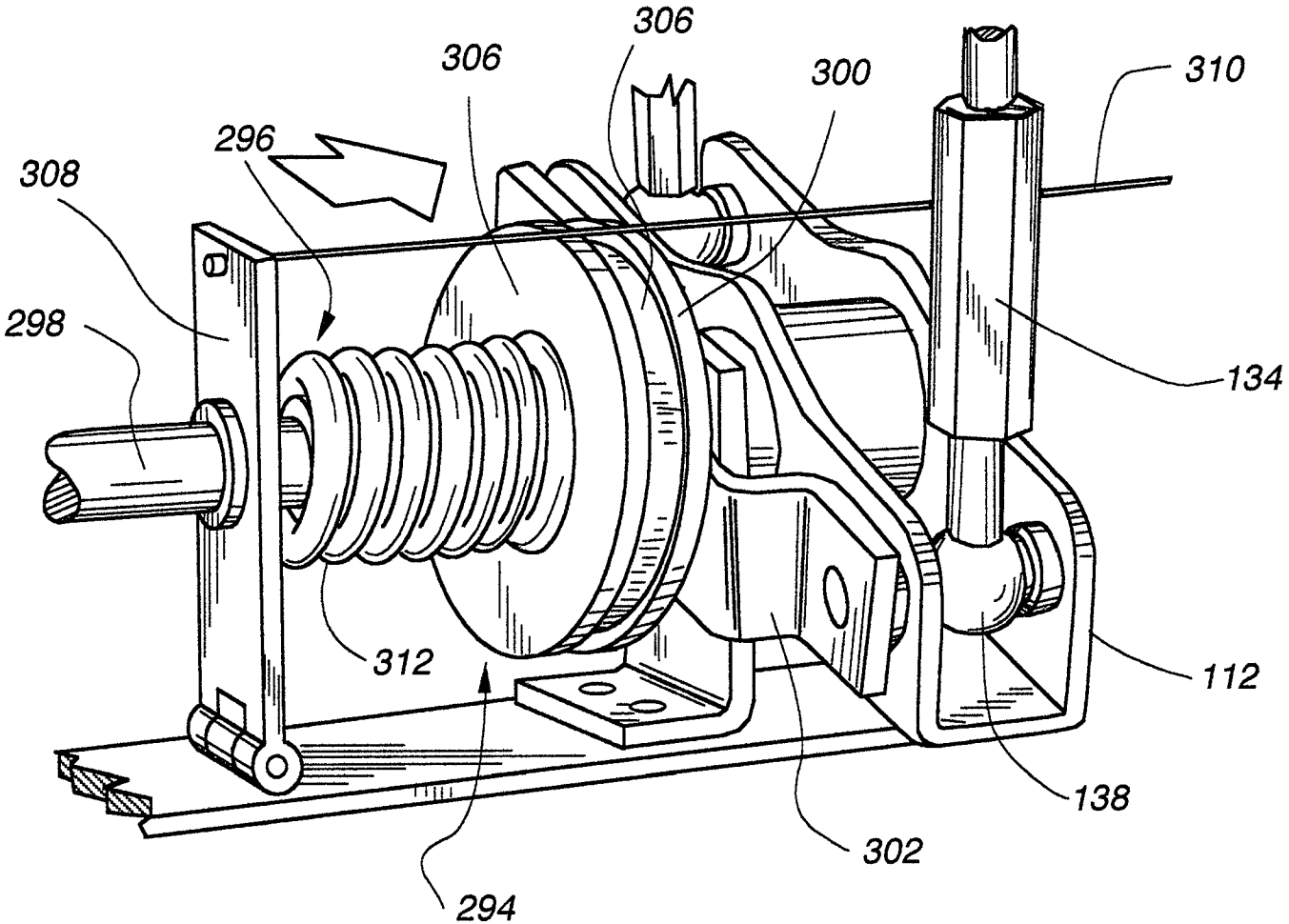
FIG. 35 is an isometric view of one embodiment of a variable treadle resistance element, in accordance the present invention.

FIG. 35 is an isometric view of a treadle resistance element 76, in accordance with one example of the present invention. The resistance assembly includes a clutch member 294 and a biasing member 296 supported on an axle 298 extending coaxially or contiguously from the rocker axle 120. In one implementation, the axle is rotationally elastic and is fixed to a cross member. Alternatively, the axle may be a rigid member. The clutch member 294 includes an inner face plate 300 fixed to a bracket 302 that is connected with the rocker arm 112 so that the bracket and inner face plate reciprocate about the rocker pivot 120 along with the rocker arm 112. The clutch member 294 also includes an outer face plate 304 connected with the axle. A clutch material member 306 is sandwiched between the inner and outer face plate.

A tensioning bracket 308 is pivotally supported to the frame below and forwardly of the clutch member 294. The axle extends through an elongate slot (not shown) in the tensioning bracket. The upper portion of the tensioning bracket is connected to a tensioning cable 310. The tensioning cable extends forwardly of the tensioning bracket and is connected at its distal end to a tensioning knob (not shown). In one particular implementation, the biasing member includes a spring 312 located between the tensioning bracket and the outer face plate 304. The spring biases the outer face plate against the clutch material 306. As such, the clutch member resists the pivoting of the rocker arm proportionally to the amount of biasing force provided by the spring. Rotation of the tensioning knob either pulls the cable, which increases the biasing force, or loosens the cable, which decreases the biasing force. In one particular implementation, the clutch member is fabricated from an ultra high molecular weight (UHMW) plastic.

Figure 36:
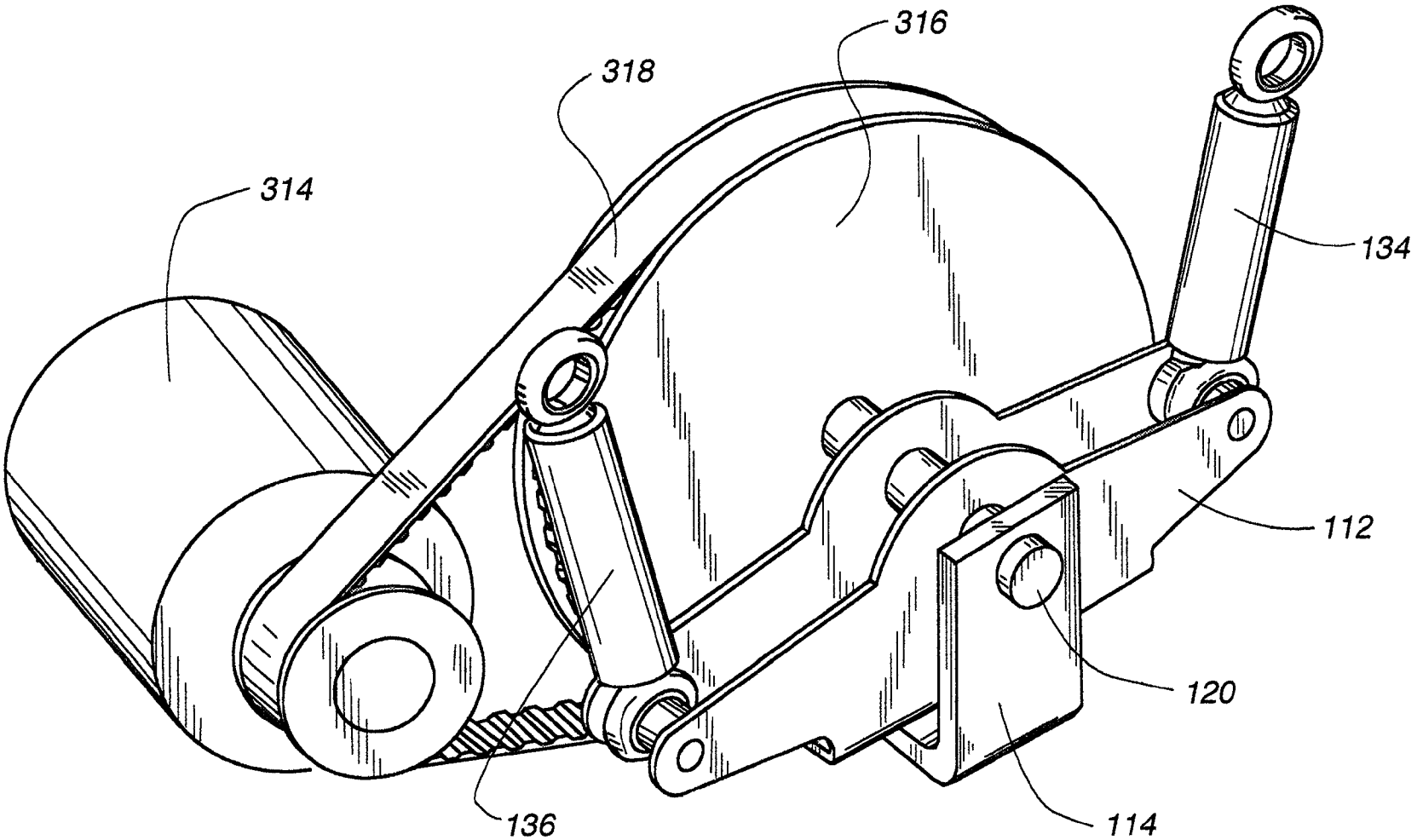
FIG. 36 is an isometric view of an alternative embodiment of a variable treadle resistance element, in accordance with the present invention.

FIG. 36 is an isometric view of a hydraulic dampening device 314 connected with the rocker assembly 112. A pulley 316 is connected to the pivot axle 120 of the rocker. The hydraulic dampening device is connected to the pulley by way of a belt 318. The hydraulic dampening device may be of the type that employs an impellar within a chamber filled with hydraulic fluid. The dampening device is configured to impact a resistance on the reciprocation of the treadle by way of the rocker.

Alternative Interconnection Structures

The interconnection structures 78 discussed herein function to coordinate the up and down pivoting movement of the treadles. For example, the rocker arm assembly 112 is one interconnection structure, in accordance with the present invention. As discussed above, the downward movement of one treadle acts through the rocker arm to cause the upward movement of the other treadle. FIGS. 37-40 below illustrate alternative interconnection structures.

Figure 37:
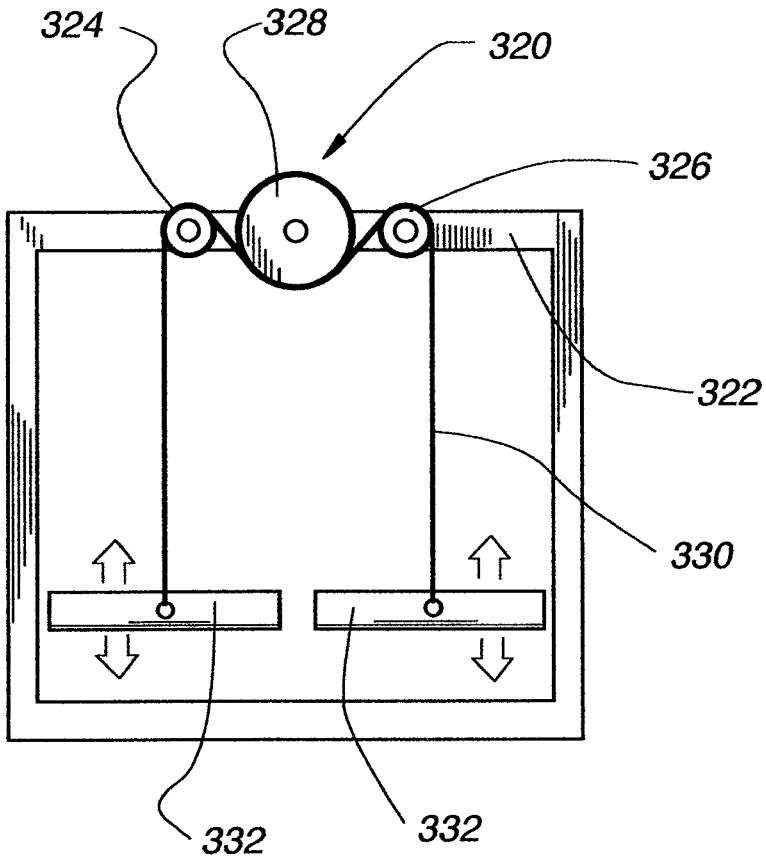
FIG. 37 is a front view of one embodiment of the exercise device employing a first alternative interconnection structure.

Referring first to FIG. 37, a stylized front view of one example of an exercise device 10, in accordance with the present invention, is shown. The exercise device includes a vertically mounted three-pulley interconnect structure 320 supported on a cross member 322 connected between the upper portions of the uprights (40, 42). A first pulley 324 is mounted to the cross member above the front of the left treadle 12A. A second pulley 326 is mounted to the cross member above the front of the right treadle 128. A third spring-loaded pulley 328 is mounted to the cross member between the first and second pulleys.

A cable 330 is routed through the three-pulley interconnect structure and between each treadle 12. Particularly, the cable is connected to the front of each treadle assembly, and is routed over the top of the first and second pulleys and under the third spring-loaded pulley. Routed as such, the downward movement of one treadle will create a downward force on the part of the cable connected to the treadle. Where a cable or dampening element is connected with the front of the treadle, a plate 332 is coupled with the treadle frame in a manner to extend in front of the front roller (not shown) to provide a surface to attach the cable or other structures. The downward force will be transferred through the cable and pulley structure to create an upward force on the cable connected with the other treadle. Thus, the cable and pulley structure provides an interconnection structure whereby the downward movement of one treadle causes an upward movement of the other treadle.

The third pulley 328 is optional and may or may not be spring-loaded. When spring loaded, the third pulley also provides a dampening force against the cable regardless of which way the cable is moving. Thus, downward movement of each treadle will be dampened by the third spring-loaded pulley via the cable. As such, the interconnection structure may be configured to also provide a treadle dampening function. In addition, the cable may be fabricated with a resilient and slightly elastic material to impart some additionally dampening or cushioning of the downward treadle movement when the user is pressing down on the treadle.

Alternatively, the first and second pulleys 324, 326 are removed, and the cable 330 is routed over the third pulley. The third pulley may or may not incorporate a dampening device. The dampening arrangement provided with the third pulley may also employ similar arrangements as shown in FIGS. 28-36. For example, a rotationally elastic rod similar to that shown in FIG. 28 may be coupled to the third pulley axle, a flat spring similar as shown in FIG. 29 may be coupled to the third pulley, and a clutch arrangement or hydraulic resistance arrangement as shown in FIGS. 35 and 36, respectively, may be coupled with the third pulley, or the other pulleys.

Figure 38:
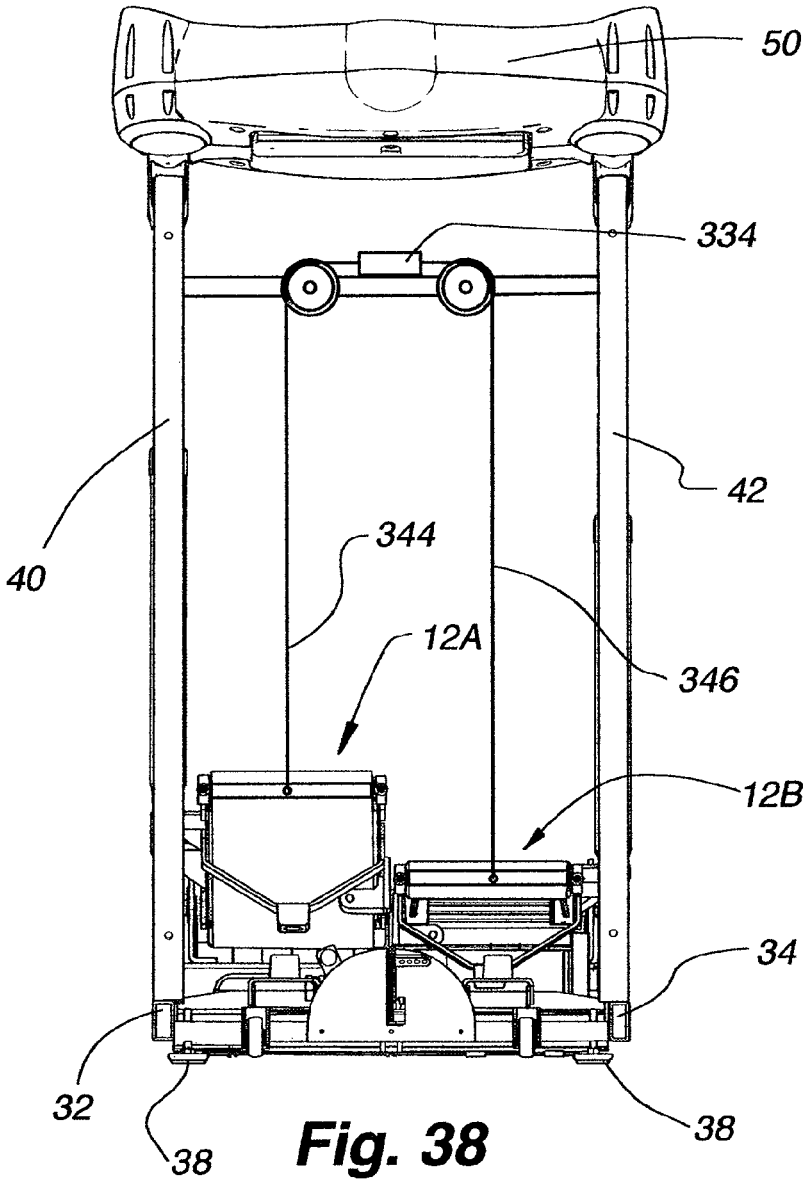
FIG. 38 is a front view of one embodiment of the exercise device employing a second alternative interconnection structure.
Figure 39:
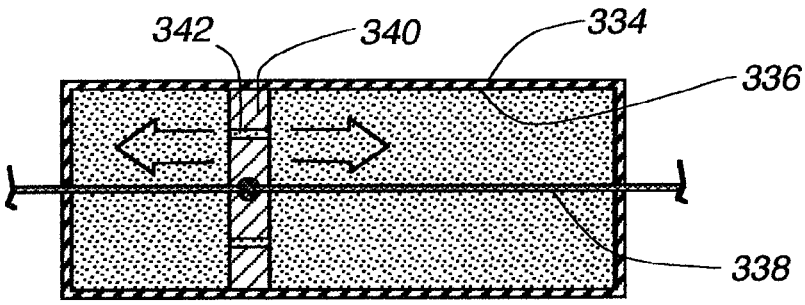
FIG. 39 is a section view of one embodiment of a dampening shock for use in conjunction with the interconnection structure of FIG. 36.

FIG. 38 is a front view of an exercise device, in accordance with the present invention, employing an alternative interconnection system including a pair of pulleys (324, 326) and a hydraulic dampening assembly 334. FIG. 39 is a section view of the dampening assembly. In this embodiment, the first and the second pulley are mounted to a cross member 322 similar to the embodiment shown in FIG. 37. However, in this embodiment the third pulley is replaced with a hydraulic bi-directional dampening shock horizontally disposed on the cross member between the two pulleys. Of course, the third pulley or the bi-directional shock may be eliminated completely and the exercise device configured with an alternative dampening system or without any dampening system. As shown in FIG. 39, the bi-directional shock includes a shock cylinder 336 holding hydraulic fluid. A piston rod 338 extends through the cylinder and extends outward from each end of the shock. A piston 340 having an outer diameter substantially the same as the inner diameter of the cylinder is connected with the piston rod. The piston defines at least one aperture 342 through which fluid may flow in either direction. Thus, the shock is configured to resist both left and right movement.

A right cable 344 is connected to the front of the right treadle assembly 12B, routed over the right pulley 326, and connected with right end of the piston rod 338. A left cable 346 is connected to the front of the left treadle assembly 12A, routed over the left pulley 324, and connected with the left end of the piston rod. Downward movement of the right treadle, pulls the right cable downward, which is transferred via the cable to a rightward movement of the piston rod and piston. Downward movement of the left treadle, pulls the left cable downward, which is transferred via the cable to a leftward movement of the piston rod and piston. Thus, the shock dampens the downward movement of each treadle. In addition, the piston rod transfers the downward force of one treadle to an upward force on the other treadle.

Figure 40:
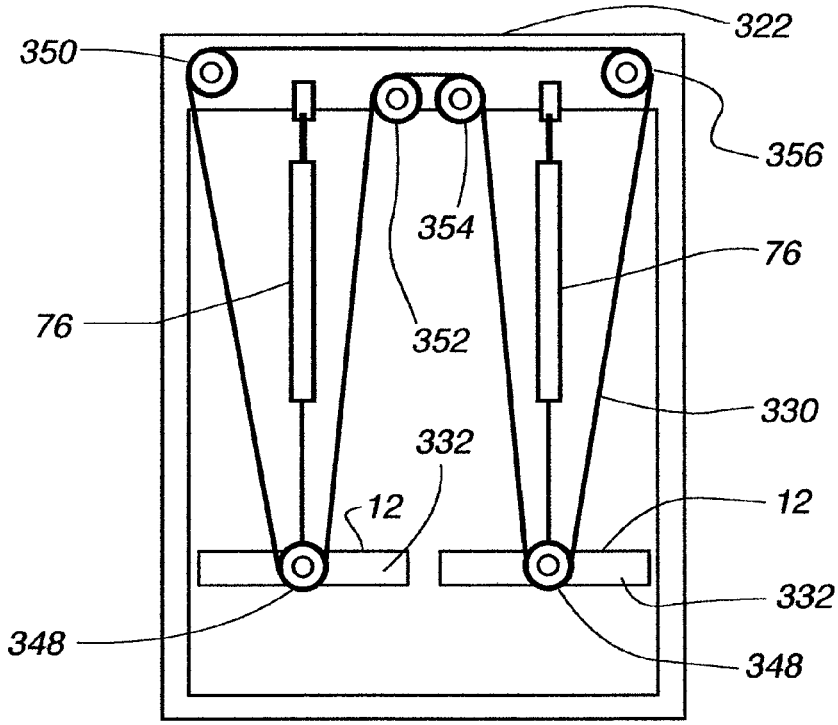
FIG. 40 is a front view of one embodiment of the exercise device employing a third alternative interconnection structure.

FIG. 40 is a front view of one example of an exercise device employing a mutli-pulley interconnection arrangement. A pulley 348 is connected to the front portion of each treadle assembly 12. The pulleys are arranged tangentially to the upper run of the tread belt 18. Four pulleys are positioned above the ends of the treadles on an upper cross member 322. A first pulley 350 is pivotally mounted to the upper cross member above the forward right corner of the right treadle. A second pulley 352 is pivotally mounted to the upper cross member 322 above the forward left corner of the right treadle. A third pulley 354 is pivotally mounted to the upper cross member above the forward right corner of the left treadle. A fourth pulley 356 is pivotally mounted to the upper cross member above the forward left corner of the right treadle.

A single cable 330 is routed in a serpentine manner around the six pulleys. The cable is routed over the top of the outer first 350 and fourth 356 pulleys, is routed down and under the treadle pulleys 348, and routed over the inner second and third pulleys (352, 354). In this manner, the downward movement of one treadle causes an upward force to be imparted on the other treadle. Having a multiple pulley arrangement, such as is shown in FIG. 40, distributes the treadle load to multiple pulleys and to multiple portions of the cable, in this case four sections of the cable.

In FIG. 40, resistance elements 76, in this case shocks, are connected between the upper cross member and the plate 332 at the front of each treadle. The shocks may be the same as discussed with regard to FIGS. 1-2 and others, and may or may not employ internal return springs.

Figure 41:
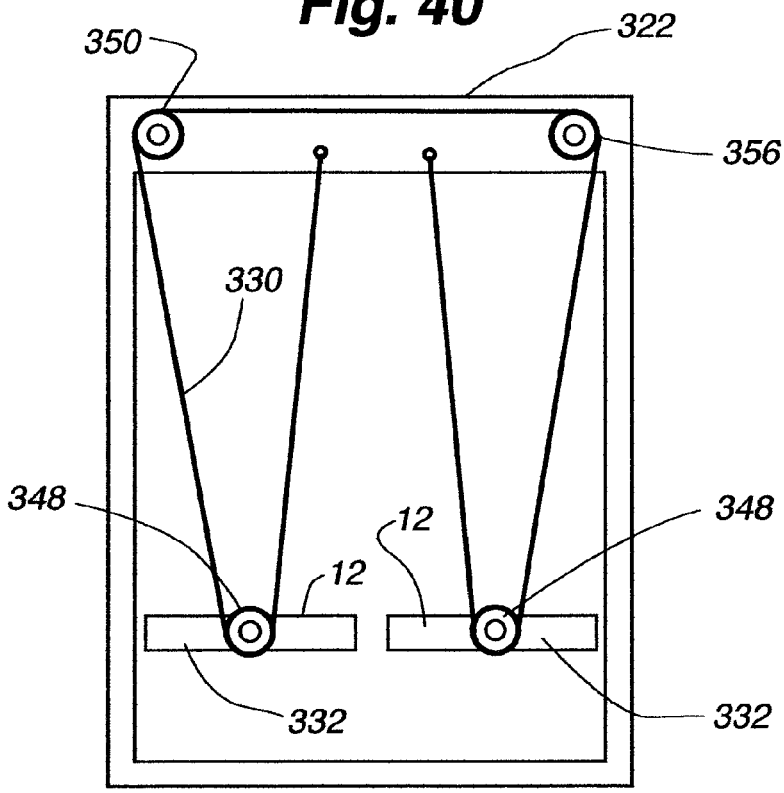
FIG. 41 is a front view of one embodiment of the exercise device employing a second alternative interconnection structure.

FIG. 41 is a front view of another example of an exercise device employing a multi-pulley interconnection arrangement. A pulley 348 is connected to the front portion of each treadle assembly. The pulleys are arranged tangentially to the upper run of the tread belt. In this example, two pulleys are rotationally mounted on the upper cross member. A first pulley 350 is pivotally mounted to the upper cross member above the forward right corner of the right treadle. A second pulley 356 is pivotally mounted to the upper cross member above the forward left corner of the left treadle. A single cable 330 is routed in a serpentine manner around the four pulleys. The cable is routed over the top of the first and second pulleys 350, 356, is routed down and under the treadle pulleys 348, and routed up to the cross member 322 above the inner corners of the treadles and connected thereto. Having a multiple pulley arrangement, such as is shown in FIG. 41, distributes the treadle load to multiple pulleys and to multiple portions of the cable, in this case four sections of the cable.

In some embodiments of the exercise apparatus, the belts 18 are installed on the first and second treadle assemblies 12 with substantial tension. Typically, the treadle assemblies are configured to be aligned so they are parallel to each other. However, tension in the belts tends to pull the treadle assemblies toward each other and out of alignment, which could cause the inside portions of treadle assemblies to rub against each other during operation of the exercise device 10. In order to help alleviate this condition, a skid plate 358 can be installed between the treadle assemblies to maintain the treadle assemblies in a parallel configuration with respect to each other.

Figure 42:
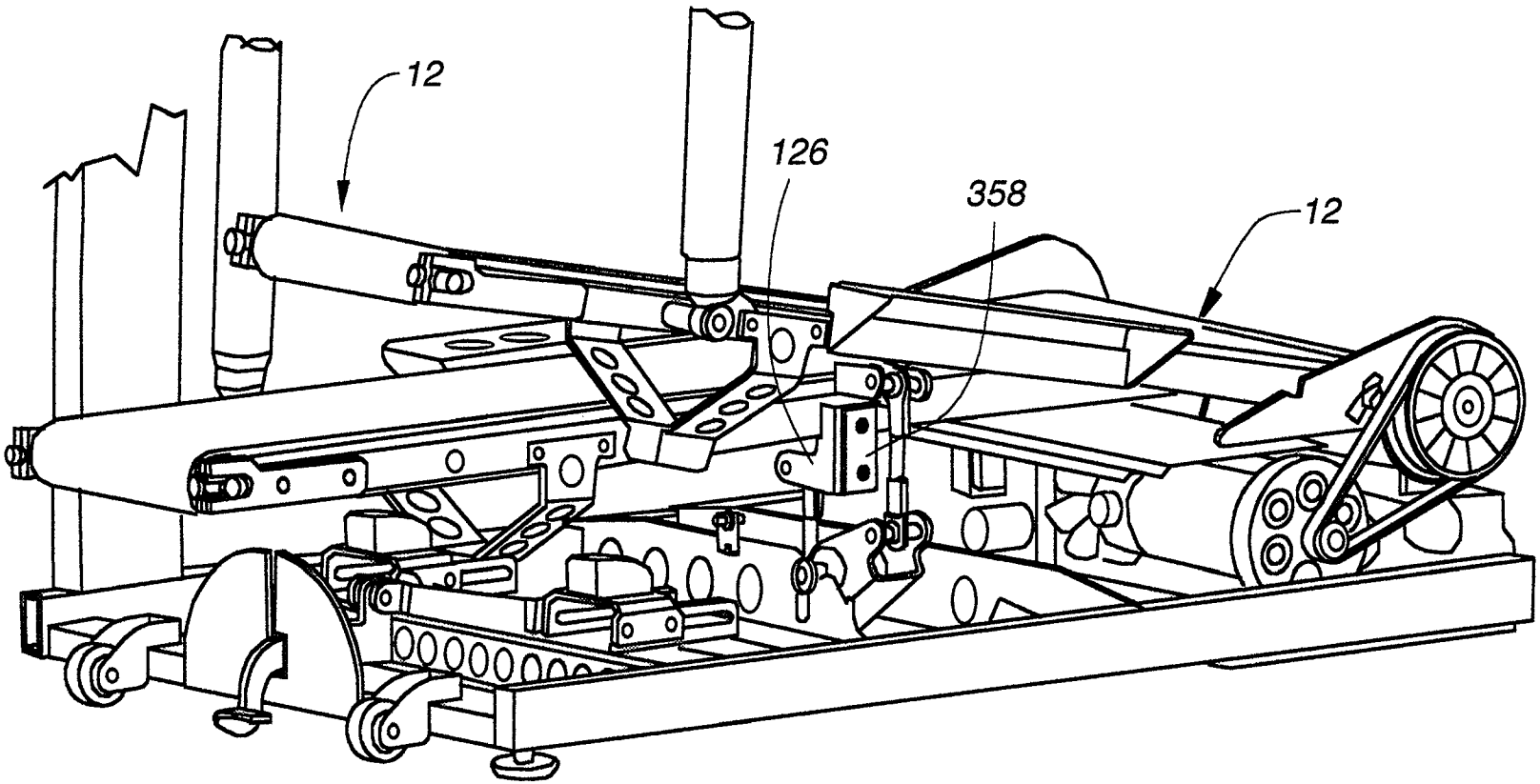
FIG. 42 is a front side perspective view of one embodiment of the exercise apparatus showing a skid plate between a right teeter bracket and a left teeter bracket.
Figure 43:
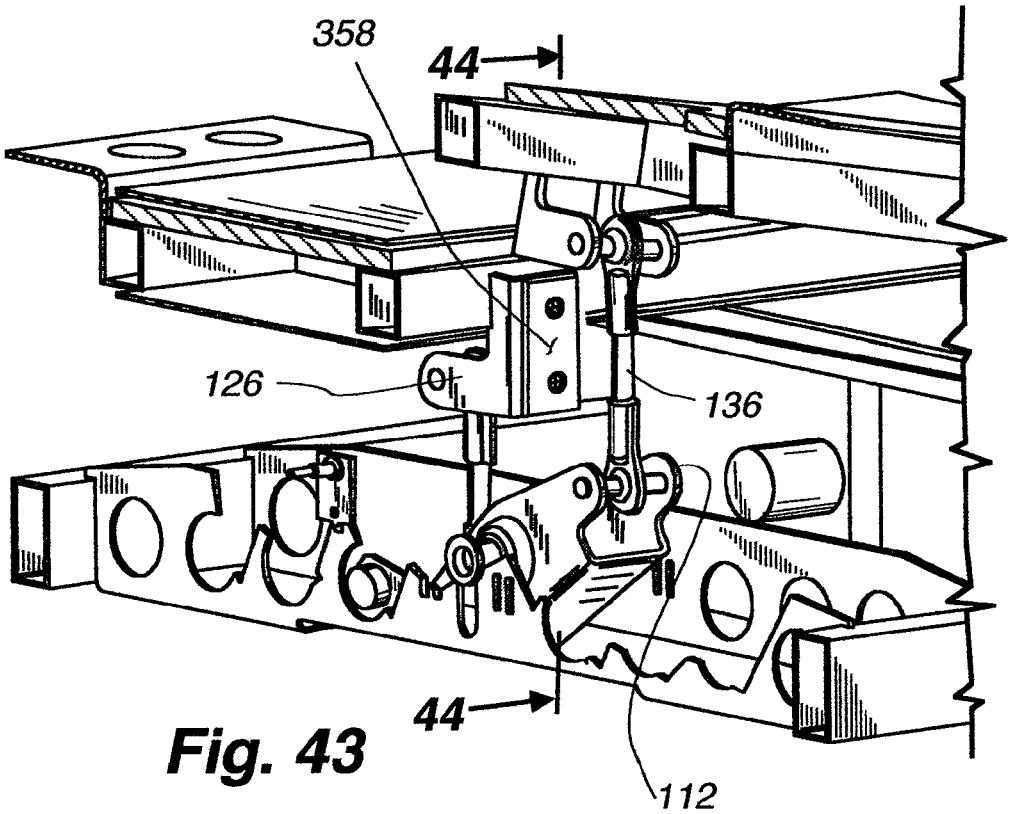
FIG. 43 shows a front side perspective view of the exercise apparatus of FIG. 42 with the right treadle assembly in an upward position and the left treadle assembly in a downward position.

As discussed above, the treadle assemblies may be interconnected with a rocker assembly 112. As shown in FIGS. 42 and 43, the skid plate can be installed on one of the inward faces of the L-brackets 126. The skid plate is thick enough to completely fill the gap between the inward faces of the opposing L-brackets 126. As the belt tension forces the treadle assemblies toward each other, the inward face of one L-bracket presses against the skid plate fixed to the opposing face, which prevents the treadle assemblies from actually moving toward each other and out of parallel alignment. Although the skid plate is depicted and discussed herein as being installed between the L-brackets of the treadle assemblies, it should be understood the skid plate can be installed between other inside portions of the treadle assemblies in order to keep maintain parallel alignment.

Because the L-brackets are forced against each other through the skid plate, frictional forces can exist on the surfaces between the skid plate and brackets. As such, the skid plate can be constructed from materials that tend to reduce these frictional forces. For example, the skid plate can be made from various materials, such as plastic, fiberglass, and the like. In one embodiment of the present invention, the skid plate is made from DuPont Delrin® 100.

Figure 44:
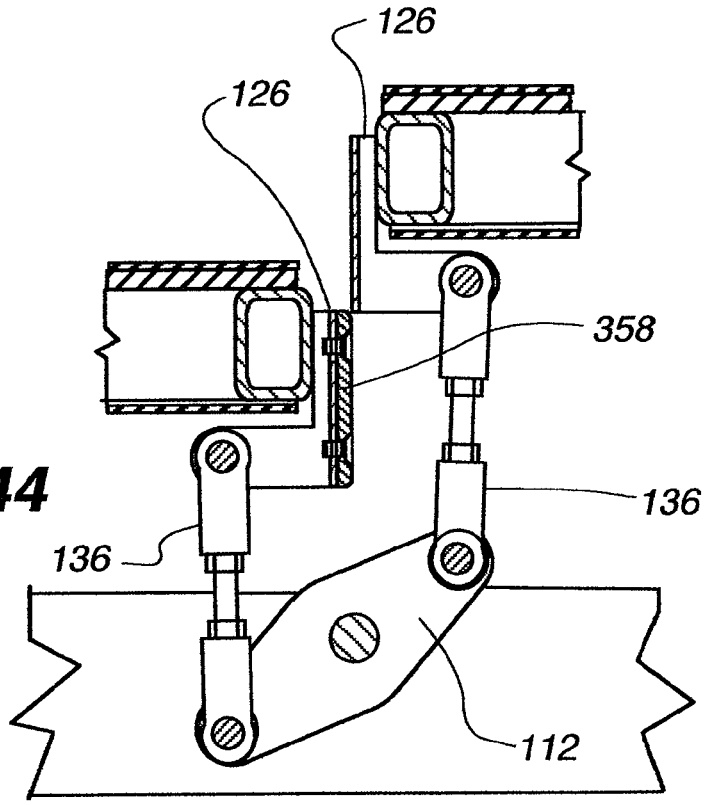
FIG. 44 shows the skid plate connected with the left teeter bracket.

The skid plate 358 can be connected with the exercise device in any number of ways to properly position the skid plate between the treadle assemblies 12. For example, the skid plate can be connected with one of the L-brackets. As shown in FIG. 44, the skid plate is connected with the inner face of the right L-bracket 126. In this configuration, the skid plate moves up and down with the right as the treadle assembly pivots. The skid plate is configured with sufficient height so the skid plate maintains contact with the inner face of the left L-bracket throughout the full range of pivot motion of the treadle assemblies. In another embodiment, the skid plate can be connected with the bottom of the frame of the exercise device and can extend upward between the L-brackets. In this configuration, both teeter brackets slide up and down on either side of the skid plate.

Figure 45:
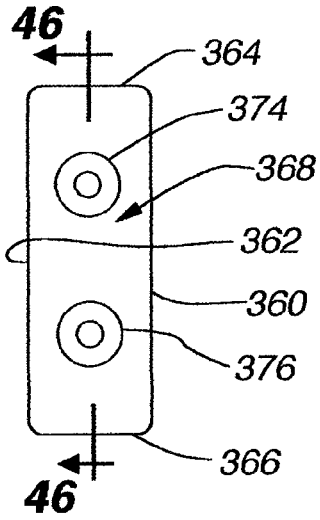
FIG. 45 shows a front side view of the skid plate according to one embodiment of the present invention.

The skid plate can be configured in various shapes and sizes. For example, as shown in FIGS. 45 and 48, the skid plate has a rectangular-shaped front side and rear side defined by a right side 360 and left side 362 separated by a top side 364 and a bottom side 366. The right side and the left side are longer than the top side and the bottom side. The thickness of the skid plate separate the front side and the rear side. As shown in FIG. 45, the front side of the skid plate is defined by a flat front surface 368. As shown in FIG. 48, the rear side of the skid plate is defined by a pattern of ribs 370.

Figure 47:
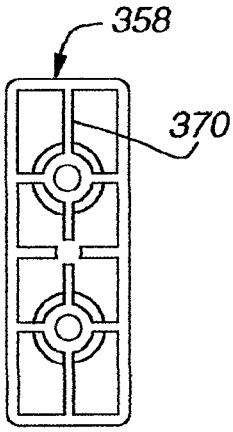
FIG. 47 shows a rear side view of the skid plate according to one embodiment of the present invention.
Figure 46A:
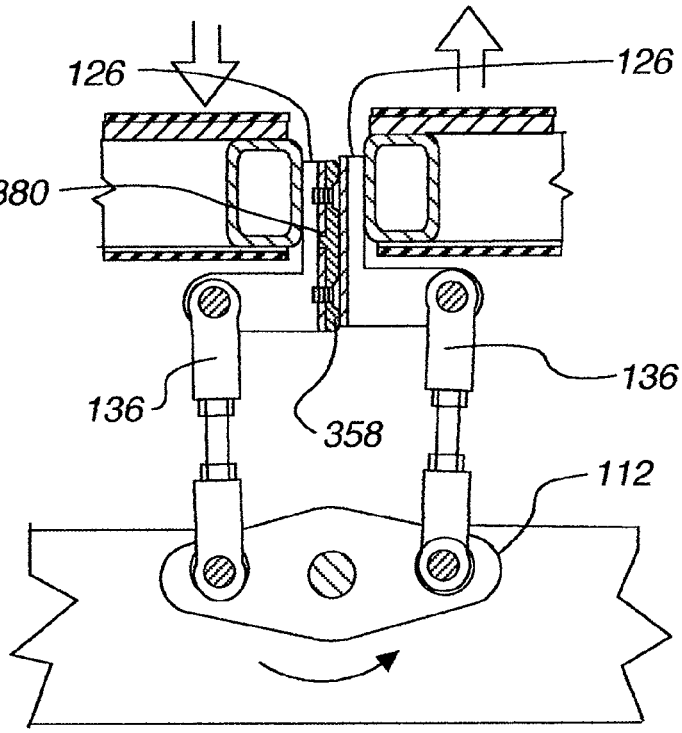
FIG. 46A shows a right side view of the skid plate taken along line 46-46 of FIG. 45 and with the treadle frames engaging the skid plate therebetween according to one embodiment of the present invention.
Figure 46B:
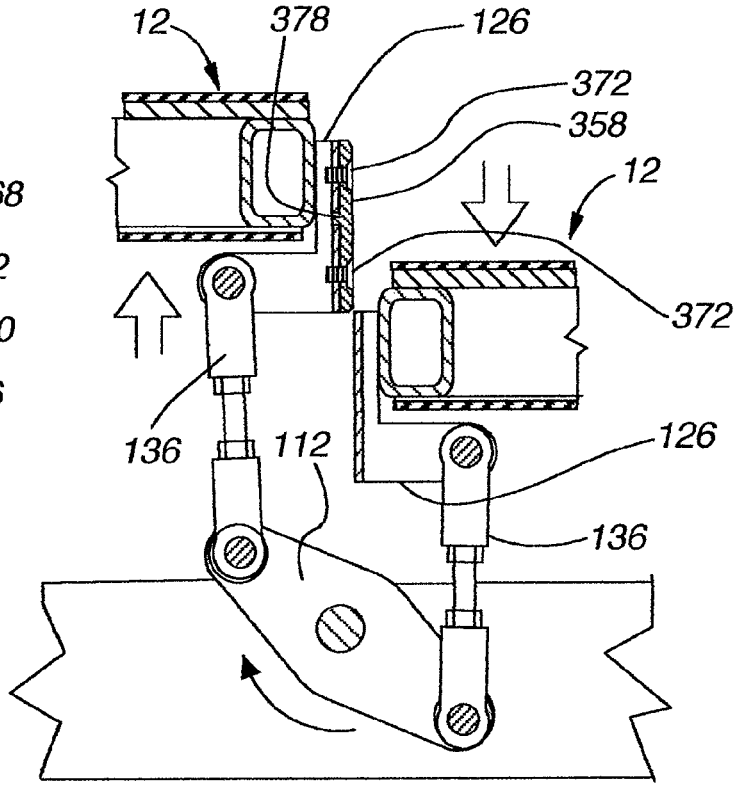
FIG. 46B shows a right side section view of the skid plate taken along line 46-46 in FIG. 45 with the treadle frames separated.

The skid plate can be connected with the L-bracket in various ways, such as with screws, rivets, glue, and the like. The skid plate shown in FIGS. 45-48 is configured to be connected with the teeter bracket with screws 372. As such, the skid plate includes a first screw hole 374 and a second screw hole 376 located along a center axis on the front surface with the first screw hole located above the second screw hole. As shown in FIG. 47, the screw holes can be beveled so the screw heads will sit flush with or below the surface of the front side of the skid plate, which prevents the screw heads from rubbing against the upper portion of the L-bracket 126 to which the skid plate 358 is not connected. To aid in proper placement of the skid plate on the inner face of the L-bracket, the skid plate includes a stub 378 extending from the rear side, as shown in FIGS. 46 and 47. When installing the skid plate on the inner face of the L-bracket, the user inserts the stub into a corresponding stub hole 380 located in the inner face of the L-bracket (see FIG. 10 showing stub hole, but not showing the skid plate), which allows the user to more easily center the screw holes of the skid plate with corresponding screw holes in the upper portion of the teeter bracket.

Although preferred embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, such joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. An exercise apparatus comprising:

a right treadle assembly having a deck and an endless tread belt that runs over the deck to provide a right moving tread surface, the right treadle assembly being pivotable about a pivot axis;

a left treadle assembly having a deck and an endless tread belt that runs over the deck to provide a left moving tread surface, the left treadle assembly being pivotable about the pivot axis;

an interconnection assembly positioned primarily below and operably connecting the right and left treadle assemblies so that pivotal movement of either of the right and left treadle assemblies in a first direction causes pivotal movement of the other of the right and left treadle assemblies in a second direction that is opposite the first direction; and a resistance element positioned primarily below the right and left treadle assemblies and coupled to the interconnection assembly to resist pivotal motion of the first and second treadle assemblies, and the resistance element including a torsion spring element coupled to the interconnection assembly to provide torsion resistance to movement of the interconnection assembly.

2. The exercise apparatus of claim 1 wherein the right and left treadle assemblies are pivotable about a pivot axle that is aligned with the pivot axis.

3. An exercise apparatus comprising: a right treadle assembly having a deck and an endless tread belt that runs over the deck to provide a right moving tread surface, the right treadle assembly being pivotable about a pivot axis; a left treadle assembly having a deck and an endless tread belt that runs over the deck to provide a left moving tread surface, the left treadle assembly being pivotable about the pivot axis; an interconnection assembly that includes a rocker having right and left arms that are coupled to the respective right and left treadle assemblies so that pivotal movement of either of first and second treadle assemblies in a first direction causes pivotal movement of the other of the first and second treadle assemblies in a second direction that is opposite the first direction; and a torsion spring resistance element positioned primarily below the first and second treadle assemblies and coupled to the interconnection assembly to resist pivotal motion of the first and second treadle assemblies.

4. An exercise apparatus comprising: a right treadle assembly having a deck and an endless tread belt that runs over the deck to provide a right moving tread surface, the right treadle assembly being pivotable about a pivot axis; a left treadle assembly having a deck and an endless tread belt that runs over the deck to provide a left moving tread surface, the left treadle assembly being pivotable about the pivot axis; an interconnection assembly that includes a rocker having right and left arms that are coupled to the respective right and left treadle assemblies so that pivotal movement of either of first and second treadle assemblies in a first direction causes pivotal movement of the other of the first and second treadle assemblies in a second direction that is opposite the first direction; and leaf spring resistance elements positioned primarily below the first and second treadle assemblies and coupled to the interconnection assembly to resist pivotal motion of the first and second treadle assemblies.

5. The exercise apparatus of claim 1 wherein the right and left spring elements include leaf spring elements to provide resistance to movement of respective right and left arms of the rocker.

6. The exercise apparatus of claim 1 wherein the right and left spring elements include coil spring elements to provide resistance to movement of respective right and left arms of the rocker.

* * * * *